US005887212A

United States Patent [19]

Ozaki et al.

[11] Patent Number: 5,887,212

[45] Date of Patent: Mar. 23, 1999

[54] DEVELOPMENT PROCESSING APPARATUS AND DEVELOPMENT PROCESSING METHOD

[75] Inventors: Takao Ozaki; Atsushi Shiraishi; Koji Wada; Nobuhiko Hirosawa; Hideaki Iijima, all of Kanagawa, Japan

[73] Assignee: Fuji Photo Film Co., Ltd., Kanagawa, Japan

[21] Appl. No.: 878,778

[22] Filed: Jun. 19, 1997

[30] Foreign Application Priority Data

| | | | |
|---|---|---|---|
| Jun. 20, 1996 | [JP] | Japan | 8-159882 |
| Sep. 9, 1996 | [JP] | Japan | 8-237989 |
| Sep. 18, 1996 | [JP] | Japan | 8-245950 |

[51] Int. Cl.[6] ..... G03D 7/00; G03D 9/00

[52] U.S. Cl. ..... 396/575; 396/580

[58] Field of Search ..... 396/575, 580; 355/27–29; 250/316.1, 317.1, 318, 319; 219/216

[56] References Cited

U.S. PATENT DOCUMENTS

| | | | |
|---|---|---|---|
| 4,660,964 | 4/1987 | Yoshikawa et al. | 355/28 |
| 4,800,275 | 1/1989 | Shimizu et al. | 250/317.1 |
| 4,992,816 | 2/1991 | Nakamura et al. | 396/580 |
| 5,520,776 | 5/1996 | Van Allen et al. | 156/584 |

FOREIGN PATENT DOCUMENTS

| | | | |
|---|---|---|---|
| 0 361 540 | 4/1990 | European Pat. Off. | G03C 8/40 |

*Primary Examiner*—D. Rutledge

*Attorney, Agent, or Firm*—Sughrue, Mion, Zinn, Macpeak & Seas, PLLC

[57] ABSTRACT

A development processing apparatus including a pair of rollers for laminating a silver halide photosensitive material on which an image has been exposed and a processing sheet containing chemicals for forming an image on the silver halide photosensitive material; a heating plate having a curved heating surface for subjecting the silver halide photosensitive material to development processing by heating the silver halide photosensitive material and the processing sheet laminated by the pair of rollers; a transport belt for transporting the silver halide photosensitive material and the processing sheet laminated by the pair of rollers along the heating surface of the heating plate to allow the heating plate to effect the development processing; and a separation roller for separating the silver halide photosensitive material and the processing sheet after completion of the development processing by the heating plate. Accordingly, since processing solutions such as a developer and a fixer are not used for the development of the photosensitive material, the efficiency in maintaining the apparatus can be improved.

33 Claims, 27 Drawing Sheets

DEVELOPMENT PROCESSING APPARATUS AND DEVELOPMENT PROCESSING METHOD

BACKGROUND OF THE INVENTION

1. Field of the Invention

The present invention relates to a development processing apparatus and a development processing method for forming an image on a silver halide photosensitive material by using an imagewise-exposed silver halide photosensitive material and a processing sheet including chemicals for forming an image on the silver halide photosensitive material as the processing sheet is laminated on the silver halide photosensitive material and is subjected to heating.

2. Description of the Related Art

Conventionally, a photosensitive material called a lithographic film is used in the printing of newspapers, magazines, and the like. In this lithographic film, each pixel represents a black dot or a white dot, and the variable density is expressed by the density of black dots in a predetermined region of the lithographic film.

By making use of the lithographic film capable of expressing the variable density in the above-described manner, a total of four originals, including an original expressing the variable density of a cyan color component for a subject color image, an original expressing the variable density of a magenta color component, an original expressing the variable density of a yellow color component, and an original expressing the variable density of a black color, are prepared by exposure and development processing. Then, as these four originals are printed in an overlapping manner by using inks corresponding to the respective colors, printed matter on which the subject color image is recorded is prepared, and this technology is well-known.

In the above-described technology, in order to prepare originals expressing variable densities of predetermined colors, the lithographic film on which variable-density images of the predetermined colors have been exposed is conventionally subjected to various kinds of processing, including development, fixation, and washing (the so-called wet processing).

However, the process of such development processing is complex. In addition, since liquids including chemicals, such as processing solutions, are used, their management is troublesome, and the staining and the like of a development processing apparatus are a cause of accelerated deterioration of the development processing apparatus.

SUMMARY OF THE INVENTION

In view of the above-described circumstances, it is an object of the present invention to provide a development processing apparatus and a development processing method whose development process is simple, which improve the efficiency in maintenance, and which produce a small amount of deterioration of the apparatus.

To attain the above object, in accordance with a first aspect of the present invention, there is provided a development processing apparatus comprising: laminating means for laminating a silver halide photosensitive material on which an image has been exposed and a processing sheet containing chemicals for forming an image on the silver halide photosensitive material; heating means having a curved heating surface for subjecting the silver halide photosensitive material to development processing by heating the silver halide photosensitive material and the processing sheet laminated by the laminating means; first transporting means for transporting the silver halide photosensitive material and the processing sheet laminated by the laminating means along the heating surface of the heating means to allow the heating means to effect the development processing; and separating means for separating the silver halide photosensitive material and the processing sheet after completion of the development processing by the heating means.

In accordance with the above-described first aspect of the invention, the silver halide photosensitive material and the processing sheet are laminated by the laminating means, and are transported along the heating surface of the heating means by the first transporting means. During the transport, the silver halide photosensitive material and the processing sheet are heated by the heating means, e.g., a heater provided therein, and chemicals contained in the processing sheet act on and develop the silver halide photosensitive material, thereby forming an exposed desired image on the surface of the silver halide photosensitive material.

Further, the heated silver halide photosensitive material and processing sheet are separated by the separating means. Thus, with the apparatus in accordance with this aspect, since the development process is simple, and processing solutions are not used, the efficiency in the maintenance of the apparatus is improved, and the amount of deterioration of the apparatus is small.

In accordance with a second aspect of the present invention, in the above-described first aspect of the invention, the separating means is arranged such that the processing sheet is separated by undergoing a change in direction with a small radius of curvature and at 90° or more with respect to a direction in which the silver halide photosensitive material and the processing sheet are transported.

In accordance with the above-described second aspect of the invention, the separating means causes the processing sheet to undergo a change in direction with a small radius of curvature and at 90° or more with respect to the direction in which the silver halide photosensitive material and the processing sheet are transported. As a result, the processing sheet is prevented from being transported together with the silver halide photosensitive material, and can be reliably separated from the silver halide photosensitive material.

In accordance with a third aspect of the present invention, the development processing apparatus in accordance with the above-described first aspect of the invention further comprises: spacing-apart means for spacing apart the processing sheet from the heating surface of the heating means when the development processing is not being effected.

In accordance with the above-described third aspect of the invention, the processing sheet is separated from the heating surface of the heating means by the spacing-apart means when the development processing of the silver halide photosensitive material is not being effected. Accordingly, the deterioration of the quality of the processing sheet can be prevented as compared with a case where the processing sheet is constantly heated by the heating means.

In accordance with a fourth aspect of the present invention, the development processing apparatus in accordance with the above-described first aspect of the invention further comprises: temperature-range maintaining means for maintaining a difference between a temperature of the silver halide photosensitive material during lamination by the laminating means and a temperature of the silver halide photosensitive material heated by the heating means during transport by the first transporting means such that the temperature difference falls within a predetermined range.

In accordance with the above-described fourth aspect of the invention, the difference between the temperature of the silver halide photosensitive material during its lamination by the laminating means and the temperature of the silver halide photosensitive material during transport by the first transporting means is maintained by the temperature-range maintaining means such that the temperature difference falls within the predetermined range. Namely, during the transport by the first transporting means, the silver halide photosensitive material is heated by the heating means, its temperature rises as compared to the time when it is laminated. However, since the difference between the temperature during lamination and the temperature during transport is maintained within the predetermined range, it is possible to prevent a sharp change in the temperature of the silver halide photosensitive material.

Generally, since the silver halide photosensitive material and the processing sheet are generally heated in a mutually laminated state, if a sudden temperature change or uneven heating occurs, there is a possibility that creases occur in the silver halide photosensitive material. As a result of experiments, it has been found that if the thicknesses of both the silver halide photosensitive material and the processing sheet which are laminated are 100 $\mu$m or thereabouts, no problem is presented. However, if those having thicknesses of 60 to 70 $\mu$m or thereabouts are used, creases occur in the silver halide photosensitive material, possibly resulting in a decline in the quality of the image formed on the silver halide photosensitive material.

In the development processing apparatus in accordance with the fourth aspect of the invention, there can be cases where silver halide photosensitive materials and processing sheets having small thicknesses of 60 to 70 $\mu$m or thereabouts are used, it is possible to prevent the occurrence of creases in the silver halide photosensitive materials even if such silver halide photosensitive materials and processing sheets are used.

In accordance with a fifth aspect of the present invention, the development processing apparatus in accordance with the above-described first aspect of the invention further comprises: preheating means for preheating at least one of the laminating means and the processing sheet prior to its lamination by the laminating means.

Specifically, since the preheating means is provided in the fifth aspect of the invention, and at least one of the laminating means and the processing sheet is preheated by the preheating means prior to its lamination by the laminating means, it is possible to prevent a sudden change in the temperature of the silver halide photosensitive material.

Thus, by providing control so that the temperature of the silver halide photosensitive material does not change suddenly, it is possible to prevent the occurrence of creases in the silver halide photosensitive material.

It should be noted that, as the silver halide photosensitive materials used in the present invention, it is possible to use sheet-like lithographic films having a characteristic whereby they are developable on heating. In addition, it is also possible to use silver halide photosensitive materials for color image formation having the characteristic whereby they are developable on heating.

As the silver halide photosensitive materials for color image formation, there are photosensitive materials which have on their bases at least a photosensitive silver halide, a binder, and a coloring material having the function of releasing or diffusing a diffusive dye in the form of an image, and which have at least three kinds of photosensitive layers whose light-sensitive wavelength regions and hues after development processing of the coloring material are mutually different. Additionally, it is also possible to use photosensitive materials which have on their bases at least a photosensitive silver halide, a binder, and a dye-imparting coupler, and which have at least three kinds of photosensitive layers whose light-sensitive wavelength regions and hues of the coloring material formed by the dye-imparting coupler are mutually different.

In accordance with a sixth aspect of the present invention, in the above-described first aspect of the invention, the heating means is a heating plate, and the development processing apparatus further comprises pressing means for pressing a laminated assembly of the silver halide photosensitive material and the processing sheet toward the heating plate with a weak force equal to or less than a predetermined value at an early period of time when transport of the laminated assembly of the silver halide photosensitive material and the processing sheet is started along a heating surface of the heating plate by the first transporting means.

In addition, in accordance with a seventh aspect of the present invention, in the above-described first aspect of the invention, the heating means is a heating plate, and the development processing apparatus further comprises nonpressing means for maintaining a laminated assembly of the silver halide photosensitive material and the processing sheet in a nonpressed state with respect to a direction toward the heating plate at an early period of time when transport of the laminated assembly of the silver halide photosensitive material and the processing sheet is started along a heating surface of the heating plate.

When the temperature of the silver halide photosensitive material suddenly rises, particularly at an early period of time when transport of the laminated assembly of the silver halide photosensitive material and the processing sheet is started along a heating surface of the heating plate, it is desirable to press the laminated assembly of the silver halide photosensitive material and the processing sheet toward the heating plate with a weak force equal to or less than the predetermined value, or maintain the laminated assembly of the silver halide photosensitive material and the processing sheet in a nonpressed state with respect to the direction toward the heating plate. As a result, it is possible to avoid a situation in which, when the temperature of the silver halide photosensitive material has risen sharply and the silver halide photosensitive material is liable to be deformed, because the laminated assembly of the silver halide photosensitive material and the processing sheet is pressed toward the heating plate with a strong force equal to or greater than the predetermined value, deformation occurs in the pressed portions, resulting in the occurrence of creases in the silver halide photosensitive material.

It should be noted that, in the above, it more desirable to maintain the laminated assembly of the silver halide photosensitive material and the processing sheet in a nonpressed state than to press the laminated assembly with a weak force in the light of prevention of creases.

In accordance with an eighth aspect of the present invention, in the above-described first aspect of the invention, the heating means is a heating plate, and the laminating means is constituted by a pair of laminating rollers for nipping and laminating the silver halide photosensitive material and the processing sheet, a portion of a heating surface of the heating plate which is in close proximity to the pair of laminating rollers being located on a tangential line which passes a point of contact between the pair of laminating rollers.

In the above-described eighth aspect of the invention, the laminating means is constituted by a pair of laminating rollers, and the portion of the heating surface which is in close proximity to the pair of rollers is located on a tangential line which passes a point of contact between the pair of laminating rollers. Accordingly, the silver halide photosensitive material and the processing sheet laminated by the pair of laminating rollers are transported on the tangential line which passes the point of contact between the pair of laminating rollers. Hence, the laminated assembly of the silver halide photosensitive material and the processing sheet is reliably and evenly brought into contact with the heating surface located on the tangential line, thereby allowing the silver halide photosensitive material to be heated uniformly. Therefore, it is possible to prevent the occurrence of creases ascribable to the nonuniform heating of the silver halide photosensitive material.

It should be noted that although, in the development processing apparatus in accordance with this eighth aspect, the laminating means is constituted by the pair of laminating rollers, the laminating means may be constituted by other members, such as a pair of endless belts. However, the laminating means is required to have a smooth lamination surface so that creases or marks of the irregular surface of the belt are not produced in the silver halide photosensitive material and the processing sheet. If the endless belts are used, it is necessary to grind and polish the belt surfaces to maintain the belt surfaces in a smooth state. In this respect, if the pair of laminating rollers is used, it is unnecessary to effect grinding and polishing.

In accordance with a ninth aspect of the present invention, in the above-described first aspect of the invention, the first transporting means is constituted by a transport belt whose surface for transporting a laminated assembly of the silver halide photosensitive material and the processing sheet has been smoothed.

In accordance with this aspect, the first transporting means is constituted by a transport belt whose surface facing a laminated assembly of the silver halide photosensitive material and the processing sheet has been smoothed, so that, during the transport by the belt, the laminated assembly of the silver halide photosensitive material and the processing sheet can be evenly brought into contact with the heating surface with a uniform force. Consequently, it is possible to prevent the occurrence of creases attributable to the nonuniform heating of the silver halide photosensitive material. That is, as for the transport belt used during heat development, its surface on the silver halide photosensitive material side has been smoothed, so that uniform heat processing becomes possible, with the result that it becomes possible to suppress the unevenness in density and the transfer of mesh marks which are ascribable to the poor finished state of the surface of the transport belt.

In accordance with a 10th aspect of the present invention, in the above-described first aspect of the invention, the heating means is a heating plate, and the development processing apparatus further comprises a pressing roller disposed in a vicinity of a rear end of a transporting path of the first transporting means and adapted to press the silver halide photosensitive material and the processing sheet toward a heating surface of the heating plate with a predetermined pressure immediately before the silver halide photosensitive material and the pressing sheet are separated by the separating means.

In this aspect of the invention, the pressing roller is disposed in the vicinity of the rear end of the transporting path of the first transporting means. Here, the silver halide photosensitive material and the processing sheet are toward the heating surface by the pressing roller with a predetermined pressure immediately before the silver halide photosensitive material and the pressing sheet are separated by the separating means, i.e., when the temperature of the silver halide photosensitive material is high. Hence, even if slight creases have occurred in the silver halide photosensitive material prior to being pressed, since the silver halide photosensitive material is pressed by the pressing roller when the temperature of the silver halide photosensitive material is high, the creases on the surface can be removed and the surface is made smooth. Thus, it is possible to prevent the occurrence of creases in the silver halide photosensitive material.

It should be noted that the pressing force of the aforementioned pressing roller should preferably be set to be weaker than the laminating force of the laminating means and stronger than the pressing force with which the silver halide photosensitive material and the processing sheet are pressed when transported.

In accordance with an 11th aspect of the present invention, in the above-described first aspect of the invention, the separating means is constituted by a separating roller around which, of the laminated silver halide photosensitive material and processing sheet, the processing sheet is wound, the separating roller being urged in a direction in which the separating roller presses the processing sheet with a force which is uniform in a direction substantially perpendicular to the direction in which the processing sheet is transported by the first transporting means.

In the development processing apparatus in accordance with this 11th aspect of the invention, the separating means is constituted by the separating roller around which, of the laminated silver halide photosensitive material and processing sheet, the processing sheet is wound. Further, the separating roller is urged in the direction in which the separating roller presses the processing sheet with a force which is uniform in the widthwise direction. Consequently, only the processing sheet is wound by the separating roller, and is separated from the silver halide photosensitive material. During the separation, the processing sheet and the silver halide photosensitive material are pressed by the separating roller with a force which is uniform in the widthwise direction.

Meanwhile, the time of this separation is the time immediately after completion of heating, and is the time when the temperature of the silver halide photosensitive material drops suddenly. Therefore, by making the force applied to the silver halide photosensitive material uniform in the widthwise direction, it is possible to realize widthwise uniform separation, and prevent the occurrence of creases in the silver halide photosensitive material during its separation due to the widthwise nonuniform temperature change in the silver halide photosensitive material.

In accordance with a 12th aspect of the present invention, in the above-described first aspect of the invention, the heating means is a heating plate, and the development processing apparatus further comprises spacing-apart means for spacing apart the processing sheet from the heating surface of the heating means when the development processing of the silver halide photosensitive material is not being effected.

To prevent the occurrence of creases in the silver halide photosensitive material, it is essential to prevent the occurrence of creases in the processing sheet which is laminated on the silver halide photosensitive material.

Therefore, the spacing-apart means is provided in the development processing apparatus in accordance with the 12th aspect of the invention, and the processing sheet is spaced apart from the heating surface by the spacing-apart means when the development processing of the silver halide photosensitive material is not being effected.

Consequently, it is possible to avoid a situation where when development processing is not being effected, the processing sheet is heated and is deformed, and creases are formed on its surface.

In accordance with a 13th aspect of the present invention, in the above-described first aspect of the invention, the laminating means is constituted by a pair of laminating rollers for nipping and laminating the silver halide photosensitive material and the processing sheet, an angle at which the processing sheet is fed into a nip between the pair of laminating rollers being arranged to be smaller than a predetermined angle with respect to a tangential line which passes the nip.

In this 13th aspect of the invention, the laminating means is constituted by the pair of laminating rollers, and the angle at which the processing sheet is fed into a nip between the pair of laminating rollers is arranged to be smaller than a predetermined angle. Incidentally, as shown in FIG. 1, the angle at which the processing sheet is fed into the nip between the pair of laminating rollers refers to an angle θ which is formed by a tangential line L1 which passes a point of contact $P_1$ between the pair of laminating rollers 82 and the transport path of the processing sheet 60 to the pair of laminating rollers 82.

By setting this feed angle to be small, the amount of elongation and shrinkage of the surface of the processing sheet during lamination by the laminating means can be made small, thereby making it possible to avoid the occurrence of deformation and creases in the processing sheet.

In accordance with a 14th aspect of the present invention, in the above-described first aspect of the invention, the processing sheet has been wound in roll form, and the development processing apparatus further comprises: feeding and rewinding means capable of feeding the processing sheet to supply the processing sheet to the laminating means and capable of rewinding the processing sheet which has been fed; applying means for applying an image-forming solvent to at least one of the processing sheet and the silver halide photosensitive material before the silver halide photosensitive material and the processing sheet fed by the feeding and rewinding means are laminated by the laminating means; and rewinding control unit for controlling the feeding and rewinding means to allow the processing sheet to be rewound by the feeding and rewinding means in a case where a region which was not used in the development processing is present in the processing sheet after the processing sheet was fed by the feeding and rewinding means and was used in the development processing, such that the region which was not used in the development processing can be laminated on the silver halide photosensitive material subject to next development processing.

With the development processing apparatus in accordance with of this aspect, an image-forming solvent is applied to at least one of the processing sheet, fed out by the feeding and rewinding means, and the imagewise exposed silver halide photosensitive material by the applying means.

Subsequently, the silver halide photosensitive material and the processing sheet are laminated by the laminating means, and are heated by the heating means while being transported by the transporting means, thereby subjecting the silver halide photosensitive material to development processing. Here, since chemicals for developing an exposed image on the silver halide photosensitive material are contained in the processing sheet, as the laminated silver halide photosensitive material and processing sheet are heated, the silver halide photosensitive material is developed, and an exposed image is formed.

Upon completion of the development processing, the silver halide photosensitive material and the processing sheet are separated by the separating means, and the processing sheet used in the development is subsequently rewound by the rewinding control means and the feeding and rewinding means only when the unused region (the region which was not used in development processing) is present, so that the unused region can be laminated on the silver halide photosensitive material which is developed next.

Thus, with the development processing apparatus in accordance with this aspect, it is possible to form images on an imagewise exposed silver halide photosensitive material in a simple manner without effecting the complicated development and fixation processing in the conventional manner. In addition, since liquids including chemicals such as processing solutions are not used, it is possible to eliminate the troublesomeness associated with the storage, replenishment, and management of such liquids and the cleaning and the like of the apparatus, thereby improving the efficiency in maintaining the apparatus for image formation. Further, since the processing sheet which is paid out during heat development can be rewound and reused, as necessary, it becomes possible to reduce the amount of unused regions of the processing sheet occurring as a consequence of the heat development processing, thereby making it possible to efficiently use the processing sheet.

It should be noted that, as the silver halide photosensitive materials in accordance with the present invention, it is preferable to use those which contain on their bases at least a photosensitive silver halide emulsion with a silver chloride content of 70 mol % or more, a hydrophylic binder, and a basic metal compound which is difficultly soluble in water.

In addition, as the processing sheet, it is preferable to use one which contains chemicals, including a complex-forming compound for metal ions, which constitutes the basic metal compound, physical development nuclei, and a silver halide solvent.

In accordance with a 15th aspect of the present invention, in the above-described 14th aspect of the invention, the rewinding control means controls the feeding and rewinding means such that the feeding and rewinding means rewinds the processing sheet after each completion of the development processing in the control for rewinding the processing sheet.

In accordance with this aspect, the rewinding of the processing sheet is unfailingly effected each time development processing is carried out. Accordingly, the efficiency in use of the processing sheet improves as compared with the case where the processing for rewinding the processing sheet is not effected on each occasion of the heat development processing.

In accordance with a 16th aspect of the present invention, in the above-described 14th aspect of the invention, the rewinding control means controls the feeding and rewinding means such that the feeding and rewinding means rewinds the processing sheet after completion of a series of continuous development processing.

In accordance with this aspect, in a case where a series of development processing is carried out continuously, the rewinding of the processing sheet is not effected during the continuous development processing. Accordingly, it becomes possible to suppress an increase in the processing time spent for rewinding the processing sheet.

In accordance with a 17th aspect of the present invention, the development processing apparatus in the above-described 1st aspect of the invention further comprises: applying means for applying an image-forming solvent to at least one of the processing sheet and the silver halide photosensitive material before the silver halide photosensitive material and the processing sheet are laminated by the laminating means, wherein the heating means heats the silver halide photosensitive material and the processing sheet in the presence of the image-forming solvent.

In accordance with this aspect, it is possible to form images on an imagewise exposed silver halide photosensitive material in a simple manner without effecting the complicated development and fixation processing in the conventional manner. In addition, since liquids including chemicals such as processing solutions are not used, it is possible to eliminate the troublesomeness associated with the storage, replenishment, and management of such liquids and the cleaning and the like of the apparatus, thereby improving the efficiency in maintaining the apparatus for image formation.

In accordance with an 18th aspect of the present invention, the development processing apparatus in the above-described 17th aspect of the invention further comprises: an accommodating section for accommodating the processing sheet and feeding the processing sheet for the development processing; a collecting section for collecting the processing sheet separated from the silver halide photosensitive material by the separating means; and discharging means provided in the apparatus and adapted to discharge the silver halide photosensitive material, separated from the processing sheet by the separating means, outside the apparatus.

In accordance with this aspect, the processing sheet is fed out from the accommodating section, and an image-forming solvent is applied to at least one of the imagewise exposed silver halide photosensitive material and the processing sheet by the applying means.

Subsequently, the silver halide photosensitive material and the processing sheet are laminated by the laminating means, and the laminated silver halide photosensitive material and processing sheet are heated by the heating means. Here, the processing sheet is a member which is used for forming an image on the silver halide photosensitive material by being laminated on the silver halide photosensitive material and heated, as the laminated silver halide photosensitive material and processing sheet are heated, the silver halide photosensitive material is developed, and an exposed image is formed.

Upon completion of the development processing, the silver halide photosensitive material and the processing sheet are separated by the separating means, and the silver halide photosensitive material with the image formed thereon is discharged outside the apparatus by the discharging means, while the used processing sheet used in heat development is corrected in the collecting section in the apparatus.

Thus, it is possible to form images on an imagewise exposed silver halide photosensitive material in a simple manner without effecting the complicated development and fixation processing in the conventional manner. In addition, since liquids including chemicals such as processing solutions are not used, it is possible to eliminate the troublesomeness associated with the storage, replenishment, and management of such liquids and the cleaning and the like of the apparatus, thereby improving the efficiency in maintaining the apparatus for image formation.

In addition, since the accommodating section for accommodating the processing sheet and feeding the processing sheet and the collecting section for collecting the processing sheet used in development processing are installed inside the apparatus, an operator's trouble in supplying and collecting the processing sheet on each occasion of the development processing can be dispensed with, and heat development can be effected by merely supplying the silver halide photosensitive material.

In accordance with a 19th aspect of the present invention, the development processing apparatus in the above-described 1st aspect of the invention further comprises: applying means for applying an image-forming solvent to at least one of the processing sheet and the silver halide photosensitive material before the silver halide photosensitive material and the processing sheet are laminated by the laminating means; second transporting means for transporting the silver halide photosensitive material in a substantially vertical direction toward the laminating means; and third transporting means for transporting the processing sheet toward the laminating means, wherein the laminating means is arranged to hold the silver halide photosensitive material in a substantially vertical state in a state in which the silver halide photosensitive material is spaced apart from the second transporting means, and to laminate the silver halide photosensitive material and the processing sheet transported by the third transporting means, and the heating means is arranged to heat the processing sheet and the silver halide photosensitive material in the presence of the image-forming solvent.

In this aspect, it is possible to form images on an imagewise exposed silver halide photosensitive material in a simple manner without effecting the complicated development and fixation processing in the conventional manner. In addition, since liquids including chemicals such as processing solutions are not used, it is possible to eliminate the troublesomeness associated with the storage, replenishment, and management of such liquids and the cleaning and the like of the apparatus, thereby improving the efficiency in maintaining the apparatus for image formation.

In addition, since the laminating means holds in a substantially vertical state the silver halide photosensitive material spaced apart from the second transporting means, when the silver halide photosensitive material is laminated on the processing sheet transported by the second transporting means, the angle formed by the silver halide photosensitive material and the processing sheet does not change, and the state of contact always becomes fixed, so that uneven development does not occur.

The substantially vertical direction referred to herein means a direction which is within ±10° with respect to the vertical direction.

In accordance with a 20th aspect of the present invention, in the above-described 19th aspect of the invention, the second transporting means is arranged to transport the silver halide photosensitive material upward, and the laminating means is disposed above the second transporting means and is arranged to receive the silver halide photosensitive material.

In this aspect, after the silver halide photosensitive material is transported upward by the second transporting means, the silver halide photosensitive material is laminated on the processing sheet by the laminating means. Since the silver halide photosensitive material is transported upward, even after its trailing end in the transporting direction is spaced apart from the second transporting means, the silver halide photosensitive material maintains its vertically transported state by its own weight, so that a change in the laminated state can be reliably prevented.

In accordance with a 21st aspect of the present invention, there is provided a development processing method comprising the steps of: laminating a silver halide photosensitive material on which an image has been exposed and to which an image-forming solvent has been applied and a processing sheet containing chemicals for forming an image on the silver halide photosensitive material; effecting development processing of the silver halide photosensitive material by heating the silver halide photosensitive material and the processing sheet, laminated by the laminating means, to a temperature suitable for the development processing by means of predetermined heating means; separating the processing sheet and the silver halide photosensitive material after completion of the development processing; and drying the silver halide photosensitive material by transporting the separated silver halide photosensitive material rectilinearly along a surface of a heating plate for drying whose temperature has been set to be higher than a glass transition temperature of a base member of the silver halide photosensitive material and substantially equivalent to a temperature of the heating means.

In the development processing method in the above-described aspect, the silver halide photosensitive material on which an image has been exposed and to which an image-forming solvent has been applied and the processing sheet containing chemicals for forming an image on the silver halide photosensitive material are laminated. Then, the silver halide photosensitive material is heated by heating the laminated silver halide photosensitive material and processing sheet to a temperature suitable for the development processing by means of the predetermined heating means. Since the silver halide photosensitive material has the characteristic whereby it is developable on heating, the silver halide photosensitive material is developed, and the exposed image is formed on its surface. In this manner, the development processing of the silver halide photosensitive material is executed.

At the same time, in the development processing method in this aspect of the invention, the silver halide photosensitive material is subjected to dry processing as the silver halide photosensitive material, for which development processing has been completed and has been separated from the processing sheet, is rectilinearly transported along the surface of the heating plate for drying. Here, the temperature of the heating plate for drying has been set to be higher than the glass transition temperature of the base member of the silver halide photosensitive material and substantially equivalent to the temperature of the heating means, i.e., to a temperature higher than the conventional temperature which is lower than the glass transition temperature.

Thus, since the silver halide photosensitive material is transported along the surface of the heating plate for drying whose temperature has been set to a temperature level higher than the conventional temperature, it is possible to speed up the dry processing of the silver halide photosensitive material. Meanwhile, when the silver halide photosensitive material is transported along the surface of the heating plate for drying, the silver halide photosensitive material is transported rectilinearly, so that a force which tends to deform the silver halide photosensitive material does not act on the silver halide photosensitive material. Consequenty, although the temperature of the silver halide photosensitive material becomes higher than the glass transition temperature, such a deformation which would remain in the silver halide photosensitive material does not occur.

Accordingly, it is possible to speed up the dry processing of the silver halide photosensitive material while ensuring that the deformation does not remain in the silver halide photosensitive material.

In accordance with a 22nd aspect of the present invention, the development processing apparatus in the above-described 1st aspect of the invention for implementing the above-described development processing method further comprises: applying means for applying an image-forming solvent to the silver halide photosensitive material before the silver halide photosensitive material and the processing sheet are laminated by the laminating means; a heating plate which is disposed adjacent to the heating means and whose temperature is set to be higher than a glass transition temperature of a base member of the silver halide photosensitive material and substantially equivalent to a temperature of the heating means, so as to subject the silver halide photosensitive material separated by the separating means to dry processing; and fourth transporting means for rectilinearly transporting the silver halide photosensitive material separated by the separating means, along a surface of the heating plate for drying.

In the development processing apparatus in this aspect of the invention, an image-forming solvent is applied to the imagewise exposed silver halide photosensitive material by the applying means, and the silver halide photosensitive material with the image-forming solvent applied thereto and the processing sheet are laminated by the laminating means.

Then, the laminated silver halide photosensitive material and processing sheet are transported along the heating surface of the heating means by the first transporting means. Consequently, the laminated silver halide photosensitive material and processing sheet are heated, and the temperature of the silver halide photosensitive material reaches a temperature suitable for development processing. At the same time, the chemicals contained in the processing sheet act on the silver halide photosensitive material, so that the silver halide photosensitive material is developed, and the exposed image is formed on the surface of the silver halide photosensitive material. As the heating means, it is possible to use a planar one whose predetermined surface is set as a heating surface, of a drum-shaped one adapted to effect heating from its outer peripheral surface.

The heat development section 66 thus developed is separated from the processing sheet by the separating means, and is transported rectilinearly along the surface of the heating plate for drying provided adjacent to the heating means, by the fourth transporting means. The temperature of this heating plate for drying has been set to be higher than the glass transition temperature of the base member of the silver halide photosensitive material and substantially equivalent to the temperature of the heating means, i.e., to a temperature higher than the conventional temperature set to a level lower than the glass transition temperature.

Thus, since the silver halide photosensitive material is transported along the surface of the heating plate for drying whose temperature has been set to a temperature level higher than the conventional temperature, the silver halide photosensitive material is subjected to dry processing, and its dry processing is effected at a higher speed than in the conventional case. Meanwhile, when the silver halide photosensitive material is transported along the surface of the heating plate for drying, the silver halide photosensitive material is transported rectilinearly, so that a force which tends to deform the silver halide photosensitive material does not act on the silver halide photosensitive material. Consequently, although the temperature of the silver halide photosensitive material becomes higher than the glass transition temperature, such a deformation which would remain in the silver halide photosensitive material does not occur.

Accordingly, it is possible to speed up the dry processing of the silver halide photosensitive material while ensuring that the deformation does not remain in the silver halide photosensitive material.

Here, a description will be given of the effect of dry processing at a higher speed. By way of example, a comparison will be made between the conventional drying using warm air at 30° C. and the drying using the heating plate for drying at 80° C. in the development processing apparatus in accordance with this aspect of the invention. The vapor pressure of water is 4245 mmHg at 30° C., and 47377 mmHg at 80° C. (source: Scientific Annual). Thus, since the vapor pressure of water at 80° C. is about 10-fold the vapor pressure of water at 30° C., under the condition that the relative humidity is identical, the absolute quantity of vapor pressure contained in air at 80° C. is about 10-fold the absolute quantity of vapor pressure contained in air at 30° C. Namely, it can be said that the drying capability at 80° C. is about 10-fold the drying capability at 30° C. In other words, if heating is shifted from 30° C. to 80° C., the dry processing is speeded up by about 10-fold.

In accordance with a 23rd aspect of the present invention, the development processing apparatus in the above-described 22nd aspect of the invention further comprises: a fan disposed in such a manner as to oppose the heating plate for drying and adapted to blow warm air onto the silver halide photosensitive material separated by the separating means.

In the development processing apparatus in accordance with this aspect of the invention, a fan for blowing warm air or drying air onto the separated silver halide photosensitive material is disposed in such a manner as to oppose the heating plate for drying such that the path for transporting the silver halide photosensitive material separated by the separating means is interposed between the fan and the heating plate for drying. Since the warm air from the fan is blown onto the silver halide photosensitive material being transported along the transport path, one surface of the silver halide photosensitive material is heated by the heating plate for drying, while the other surface thereof is dried by the warm air from the fan. When the silver halide photosensitive material is dried by the warm air, a drop in the surface temperature is compensated for by heating from the reverse surface, so that dry processing can be effected efficiently.

It should be noted that, to effect the dry processing efficiently, the temperature of the warm air from the fan should preferably set to be higher than the glass transition temperature of the base member of the silver halide photosensitive material and substantially equivalent to the temperature of the heating means.

In accordance with a 24th aspect of the present invention, the development processing apparatus in the above-described 22nd or 23rd aspect of the invention further comprises: a heating plate for cooling which is disposed adjacent to the heating plate for drying and whose temperature is set to be lower than the glass transition temperature of the base member of the silver halide photosensitive material, wherein the fourth transporting means is arranged to transport the silver halide photosensitive material subjected to the dry processing rectilinearly along a surface of the heating plate for cooling.

In accordance with this aspect, a heating plate for cooling is disposed adjacent to the heating plate for drying, and the temperature of the heating plate for cooling is set to be lower than the glass transition temperature of the base member of the silver halide photosensitive material, and the silver halide photosensitive material is transported rectilinearly along the surface of the heating plate for cooling by the fourth transporting means. Accordingly, it is possible to obviate a situation in which the silver halide photosensitive material heated by the heating plate for drying, and is then air-cooled, and its temperature drops suddenly. Namely, it is possible to prevent the occurrence of a sudden temperature change in the silver halide photosensitive material, and prevent the occurrence of deformation in the silver halide photosensitive material.

It should be noted that, as the silver halide photosensitive materials in accordance with this aspect of the invention, it is possible to use sheet-like lithographic films having a characteristic whereby they are developable on heating. In addition, it is also possible to use silver halide photosensitive materials for color image formation having the characteristic whereby they are developable on heating.

As the silver halide photosensitive materials for color image formation, there are photosensitive materials which have on their bases at least a photosensitive silver halide, a binder, and a coloring material having the function of releasing or diffusing a diffusive dye in the form of an image, and which have at least three kinds of photosensitive layers whose light-sensitive wavelength regions and hues after development processing of the coloring material are mutually different. Additionally, it is also possible to use photosensitive materials which have on their bases at least a photosensitive silver halide, a binder, and a dye-imparting coupler, and which have at least three kinds of photosensitive layers whose light-sensitive wavelength regions and hues of the coloring material formed by the dye-imparting coupler are mutually different.

In accordance with a 25th aspect of the present invention, in the above-described 1st aspect of the invention, the heating means is constituted by a plurality of heating plates each having the heating surface, the plurality of heating plates being arranged in a curved form, and the development processing apparatus further comprises: controlling means for controlling the plurality of heating plates such that a temperature of a central portion, as viewed in a direction substantially perpendicular to a direction of transport by the first transporting means, of the heating surface of each of the plurality of heating plates becomes suitable for the development processing, and such that a temperature of each opposite end portion, as viewed in the direction substantially perpendicular to the direction of transport by the first transporting means, of the heating surface of each of the plurality of heating plates becomes higher by predetermined degrees than the temperature suitable for the development processing; drying means for respectively subjecting to dry processing the silver halide photosensitive material and the processing sheet which have been separated by the separating means; and discharging means for discharging the silver halide photosensitive material subjected to the dry processing outside the development processing apparatus.

In accordance with the above-described 25th aspect of the invention, the heating means is constituted by a plurality of heating plates arranged in the form of a circular arc. The plurality of heating plates are controlled by the heating controlling means such that the temperature of the central portion of each heating plate becomes suitable for the development processing, and such that the temperature of the opposite end portions of each heating plate becomes higher by predetermined degrees than the temperature of the central portion (the temperature suitable for the development processing). Accordingly, the silver halide photosensitive material and the processing sheet are heated in a state in which a predetermined temperature difference is maintained between the central portion and the opposite end portions of each heating plate. As a result, since the elongation of the opposite end portions of the processing sheet becomes greater than that of the central portion thereof, it is possible to alleviate the slack which is likely to occur in the vicinity of the central portion of the processing sheet when transported along the surfaces of the heating plates, making it possible to transport the processing sheet in a state in which creases are eliminated. As a result, since the silver halide photosensitive material and the processing sheet are transported by the first transporting means and are heated in a state of being reliably held in close contact with each other, the temperature of the silver halide photosensitive material reaches the temperature suitable for development processing. At the same time, the chemicals contained in the processing sheet act on and develop the silver halide photosensitive material, with the result that an exposed image is formed on the surface of the silver halide photosensitive material.

After the development processing, the laminated silver halide photosensitive material and processing sheet are separated by the separating means, and are respectively subjected to dry processing. Then, the silver halide photosensitive material on which the image has been formed is discharged to a predetermined section provided on the outer side of the development processing apparatus.

In accordance with a 26th aspect of the present invention, in the above-described 25th aspect of the invention, the controlling means controls the heating means such that the temperature of the central portions of the heating surfaces becomes suitable for the development processing, the central portions corresponding to an image-forming region of the silver halide photosensitive material, and such that the temperature of the opposite end portions of the heating surfaces becomes higher by the predetermined degrees than the temperature suitable for the development processing, the opposite end portions corresponding to a non-image-forming region of the silver halide photosensitive material.

In accordance with this aspect of the invention, a region where an image is formed is set in advance in the silver halide photosensitive material, and a desired image cannot be formed unless the processing sheet is laminated on the silver halide photosensitive material in a state in which the processing sheet is reliably held in close contact with this image-forming region. Accordingly, the central portions of the aforementioned heating plates are made to correspond to the image-forming region of the silver halide photosensitive material and, at the same time, the opposite end portions of the heating plates are made to correspond to a non-image-forming region of the silver halide photosensitive material. As a result, heat development processing is effected in the state in which the processing sheet is reliably held in close contact with the imageforming region of the silver halide photosensitive material, which requires development processing, without the occurrence of creases therein, thereby making it possible to form a desired image.

In accordance with a 27th aspect of the present invention, in the above-described ninth aspect of the invention, the transport belt is formed by a web formed by weaving heat-resistant fibers into mesh form and a heat-resistant elastic material layer applied to the web to a predetermined depth, and the smoothing of the transport belt is effected by grinding and polishing the heat-resistant elastic material layer.

In accordance with this aspect of the invention, the transport belt used for heat development is formed by a web formed by weaving heat-resistant fibers into mesh form and a heat-resistant elastic material layer. The heat-resistant elastic material used is a material whose heat-resistant temperature is higher than a predetermined temperature (in this case, the heating temperature during heat development), whose thermal expansion within the range of this heat-resistant temperature is small, and which is elastic. Accordingly, the transport belt excels in elasticity. In addition, the smoothing of the surface of the transport belt is effected by grinding and polishing. Therefore, the smoothing of the transport belt can be effected with high accuracy by a relatively simple means such as grinding work. As an alternative method of smoothing the transport belt, among others, there is a method in which the transport belt is nipped by a pair of rollers.

It should be noted that the heat-resistant fibers are preferably heat-resistant silicone core members, and the heat-resistant elastic material is preferably an electrically conductive silicone rubber.

The above and other objects, features and advantages of the present invention will become more apparent from the following detailed description of the invention when read in conjunction with the accompanying drawings.

DESCRIPTION OF THE PREFERRED EMBODIMENTS

First Embodiment

Referring now to FIGS. 1 to 4, a description will be given of a first embodiment in accordance with the present invention.

Figure 1:
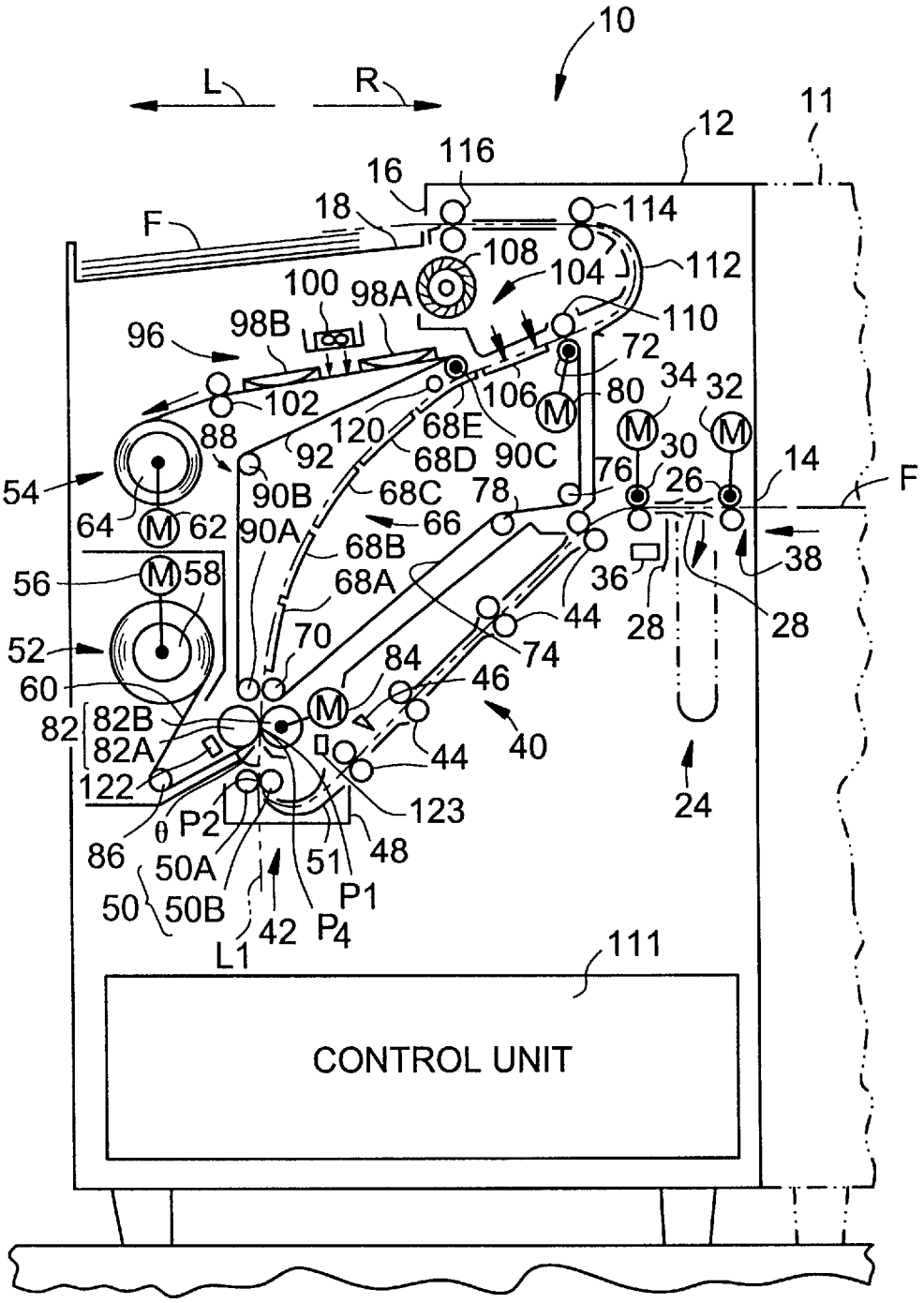
FIG. 1 is an overall diagram of a development processing apparatus in accordance with a first embodiment of the present invention.

FIG. 1 shows an internal configuration of a development processing apparatus 10 in accordance with the first embodiment of the present invention. This development processing apparatus 10 performs the development processing of lithographic films (ranging in size from B5 to A0, for example) for forming black-and-white images (binary images) which are used in the printing of such as newspapers, magazines, and the like.

Hereafter, by way of an example a description will be given of a case in which the development processing apparatus 10 is used for the development processing of a lithographic film on which variable-density images of a cyan color for color images subject to printing have already been exposed. The lithographic film subject to development processing will be hereafter referred to as the film F.

It should be noted that the film F corresponds to the silver halide photosensitive material in the present invention, and contains on its base at least a photosensitive silver halide emulsion with a silver chloride content of 70 mol % or more, a hydrophylic binder, and a basic metal compound which is difficultly soluble in water. As the aforementioned base, polyethylene terephthalate (TET) is used as one example.

As shown in FIG. 1, a main body 12 of the development processing apparatus 10 is formed in the shape of a box. Incidentally, an exposure apparatus 11 for imagewise exposing the film F and discharging the same is disposed on the right-hand side of the development processing apparatus 10 (on the side in the direction of arrow R). A slit-shaped insertion port 14, through which undeveloped film F is inserted, is provided on a right-hand surface of the main body 12. A discharge port 16, from which developed film F is discharged, is provided in an upper portion of the main body 12. Incidentally, a tray 18 for receiving the film F which has been discharged outside the main body 12 through the discharge port 16 is formed on the upper portion of the main body 12.

An unillustrated door is provided on a left-hand surface of the main body 12 on the side in the direction of arrow L, and the interior of the main body 12 can be exposed by opening the door. Meanwhile, an insertion buffer section 24, which is capable of causing the film F inserted through the insertion port 14 to wait temporarily, is provided on the right-hand side in the interior of the main body 12. A pair of transport rollers 26, a branching guide 28, and a pair of transport rollers 30 are arranged in order inside this insertion buffer section 24. One of the pair of transport rollers 26 is rotatively driven by a motor 32, while one of the pair of transport rollers 30 is rotatively driven by a motor 34.

The branching guide 28 is changed over between a horizontal state indicated by the solid lines in FIG. 1 and a vertical state indicated by the phantom lines by means of a solenoid 36, and if the branching guide 28 is changed over to the vertical state, the branching guide 28 is capable of slackening the film F between the transport rollers 26 on the one hand, and the transport rollers 30 on the other, as shown by the phantom lines. It should be noted that an insertion sensor 38 for detecting the film F is provided between the insertion port 14 and the transport rollers 26.

By virtue of such an insertion buffer section 24, it is possible to absorb the difference in speed between the processing speed (e.g., 30 mm/sec) of the development processing apparatus 10 and the processing speed (e.g., 100 mm/sec) of the exposure apparatus 11.

A photosensitive material carrying-in section 40 as well as a water applying section 42, which serves as an applying means for applying water used as an image-forming solvent, are disposed on the downstream side, as viewed in the traveling direction of the film F, of the transport rollers 30. This water is not limited to the so-called pure water, but includes water in the sense in which it is generally used widely. In addition, it is possible to use a solvent mixture of water and a low-boiling solvent such as methanol, DMF, acetone, di-isobutyl ketone, or the like. Further, it is possible to use a solution containing an image formation accelerator, an antifoggant, a development retarder, a hydrophilic thermal solvent, an antiseptic, a mildewproofing agent, or the like.

In the photosensitive material carrying-in section 40, a plurality of pairs of transport rollers 44 are provided for transporting the film F, which is transported from the insertion buffer section 24, to the water applying section 42. In addition, a standby sensor 46 for detecting the film F is provided in an intermediate portion of the film-transporting path in the photosensitive material carrying-in section 40.

An application tank 48 is disposed in the water applying section 42. The application tank 48 is formed in the shape of a dish, and water serving as the image-forming solvent is accommodated therein. Further, a circular arc-shaped guide 51 for allowing the film F to be immersed in the water is provided in the application tank 48.

A pair of squeegee rollers 50, which consist of a roller 50A and a roller 50B arranged horizontally, are disposed on the upper side of the application tank 48 so as to remove excess water attached to the film F and transport the film F in an upward direction. The center of rotation of the roller 50A and the center of rotation of the roller 50B are substantially in a horizontal plane, and the squeegee rollers 50 are adapted to transport the film F substantially vertically upward. Incidentally, the water applying section 42 is provided with a replenisher tank and a pump (neither are shown) for replenishing the application tank 48 with water.

A processing-sheet feeding section 52 is provided on the left-hand side of the interior of the main body 12, and a processing-sheet takeup section 54 is provided on the upper side of the processing-sheet feeding section 52. A feed shaft 58, which is rotated by a motor 56, is detachably mounted in the processing-sheet feeding section 52, and an elongated processing sheet 60 has been wound around the feed shaft 58 in roll form.

Meanwhile, a takeup shaft 64, which is rotated by a motor 62, is detachably mounted in the processing-sheet takeup section 54, and is adapted to take up the processing sheet 60 fed out from the feed shaft 58 onto the takeup shaft 64. Incidentally, the feed shaft 58 and the takeup shaft 64 can be removed from the main body 12 after opening the unillustrated door provided on the left-hand surface of the main body 12.

It should be noted that, in the processing sheet 60 in this first embodiment, layers containing a complex-forming compound for metal ions, which constitutes the basic metal compound, physical development nuclei, and a silver halide solvent are formed on both surfaces of the base. Accordingly, the processing sheet 60, i.e., the processing sheet 60 which was fed out from the feed shaft 58, was subjected to heat development, and was taken up onto the takeup shaft 64, can be reused. Namely, the takeup shaft 64 which has taken up the processing sheet 60 which was once used is removed from the processing-sheet takeup section 54. In addition, the feed shaft 58 which fed out the aforementioned processing sheet 60 is also removed from the processing-sheet feeding section 52. Then, the takeup shaft 64 which has taken up the processing sheet 60 which was once used is loaded in the processing-sheet feeding section 52, while the feed shaft 58 which fed out the aforementioned processing sheet 60 is loaded in the processing-sheet takeup section 54. Thus, the processing sheet 60 which was once used is reused.

A heat development section 66 serving as a heating means is provided in a substantially central portion of the main body 12. In the heat development section 66, a plurality of heating plates 68A to 68E are arranged in the form of a circular arc. In these heating plates 68A to 68E, unillustrated planar heaters and temperature sensors are incorporated, and the heating plates 68A to 68E are heated to a predetermined temperature by the heaters.

On the lower side of the lowermost heating plate 68A, a roller 70 is disposed on the right-hand side of the traveling path of the film F indicated by the chain line. On the side of the uppermost heating plate 68E, a heating plate 106 for drying is disposed along the traveling path of the film F. On the right-hand side of the heating plate 106, a roller 72 is disposed on the lower side of the traveling path of the film F. Incidentally, this heating plate 106 is used for heating and drying the film F.

An endless belt 74, which comes into contact with a reverse surface of the film F, is wound around the roller 70, the heating plates 68A to 68E, the heating plate 106, and the roller 72, and is further wound around rollers 76 and 78. The rollers 70, 72, 76, and 78 are connected to each other by means of an unillustrated timing belt (or a chain or the like), and are rotated by a motor 80.

A pair of laminating rollers 82, which consist of a roller 82A and a roller 82B, are disposed below the roller 70. The roller 82B is adapted to be rotated by a motor 84, while the roller 82A is urged toward the roller 82B by means of unillustrated springs.

It should be noted that a point of contact between the roller 70 and a roller 90A as well as a lower end of a heating surface (the left-hand surface in FIG. 1) of the heating plate 68A are disposed in such a manner as to be located on a tangential line which passes a point of contact $P_1$ between the roller 82A and the roller 82B. By virtue of this arrangement, the film F and the processing sheet 60 which are laminated by the pair of laminating rollers 82 are reliably and evenly brought into contact with the heating surface of the initial heating plate 68A through the rollers 70 and 90A, thereby making it possible to uniformly heat the laminated assembly of the film F and the processing sheet 60.

A roller 86, around which the processing sheet 60 is wound, is disposed below the feed shaft 58. The processing sheet 60, which has been fed out from the feed shaft 58, is wound around the roller 86, and is then transported along the heating plates 68A to 68E via the aforementioned pair of laminating rollers 82.

An urging device 88 for urging the laminated assembly of the film F and the processing sheet 60 toward the heating plates 68A to 68E side is provided at a position opposing the heating plates 68A to 68E. This urging device 88 is provided with rollers 90A, 90B, and 90C, as well as an endless belt 92 which is wound around these rollers 90A, 90B, and 90C to urge the processing sheet 60 toward the outer peripheral surfaces of the heating plates 68A to 68E. The rollers 90A, 90B, and 90C are connected to each other by an unillustrated timing belt (or a chain or the like), and are rotated by a motor 94. In the urging device 88 having such an arrangement, the film F and the processing sheet 60 are urged toward the heating plates 68A to 68E side by means of the tension at a portion of the endless belt 92 between the rollers 90A and 90C.

A processing-sheet drying section 96 is provided on the upper side of the urging device 88. The processing-sheet drying section 96 is provided with heating plates 98A and 98B for heating the processing sheet 60, a fan 100 for blowing air onto the processing sheet 60, and a pair of nip rollers 102 for causing the processing sheet 60 to come into contact with or into close proximity with the heating plates 98A and 98B.

A film drying section 104 is provided on the downstream side, as viewed in the traveling direction of the film F, of the heat development section 66. The film drying section 104 has a fan 108 for blowing drying air (warm air) onto the film F and the heating plate 106 for heating the film F.

A roller 110 for nipping and feeding the film F in cooperation with the endless belt 74 wound around the roller 72 is disposed on the downstream side, as viewed in the traveling direction of the film F, of the film drying section 104.

The film F, which is transported by the roller 110 and the endless belt 74 wound around the roller 72, is discharged outside the main body 12 from the discharge port 16 via a substantially U-shaped transport guide 112 and by means a pair of transport rollers 114 and a pair of transport rollers 116.

The center of rotation of the roller 82A and the center of rotation of the roller 82B of the pair of laminating rollers 82 are in the same horizontal plane, while the point of contact $P_1$ between the roller 82A and the roller 82B is located substantially at a position immediately above a point of contact $P_2$ between the roller 50A and the roller 50B of the squeegee rollers 50. As a result, the film F with water applied thereto is transported vertically upward by the squeegee rollers 50.

Since the center of rotation of the roller 82A and the center of rotation of the roller 82B of the pair of laminating rollers 82 are in the same horizontal plane, when the film F is further transported and even if a trailing end of the film F in its traveling direction leaves the squeegee rollers 50, a rear half portion of the film F in its traveling direction is transported by the pair of laminating rollers 82 while maintaining its vertical state owing to its own weight. Therefore, the film F with water applied thereto, from its leading end to its trailing end, is laminated on the processing sheet 60 while constantly maintaining a fixed angle with respect to the processing sheet 60. Thus, the arrangement is provided such that uneven development does not occur in the film F. It should be noted that the vertical direction is most preferable as the direction in which the film F is advanced into a nip between the pair of laminating rollers 82, but the entering direction may be slightly inclined insofar as it is within ±15° with respect to the vertical direction.

The processing sheet 60 is not directly wound around the roller 82A after being fed out from the processing-sheet feeding section 52, but it is transported into the nip between the rollers 82A and 82B via the roller 86. Namely, the arrangement provided is such that an angle θ at which the processing sheet 60 is wound around the roller 82A of the pair of laminating rollers 82 is small. Since the winding angle θ is set to be small, the amount of shrinkage of the surface of the processing sheet 60 at the time of lamination by the pair of laminating rollers 82 can be made small, so that there is an advantage in that the occurrence of deformation and creases in the processing sheet 60 can be obviated.

In addition, a heater 122 for preheating the roller 82A is disposed in the vicinity of the roller 82A, while a heater 123 for preheating the roller 82B is disposed in the vicinity of the roller 82B.

Further, a pressing roller 120, which presses the film F and the processing sheet 60, heated and set in a high-temperature state, against the heating plate 68E with a predetermined pressing force, is disposed immediately upstream of the roller 90C in the traveling path of the laminated assembly of the film F and the processing sheet 60. The pressing force of this pressing roller 120 is set to be weaker than the laminating force of the pair of laminating rollers 82 and stronger than the urging force of the urging device 88.

Figure 2:
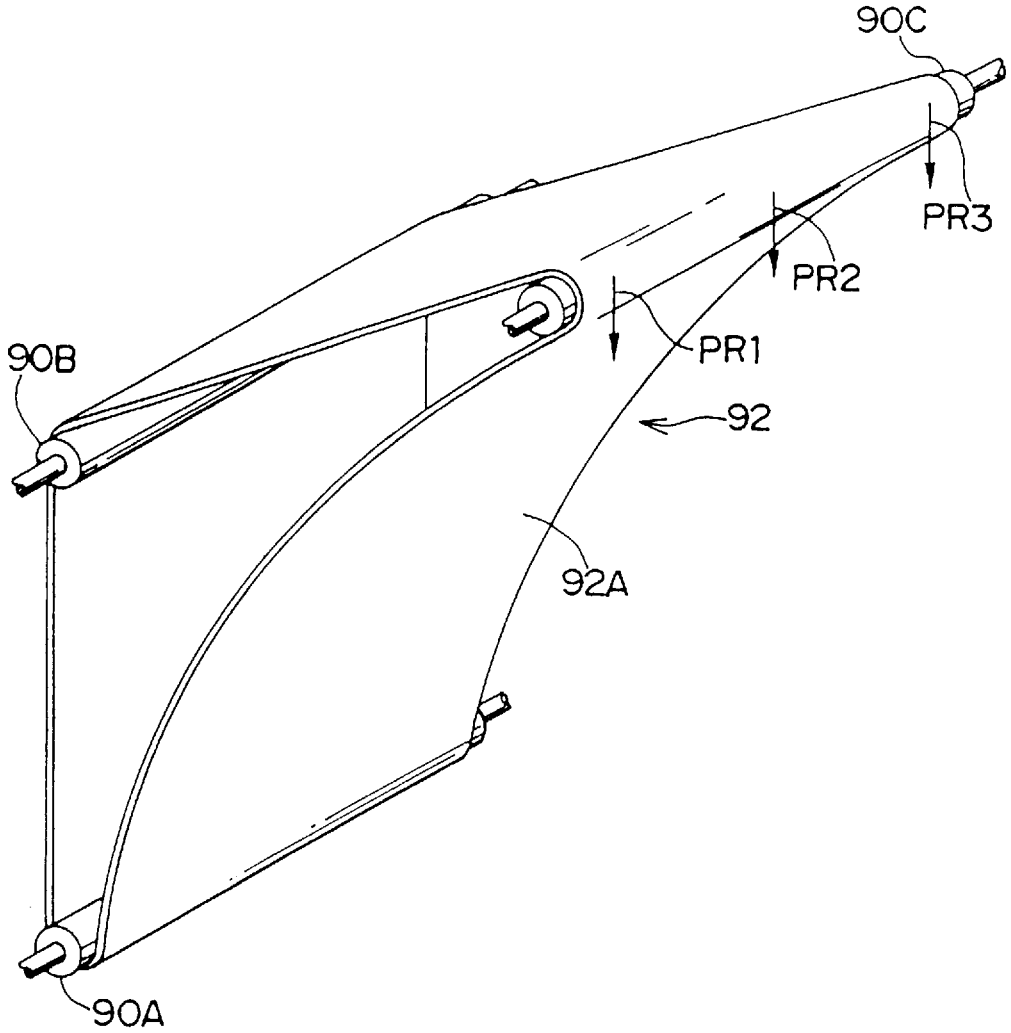
FIG. 2 is a schematic diagram of an endless belt.

FIG. 2 shows the endless belt 92 wound around the rollers 90A, 90B, and 90C. An obverse surface 92A of this endless belt 92 is kept in a smooth state by being ground and polished. Similarly, the surface of the endless belt 74 shown in FIG. 1 is also kept in a smooth state.

In addition, the roller 90C is urged downward by a widthwise uniform force exerted by unillustrated springs, as shown in FIG. 2. For instance, urging forces PR1 and PR3 in the vicinities of opposite ends of the roller 90C, as well as an urging force PR2 in the vicinity of a central portion of the roller 90C, are all set to be uniform. As a result, the processing sheet 60 can be peeled off the film F laminated on the processing sheet 60, by means of the roller 90C with a widthwise uniform force.

Further, all the motors, the sensors, and the heaters of the heating plates mentioned above are electrically connected to a control unit 111, and their operation is controlled by the control unit 111.

Next, a description will be given of the operation in accordance with this embodiment.

With the development processing apparatus 10 having the above-described arrangement, when the exposed film F discharged from the exposure device 11 is inserted through the insertion port 14, the film F is detected by the insertion sensor 38, and the transport rollers 26 are rotated at a speed adjusted to the speed at which the film F is inserted, thereby transporting the film F into the interior.

Since the processing speed of the film F (at and downstream of the transport rollers 30) in the development processing apparatus 10 is slower than the insertion speed of the film F, when the leading end of the film F is nipped by the transport rollers 30, the branching guide 28 is changed over to the vertical state indicated by the phantom lines, so that a central portion and a trailing end portion of the film F is suspended downward, as indicated by the phantom lines in FIG. 1.

The film F transported by the transport rollers 30 is transported to the water applying section 42 by the transport rollers 44 of the photosensitive material carrying-in section 40. In this water applying section 42, the film F is immersed in water stored in the water application tank 48. Then, excess water is removed by the squeegee rollers 50, and the film F is transported vertically upward.

When a predetermined time duration elapses after the leading end of the film F was detected by the standby sensor 46, the endless belt 74, the endless belt 92, and the processing sheet 60 are transported at the same speed as the traveling speed of the film F, and the film F with water applied thereto and the processing sheet 60 are laminated by the pair of laminating rollers 82, and are transported to the heat development section 66.

In the heat development section 66, the laminated assembly of the film F and the processing sheet 60 is transported while it is urged toward the heating plates 68A to 68E side by the urging device 88 and comes into contact with the heating surfaces of the heating plates 68A to 68E. As a result, the film F is heated, and its temperature rises. As the temperature of the film F thus rises, and the complex-forming compound, the physical development nuclei, and the silver halide solvent contained in the processing sheet 60 act on the film F, variable-density images of a cyan color component with respect to the color images subject to printing are formed on the film F.

It should be noted that consideration has been given to ensure that the film F and the processing sheet 60 are subjected to heat development uniformly in a state of close contact with each other since water is attached to the film F, and the endless belt 92 presses the processing sheet 60 against the film F.

In this first embodiment, the roller 82A and the roller 82B which constitute the pair of laminating rollers 82 are preheated by the heater 122 and the heater 123, respectively. As a result, since the film F is already preheated during lamination by the pair of laminating rollers 82, the temperature of the film F in the heat development section 66 is prevented from rising sharply. Thus, since consideration has been given to ensure that a sharp temperature rise does not occur in the film F, the prevention of creases in the film F is also prevented.

In addition, when the laminated assembly of the film F and the processing sheet 60 is transported while coming into contact with the heating surfaces of the heating plates 68A to 68D, i.e., when the temperature change in the film F is large, the film F and the processing sheet 60 are only urged toward the endless belt 74 and the heating plates 68A to 68D side by the relatively weak tension of the endless belt 92, and are not pressed toward the endless belt 74 and the heating plates 68A to 68D side by such as rollers with a strong force. Thus, the arrangement provided is such that the film F is not pressed strongly when the temperature change in the film F is large, so that the deformation of the film F and the occurrence of creases therein are prevented.

Furthermore, when the laminated assembly of the film F and the processing sheet 60 is transported to the rear end of the heat development section 66, the film F and the processing sheet 60 are strongly pressed against the endless belt 74 and the heating plate 68E by the pressing roller 120 with a predetermined pressure. Since the film F and the processing sheet 60 are pressed by the pressing roller 120 in a state in which the temperature of the film F has reached a highest level, even if slight creases have occurred on the surface of the film F, such creases can be removed.

After the laminated assembly of the film F and the processing sheet 60 is pressed by the pressing roller 120, the processing sheet 60 is peeled off the film F by the roller 90C serving as a separating means. During this peeling off, since a widthwise uniform force is applied to the film F and the processing sheet 60 by the roller 90C, a widthwise uniform peeling off is realized. Meanwhile, during the period of such a peeling off, the temperature of the film F drops sharply. Nevertheless, since a widthwise uniform peeling off is realized as described above, it is possible to prevent the occurrence of creases in the film F which can occur due to the widthwise nonuniform temperature change of the film F. Incidentally, the peeled-off processing sheet 60 is taken up onto the takeup shaft 64 after it is dried in the sheet drying section 96.

Meanwhile, after the film F peeled off the processing sheet 60 is dried in the film drying section 104, the film F is discharged from the discharge port 16 onto the tray 18 via the transport guide 112, the pair of transport rollers 114, and the pair of transport rollers 116.

In the above-described manner, development processing is completed for the film F on which variable-density images of the cyan color component with respect to the subject color images have been exposed.

Thereafter, development processing is consecutively executed with respect to a film on which variable-density images of a magenta color component with respect to the subject color images have been exposed, a film on which variable-density images of a yellow color component have been exposed, and a film on which variable-density images of a black color have been exposed, thereby preparing a total of four originals for cyan, magenta, yellow, and black. Then, these four originals are printed in an overlapping manner by using inks corresponding to the respective colors. Thus, printed matter on which the subject color images are recorded is prepared.

In accordance with the development processing apparatus 10 in the above-described first embodiment, it is possible to prevent the occurrence of creases in the film F or the processing sheet 60 which is laminated on the film F by virtue of the following features:

1) The pair of laminating rollers 82 is preheated by the heaters 122 and 123 so as to avoid a sharp temperature change of the film F.
2) During heating by the heating plates 68A to 68D, the film F is not pressed against the heating plates.
3) The lower end portion o the heating plate 68A is disposed on a tangential line which passes a point of contact between the pair of laminating rollers 82, thereby realizing the uniform heating of the film F by the heating plate 68A.
4) The surfaces of the endless belts 74 and 92 for transporting the laminated assembly of the film F and the processing sheet 60 are formed as smooth surfaces.
5) Immediately before the peeling off of the processing sheet 60, the film F is pressed against the heating plate by the pressing roller 120.

6) The processing sheet 60 is peeled off the film F with a force which is uniform in the widthwise direction of the processing sheet 60.

7) Since the angle at which the processing sheet 60 is wound around the roller 82A of the pair of laminating rollers 82 is made small, it is possible to prevent the occurrence of creases in the film F and in the processing sheet 60 which is laminated thereon.

Figure 4:
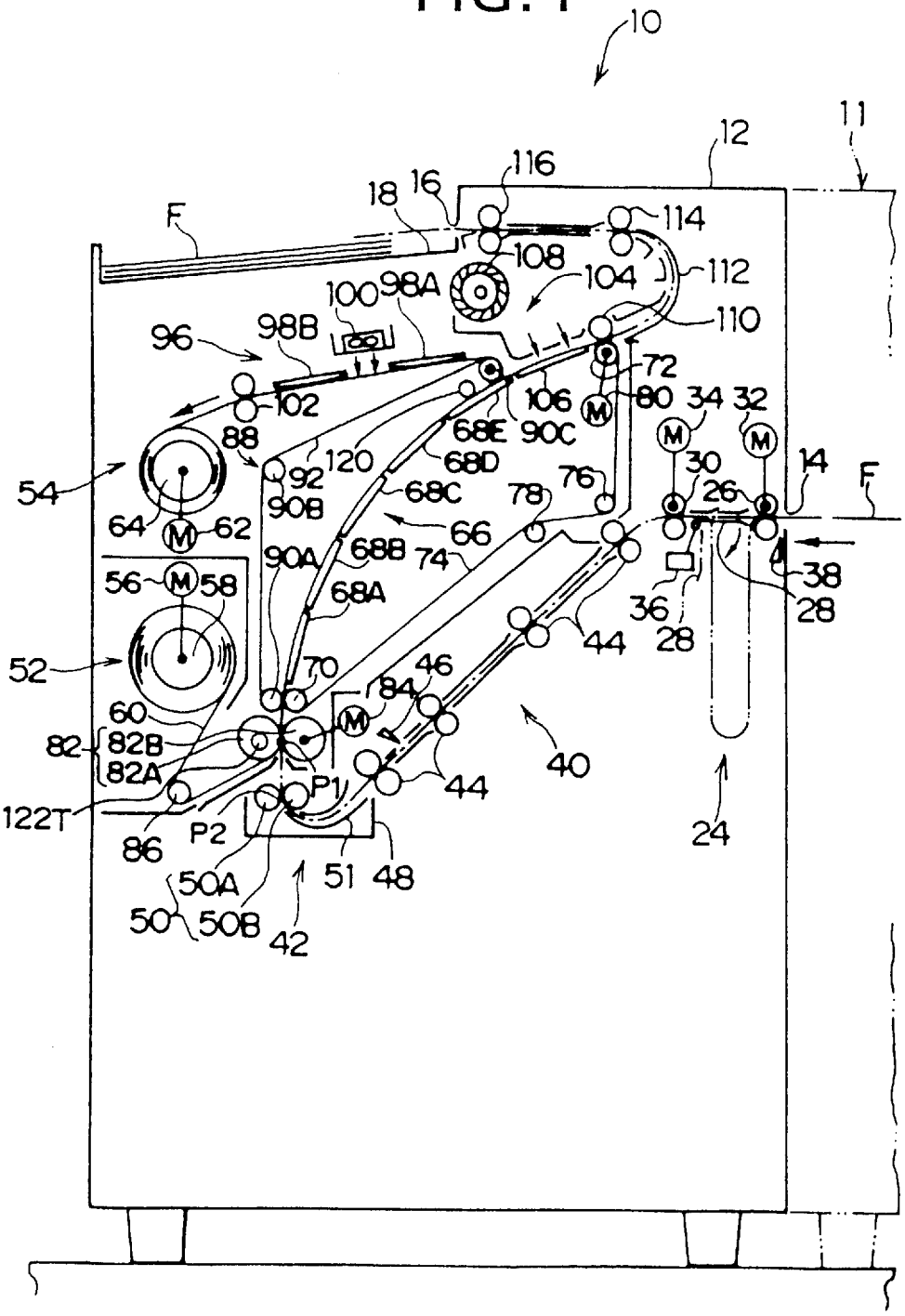
FIG. 4 is a an diagram illustrating a second modification of the development processing apparatus in accordance with the first embodiment.

Incidentally, to preheat the pair of laminating rollers 82, in addition to the arrangement of the above-described first embodiment in which the heaters 122 and 123 are disposed in the vicinities of the pair of laminating rollers 82 to effect heating by these heaters, it is possible to adopt, for example, an arrangement in which, as shown in FIG. 4, a rod-shaped heater 122T is embedded inside the roller 82A to heat the roller 82A by the heater 122T.

Figure 3:
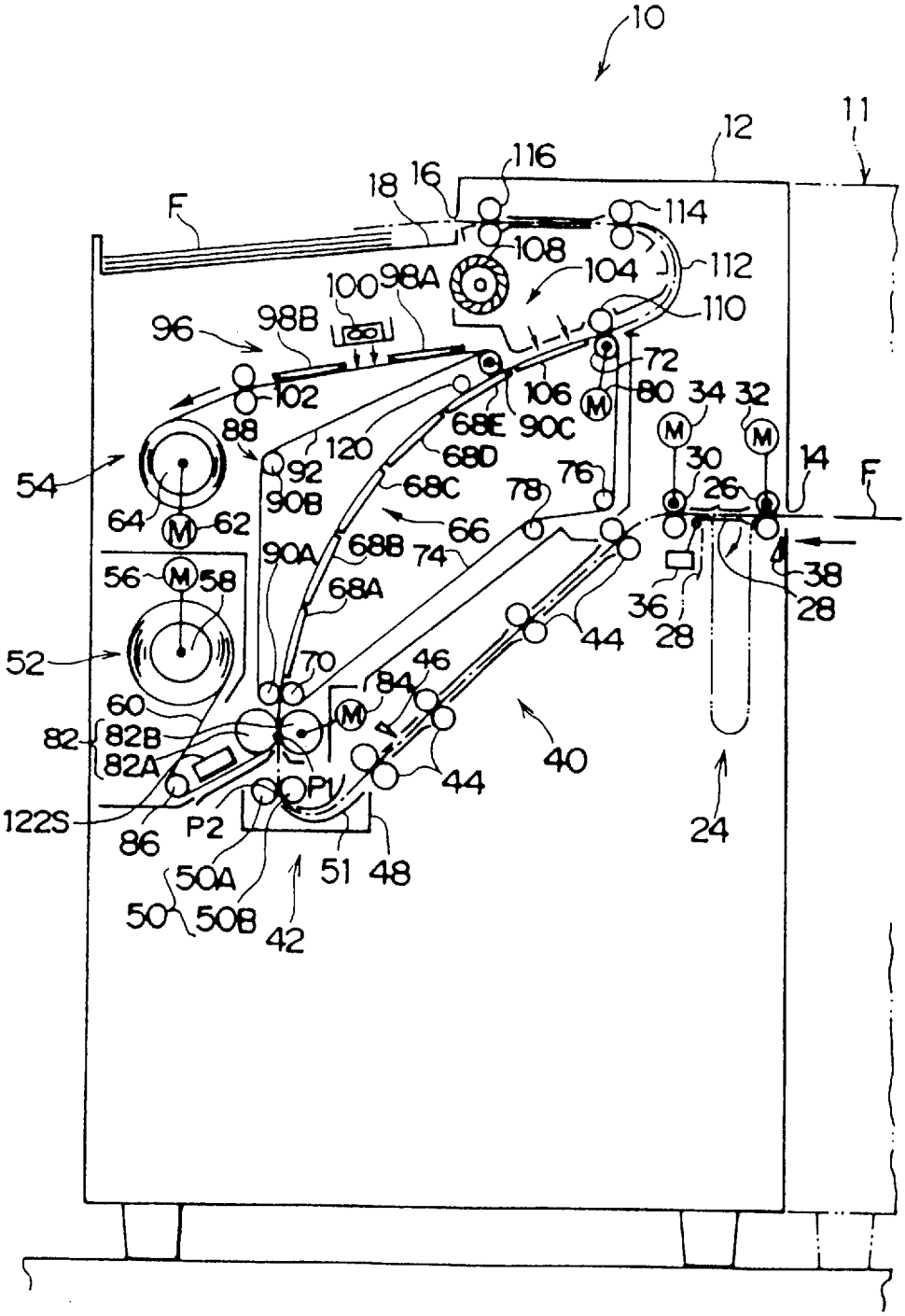
FIG. 3 is an diagram illustrating a first modification of the development processing apparatus in accordance with the first embodiment.

In addition, the means for avoiding a sharp temperature change of the film F is not limited to the preheating of the pair of laminating rollers 82 as described above, and the processing sheet 60 which is laminated on the film F may be preheated. For example, as shown in FIG. 3, a heater 122S may be disposed in the vicinity of the traveling path of the processing sheet 60 which is transported toward the pair of laminating rollers 82, so as to preheat the processing sheet 60 by means of the heater 122S.

In addition, although the arrangement provided in the first embodiment is such that water serving as the imageforming solvent is applied to the film F, water may be applied to the processing sheet 60, or may be applied to both the film F and the processing sheet 60.

Second Embodiment

Referring now to FIGS. 5 to 11, a description will be given of a second embodiment of the present invention. This second embodiment shows an example in which, in the development processing apparatus 10 according to the first embodiment shown in FIG. 1, a spacing-apart means is further provided for causing the processing sheet 60 to be spaced apart from the heating surfaces of the heating plates 68A to 68E (hereafter, generally referred to as the heating plates 68) when the development processing of the film F is not carried out. It should be noted that, in the description of this embodiment, the same parts, members, and arrangements as those of the first embodiment will be denoted by the same reference numerals as those used in the description of the first embodiment, and a detailed description thereof will be omitted.

Figure 5:
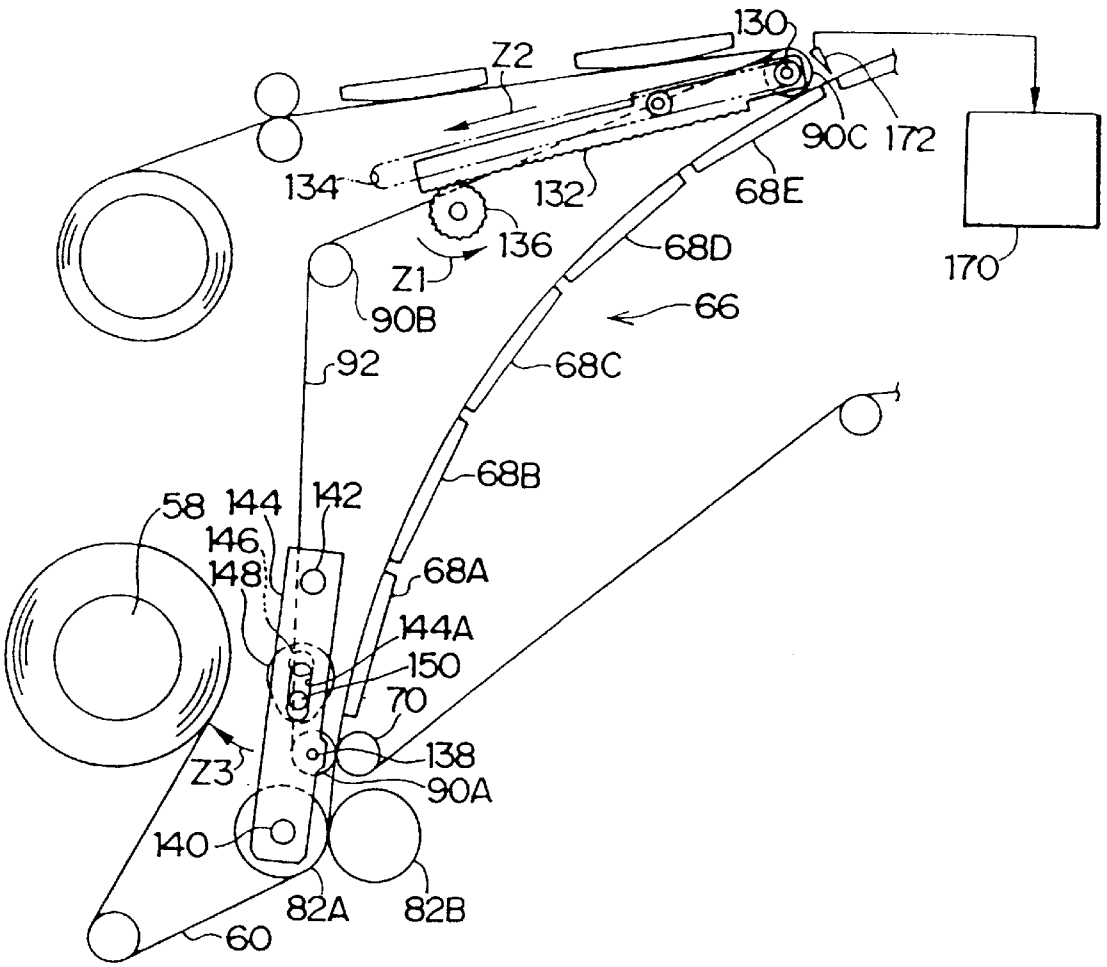
FIG. 5 is a diagram illustrating a state when a photosensitive material is being heated in the development processing apparatus in accordance with a second embodiment.

First, referring to FIGS. 5 and 6, a description will be given of the configuration of the development processing apparatus 10 in accordance with the second embodiment. FIG. 5 shows a configuration of the heat development section 66 and its peripheral portions in the development processing apparatus 10. As shown in FIG. 5, a rack 132 having a tooth profile on its lower surface is connected to a support shaft 130 of the roller 90C, and this rack 132 is disposed movably along a predetermined moving path 134. In addition, a pinion 136 is installed at a distal end portion (left end portion in FIG. 5) of the rack 132, and the teeth of the pinion 136 and the tooth profile formed on the lower surface of the rack 132 mesh with each other. Further, a development completion sensor 172, which detects the completion of development processing on the basis of the fact that the transported film F is not detected for a predetermined time or more, is provided on the right-hand side of the roller 90C. A detection signal on the completion of development processing from this development completion sensor 172 is sent to a control unit 170 comprised of an unillustrated microcomputer.

Figure 6:
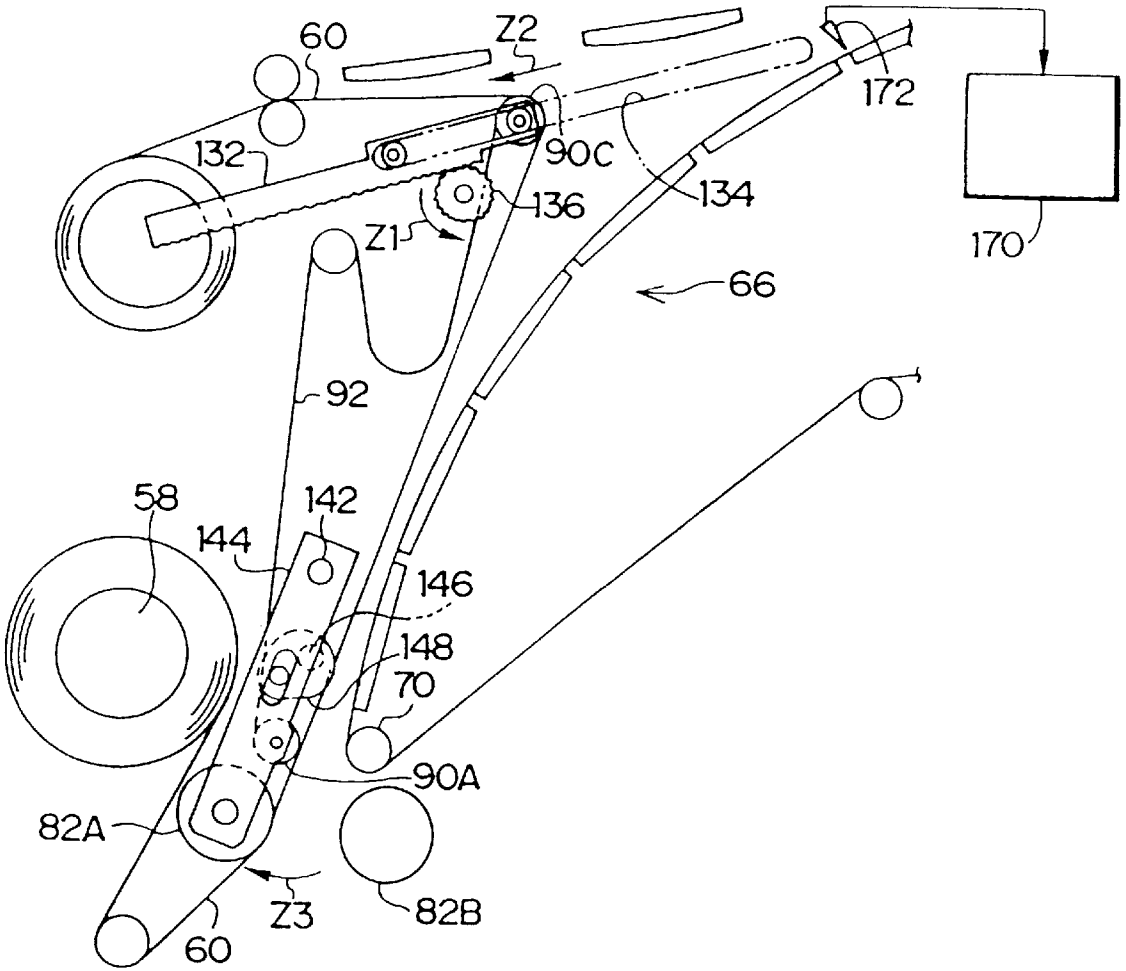
FIG. 6 is a diagram illustrating a state when the processing sheet is being spaced apart from heating plates when the photosensitive material is not being heated in the development processing apparatus in accordance with the second embodiment.

When the completion of development processing is recognized by the control unit 170 upon receipt of the detection signal on the completion of development processing, the pinion 136 is rotatively driven in the direction of arrow Z1, so that the rack 132 and the roller 90C move in the direction of arrow Z2, as shown in FIG. 6.

Meanwhile, a support shaft 138 of the roller 90A and a support shaft 140 of the roller 82A are connected to a plate-shaped member 144 which is disposed in such a manner as to be rotatably movable about a shaft 142. A cam 148, which is disposed in such a manner as to be rotatably movable about a shaft 146, is provided on a rear side of the plate-shaped member 144, and a projecting portion 150 is provided at a rotating portion of the cam 148. This projecting portion 150 is engaged in an elongated groove 144A provided in a central portion of the plate-shaped member 144. In the above-described arrangement, when the completion of development processing of the film F is recognized by the control unit 170 upon receipt of the detection signal on the completion of development processing, the cam 148 is rotatively driven in the direction of arrow Z3, which in turn causes the plate-shaped member 144 to rotatively move about its shaft 142 as shown in FIG. 6, allowing the roller 90A and the roller 82A to move in the direction of arrow Z3.

Further, upon recognizing the completion of development processing of the film F, the control unit 170 provides control so as to cause the feed shaft 58 to rotate reversely by controlling the motor 56, thereby rewinding the processing sheet 60 a predetermined distance.

When the completion of development processing of the film F is recognized by the control unit 170 in the above-described manner, the pinion 136 and the cam 148 are rotatively driven, which in turn causes the roller 90C to move in the direction of arrow Z2 and causes the roller 90A and the roller 82A to move in the direction of arrow Z3 as shown in FIG. 6, thereby allowing the endless belt 92 and the processing sheet 60 to be spaced apart from the heating surfaces of the heating plates 68.

Next, a description will be given of the operation in accordance with the second embodiment. Since the development processing is the same as that of the first embodiment, a description thereof will be omitted, and a description will be given of only the processing related to the spacing apart of the processing sheet 60 from the heating surfaces of the heating plates 68.

Upon completion of heating and heat development of the film F in the heat development section 66, the completion of heat development is detected by the development completion sensor 172, whereupon a predetermined detection signal on the completion of development processing is sent to the control unit 170.

Figure 11:
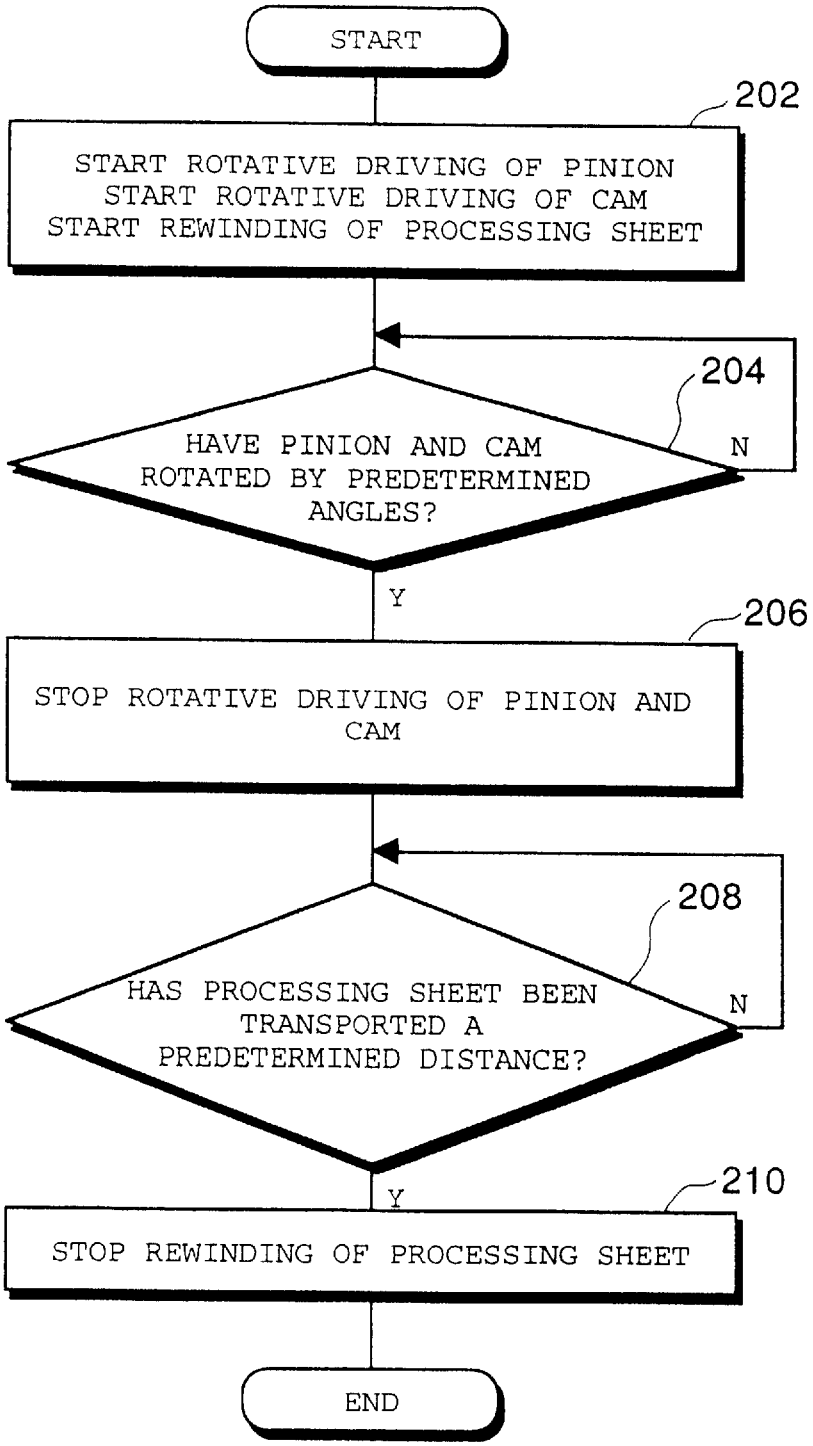
FIG. 11 is a flowchart illustrating a control routine concerning the spacing apart of the processing sheet in the development processing apparatus in accordance with the second embodiment.

When the detection signal on the completion of development processing is received by the control unit 170 and the completion of development processing of the film F is recognized thereby, the control routine shown in FIG. 11 is started and executed by the control unit 170.

In Step 202 in FIG. 11, the rotative driving of the pinion 136 is started. Consequently, the rack 132 and the roller 90C start to move in the direction of arrow Z2. In addition, in Step 202, the rotative driving of the cam 148 is started. Consequently, the plate-shaped member 144 rotatively moves about its shaft 142, which in turn causes the roller 90A and the roller 82A to start moving in the direction of arrow Z3. Thus, the endless belt 92 is spaced apart from the heating surfaces of the heating plates 68.

Further, in Step 202, the feed shaft 58 is reversely rotated to start the rewinding of the processing sheet 60 in interlocking relation to the rotative driving of the pinion 136 and the cam 148, to ensure that even if the endless belt 92 is spaced apart from the heating surfaces of the heating plates 68, the processing sheet 60 will not come into contact with the heating surfaces of the heating plates 68 due to its slackening.

Then, when the pinion 136 and the cam 148 are rotatively moved a predetermined angle (if YES is the answer in the determination in Step 204), the rotative driving of the pinion 136 and the cam 148 is stopped in an ensuing Step 206, thereby maintaining the processing sheet 60 in the state shown in FIG. 6.

Further, if the processing sheet 60 is rewound a transporting distance LG (i.e., the transporting distance along the heating plates 68A to 68E) of the heat development section 66 (if YES is the answer in the determination in Step 208), the rewinding of the processing sheet 60 is stopped in an ensuing Step 210.

In the above-described manner, after the completion of the heat development of the film F, the endless belt 92 and the processing sheet 60 are spaced apart from the heating surfaces of the heating plates 68. Consequently, it is possible to obviate a situation wherein after development processing has stopped being carried out, the processing sheet 60 is heated and becomes deformed, and creases are produced in its surface. For this reason, it is also possible to prevent creases from being produced in the film F which is laminated on the processing sheet 60.

In addition, in the above-described second embodiment, after completion of development processing, the processing sheet 60 is rewound the transporting distance LG of the heat development section 66. Namely, in the processing sheet 60, its portion which was not laminated on the film F during development processing is rewound onto the feed shaft 58. Since this rewound portion can be reused during ensuing development processing, it is possible to reduce wasted portions of the processing sheet 60 which are not laminated on the film F.

It should be noted that, in the development processing apparatuses in accordance with the above-described first and second embodiments, the pair of laminating rollers 82, comprised of the pair of rollers 82A and 82B, is used as the laminating means in accordance with the present invention for laminating the film F and the processing sheet 60. The laminating means may be constituted by another member, such as a pair of endless belts. However, the laminating surface of the laminating means is required to be smooth so that creases will not be produced in the film F and the processing sheet 60 which are subject to lamination. Accordingly, in a case where the endless belts are used, it is necessary to grind and polish the belt surfaces so as to maintain them in a smooth state. In this respect, if the pair of laminating rollers 82 is used, the grinding and polishing are not required.

However, in the case where the pair of laminating rollers 82 is used as the laminating means, it is necessary to maintain the film F and the processing sheet 60 in the laminated state from the time the film F and the processing sheet 60 are laminated by the pair of laminating rollers 82 until the laminated assembly is heated and the processing sheet 60 is separated.

Figure 7:
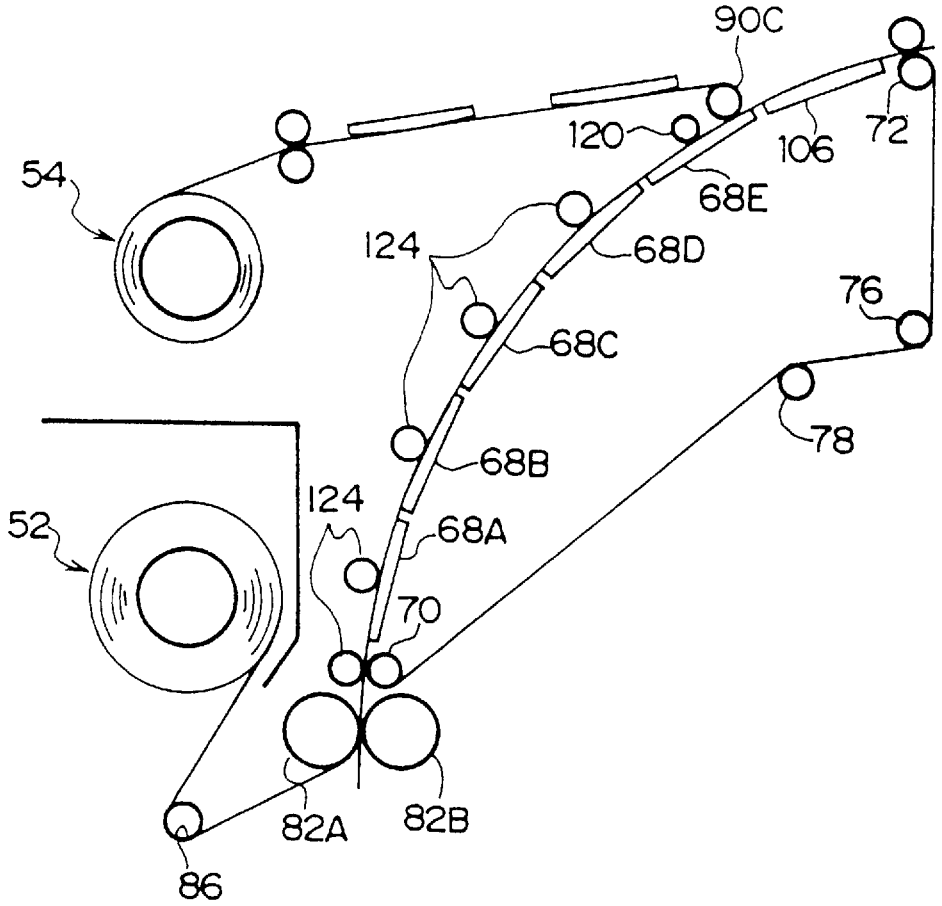
FIG. 7 is a diagram illustrating an example in which the photosensitive material and the processing sheet are laminated by using backup rollers and a belt apart in addition to a pair of laminating rollers.
Figure 8:
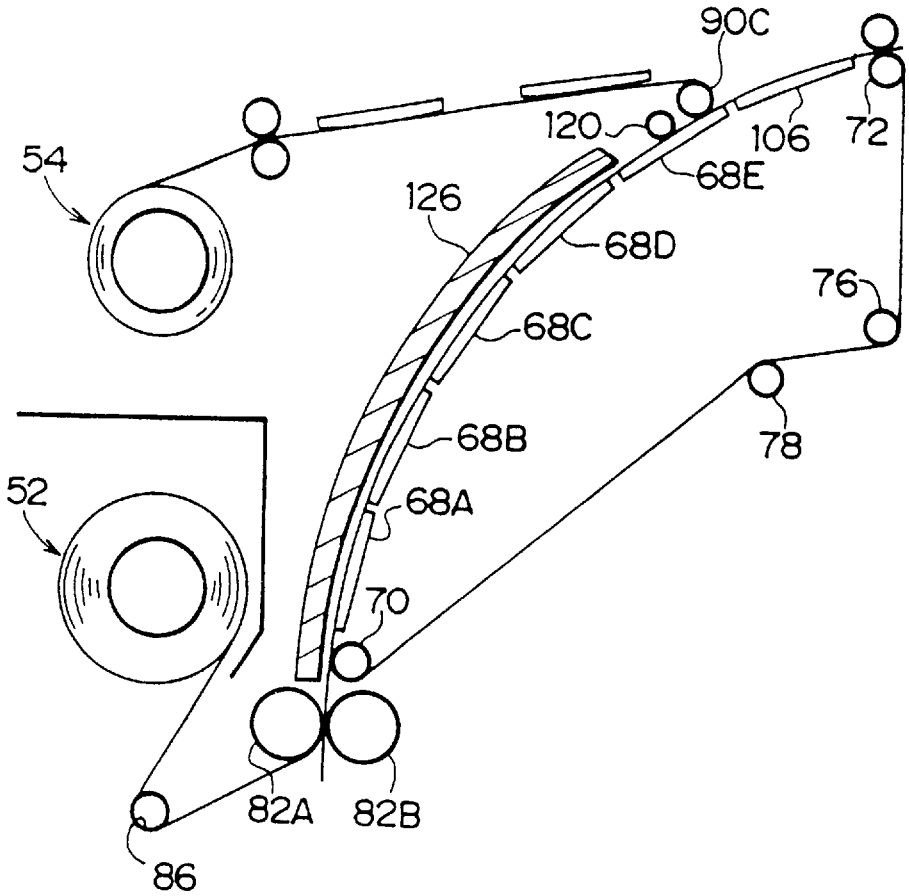
FIG. 8 is a diagram illustrating an example in which a heat insulating member is further added to the arrangement shown in FIG. 7.

Accordingly, in the development processing apparatuses in accordance with the above-described first and second embodiments, the laminated assembly of the film F and the processing sheet 60 is urged toward the heating plates 68 side by the urging means 88 so as to maintain the film F and the processing sheet 60 in the laminated state. Alternatively, however, it is possible to use other members which are described below. For example, as shown in FIG. 7, backup rollers 124 may be disposed at a position immediately above the pair of laminating rollers 82 and at positions facing the heating plates 68A to 68D, and these backup rollers 124 may be used instead of the endless belt 92 shown in FIG. 1. Still alternatively, as shown in FIG. 8, a heat insulating member 126 may be disposed along the traveling path of the film F instead of the backup rollers 124, and the heat insulating member 126 may be used instead of the endless belt 92 shown in FIG. 1.

In addition, in the heat development sections 66 in the development processing apparatuses in accordance with the above-described first and second embodiments, since part of the heat from the heating plates 68A to 68E is absorbed by the endless belts 92 and 74, the temperature of the heating plates 68A to 68E should preferably be set at a level slightly higher than the temperature which is appropriate for development processing.

Figure 9:
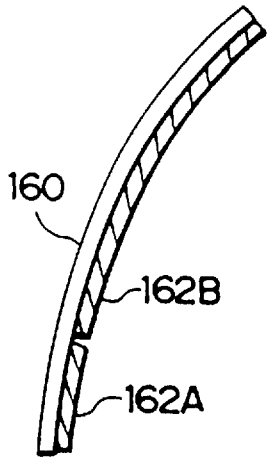
FIG. 9 is a diagram illustrating an example of the arrangement of a heating means in which the amount of heating in an early stage during the start of heating is made relatively higher.

In addition, in the heating plates 68A to 68E in the development processing apparatuses in accordance with the above-described first and second embodiments, in order to speedily raise the temperature of the laminated assembly of the film F and the processing sheet 60 to the temperature which is appropriate for development processing, the amount of heating by the heating plates 68A and 68B located on the lower side (on the upstream side in the traveling direction) in the heat development section 66 should desirably be set relatively higher than the amount of heating by the other heating plates. In addition, as shown in FIG. 9, the heating means in accordance with the present invention may be comprised of a plate 160 having high heat conductivity and heaters 162A and 162B for heating the plate 160 from a reverse surface thereof, and the amount of heating by the heater 162A disposed on the inlet side (the lower side in FIG. 9) of the heat development section 66 may be set relatively higher than the amount of heating by the other heating element 162B. Thus, since the amount of heating on the upstream side in the transporting direction in the heat development section 66 is set relatively higher so as to speedily raise the temperature of the film F and the processing sheet 60 subject to development processing to a temperature level appropriate for development processing, thereby making it possible to reduce the period of time required for development processing and enhance the processing efficiency.

Figure 10:
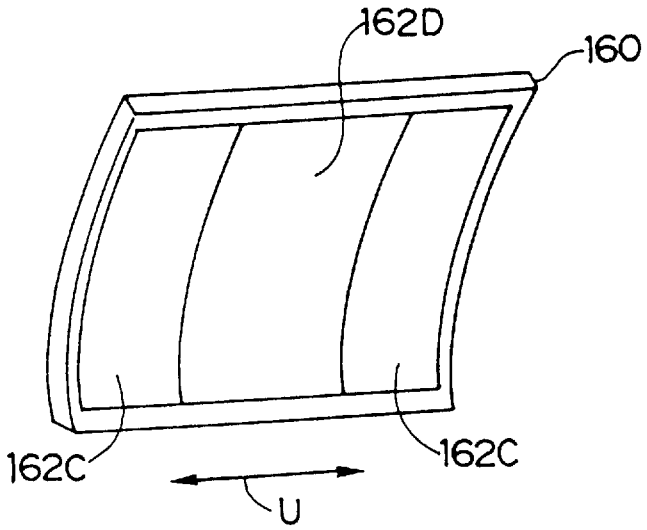
FIG. 10 is a diagram illustrating an example of the arrangement of the heating means in which the amount of heating of opposite end portions, as viewed in the widthwise direction, of the photosensitive material being transported is made relatively higher than the amount of heating of a central portion thereof.

Furthermore, when the laminated assembly of the film F and the processing sheet 60 is heated in the heat development section 66, transverse end portions of the film F, as compared to a central portion thereof, are more liable to be cooled due to the effect of the ambient temperature. Therefore, in the arrangement shown in FIG. 9, it is preferable to provide an arrangement in which, as shown in FIG. 10, the amount of heating by heaters 162C located at opposite sides in the direction of arrow U, which corresponds to the widthwise direction of the transported film F, becomes higher than the amount of heating by a central heater 162D. By adopting such an arrangement, it becomes possible to uniformly heat the laminated assembly of the film F and the processing sheet 60.

Third Embodiment

Next, a description will be given of a third embodiment. It should be noted that, in the description of this embodiment, the same parts, members, and arrangements as those of the first embodiment will be denoted by the same reference numerals as those used in the description of the first embodiment, and a detailed description thereof will be omitted. In this embodiment, a description will be given centering on portions which differ from those of the first embodiment.

Figure 12:
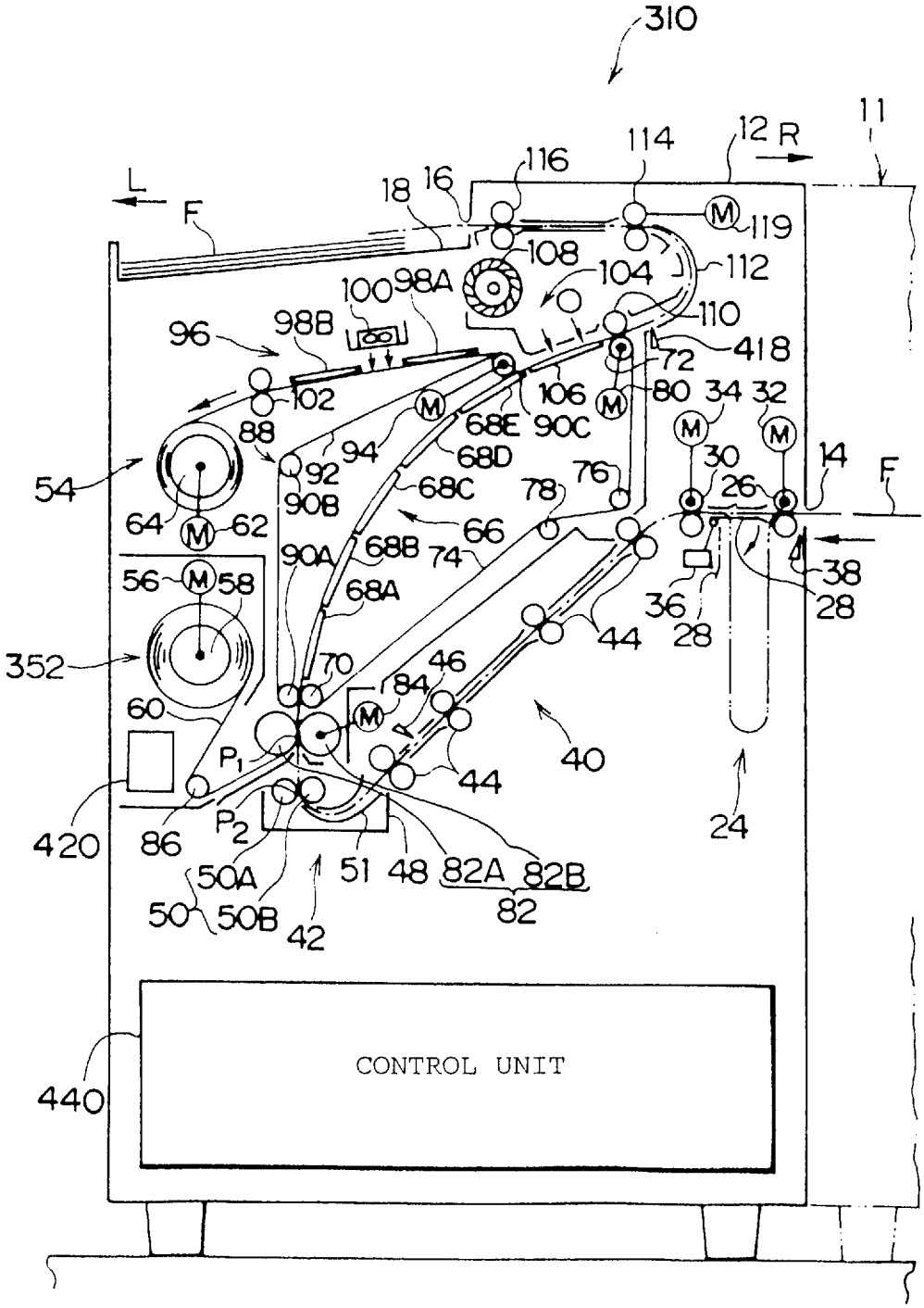
FIG. 12 is an overall diagram of the development processing apparatus in accordance with a third embodiment.

FIG. 12 shows an internal configuration of a photosensitive-material processing apparatus (development processing apparatus) 310 in accordance with the third embodiment of the present invention.

A feeding and rewinding section 352 serving as a feeding and rewinding means is provided in the main body 12, and the processing-sheet takeup section 54 is provided on the upper side of the feeding and rewinding section 352.

The feed shaft 58, which is rotated by the motor 56, is detachably mounted in the feeding and rewinding section 352, and the elongated processing sheet 60 has been wound around the feed shaft 58 in roll form.

The feeding and rewinding section 352 is further provided with a rewinding control unit 420 which serves as a rewinding controlling means for controlling the processing in which the fed processing sheet 60 is rewound as ad necessary. Incidentally, the rewinding control unit 420 will be described later.

Meanwhile, the takeup shaft 64, which is rotated by the motor 62, is detachably mounted in the processing-sheet takeup section 54, and is adapted to take up the processing sheet 60 fed out from the feed shaft 58 onto the takeup shaft 64. Incidentally, the feed shaft 58 and the takeup shaft 64 can be removed from the main body 12 after opening the unillustrated door provided on the left-hand surface of the main body 12.

It should be noted that the processing sheet 60 in this embodiment is arranged such that layers containing a complex-formation compound for metal ions, which constitutes the basic metal compound, physical development nuclei, and a silver halide solvent are formed on both surfaces of the base. Accordingly, the processing sheet 60, which has been taken up onto the takeup shaft 64 after being once used for heat development processing, is adapted to be reused when the takeup shaft 64 is reinstalled in the feeding and rewinding section 352, and the feed shaft 58 is reinstalled in the processing-sheet takeup section 54.

The roller 110 for nipping and feeding the film F in cooperation with the endless belt 74 wound around the roller 72, a trailing-end sensor 418 for detecting the passing of the trailing end of the film F, the substantially U-shaped transport guide 112, the pair of transport rollers 114, and the pair of transport rollers 116 are disposed in that order on the downstream side, as viewed in the traveling direction of the film F, of the film drying section 104. The transport roller 114 and the transport roller 116 are connected to each other by means of an unillustrated timing belt (or a chain or the like), and are rotated by a motor 119.

The film F, which has been transported by the roller 110 and the belt 74 wound around the roller 72, is discharged outside the main body 12 from the discharge port 16 via the transport guide 112 and by means of the pair of transport rollers 114 and the pair of transport rollers 116.

A control unit 440 is installed in a lowermost portion of the main body 12, and controls the overall operation of the heat development processing by the photosensitive-material processing apparatus 310.

Figure 13:
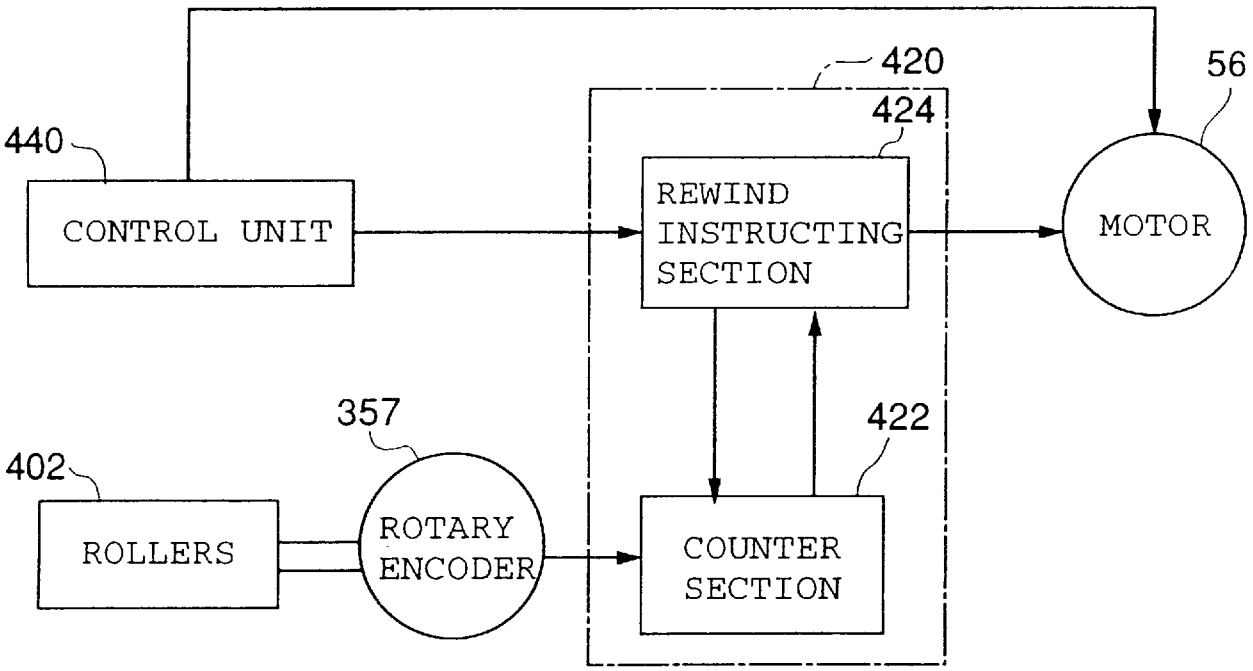
FIG. 13 is a block diagram illustrating a rewinding control unit and its peripheries in the development processing apparatus in accordance with the third embodiment.

Next, referring to FIG. 13, a description will be given of the arrangement of the rewinding control unit 420 and its peripheral portions.

It should be noted that the rewinding control unit 420 is constituted by a microcomputer which stores a rewinding control program. When the rewinding control unit 420 is represented by functional blocks, the rewinding control unit 420 can be divided into two blocks, i.e., a rewind instructing section 424 and a counter section 422.

The control unit 440, the counter section 422, and the motor 56 are electrically connected to the rewind instructing section 424. The rewind instructing section 424 effects control of the counter section 422 and control of the rewind processing of the processing sheet 60 by the motor 56 on the basis of a signal instructing a rewinding start of the processing sheet 60, which is outputted from the control unit 440.

Meanwhile, a rotary encoder 357 is electrically connected to the counter section 422. The counter section 422 executes the measurement of a transported length of the processing sheet 60 on the basis of an output signal from the rotary encoder 357. Incidentally, the rotary encoder 357 is attached to nip rollers 402 interlocked with the transport of the processing sheet 60, and is adapted to output a pulse signal for each predetermined transported length of the processing sheet 60. As the number of pulses of the pulse signal is counted by the counter section 422, it is possible to determine the transported length of the processing sheet 60.

Figure 14:
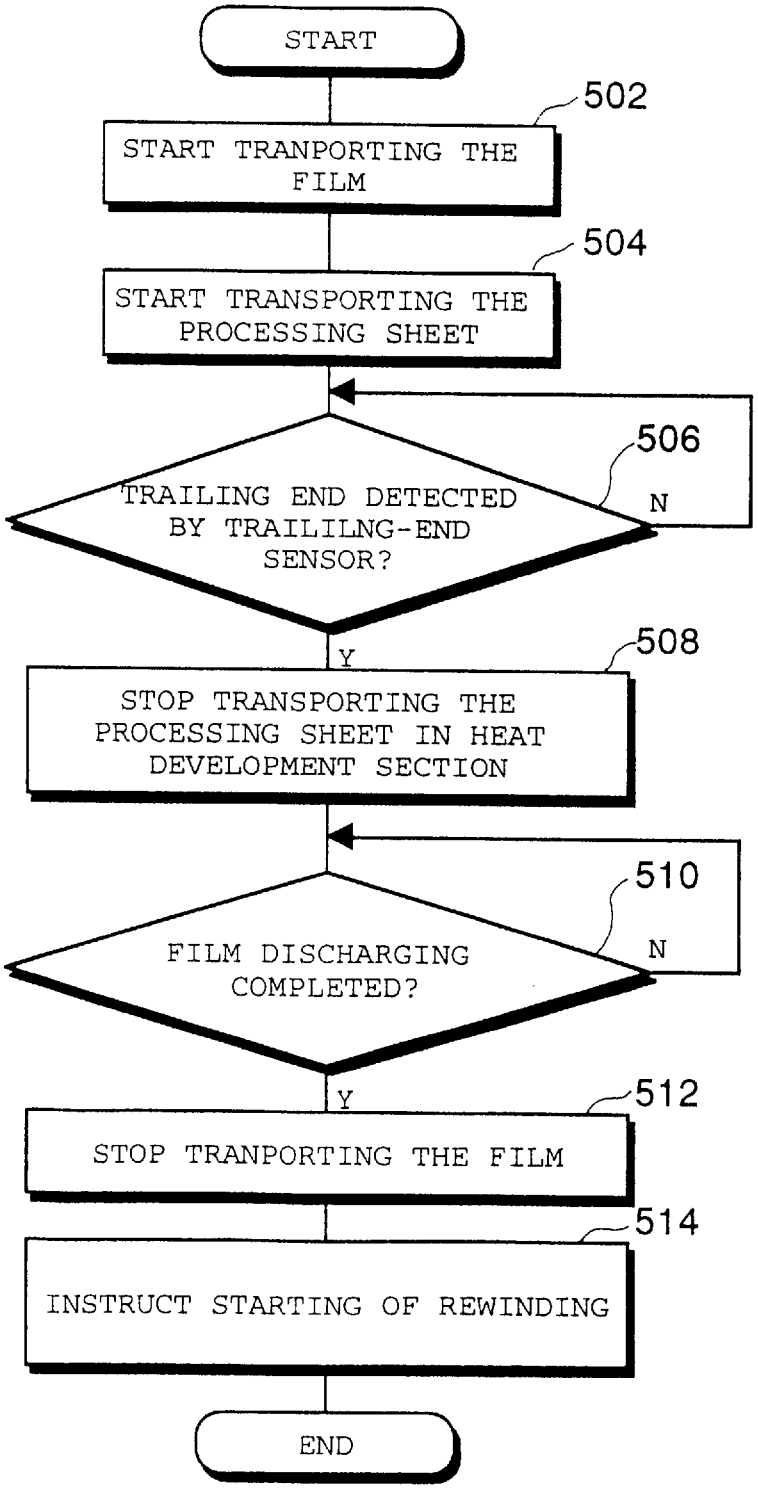
FIG. 14 is a flowchart illustrating the flow of heat development processing by a control unit of the development processing apparatus in accordance with the third embodiment.
Figure 15:
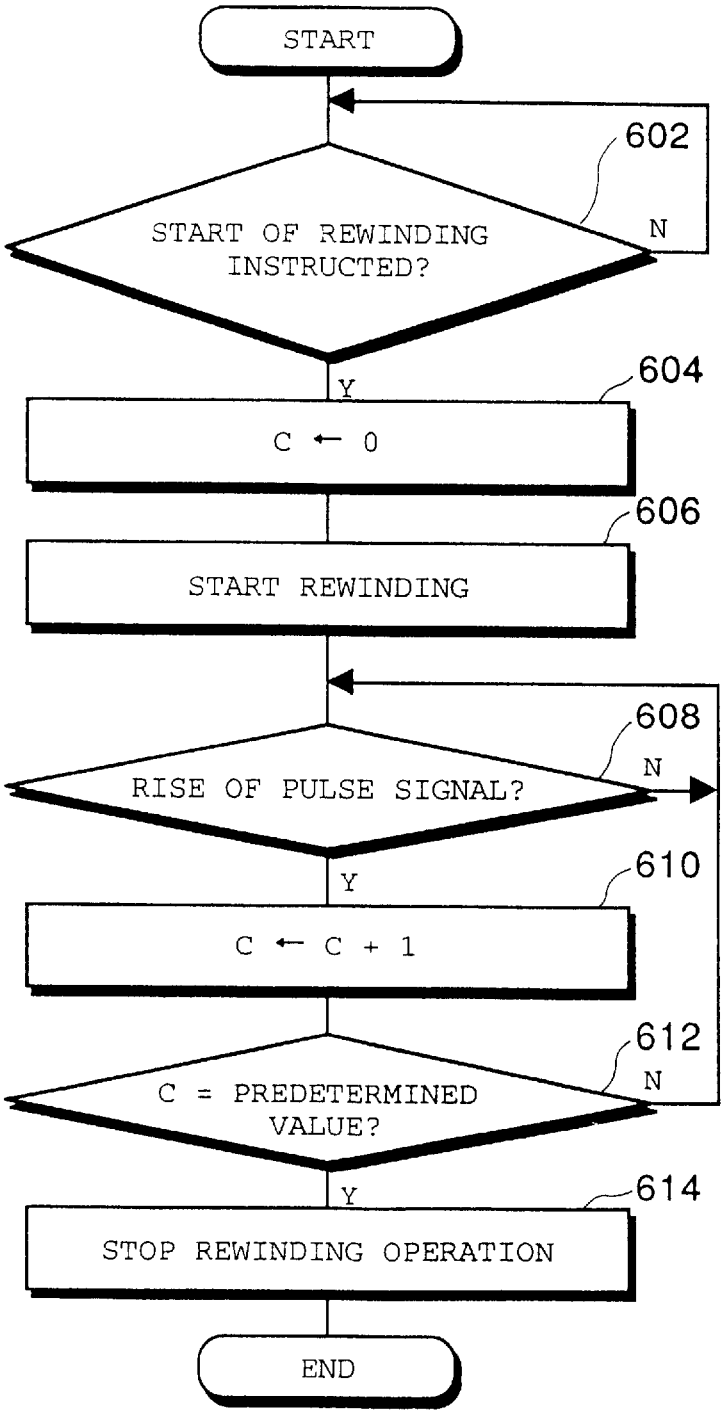
FIG. 15 is a flowchart illustrating the flow of processing-sheet rewinding processing by the rewinding control unit of the development processing apparatus in accordance with the third embodiment.

FIG. 14 is a flowchart illustrating the flow of heat development processing which is carried out by the control unit 440. FIG. 15 is a flowchart illustrating the flow of rewind processing of the processing sheet 60 which is carried out by the rewinding control unit 420.

Next, referring to FIGS. 12 to 15, a description will be given of the operation in accordance with this embodiment.

With the photosensitive-material processing apparatus 310 having the above-described arrangement, when the exposed film F discharged from the exposure device 11 is inserted through the insertion port 14, and the leading end of the film F is detected by the insertion sensor 38, in Step 502, the transport rollers 26 are rotated at a speed adjusted to the speed at which the film F is inserted, while the transport rollers 30 are rotated at a speed adjusted to the processing speed of the photosensitive-material processing apparatus 310, thereby transporting the film F into the interior.

Since the processing speed of the film F (at and downstream of the transport rollers 30) in the photosensitive-material processing apparatus 310 is slower than the insertion speed of the film F, when the leading end of the film F is nipped by the pair of transport rollers 30, the branching guide 28 is changed over to the vertical state indicated by the phantom lines, so that the trailing end side of the film F is suspended downward, as indicated by the phantom lines in FIG. 12. Whether or not the film F is nipped by the pair of transport rollers 30 can be determined by counting the elapsed time from the point of time the leading end of the film F was detected by the insertion sensor 38.

The film F transported by the transport rollers 30 is transported to the water applying section 42 by the transport rollers 44 of the photosensitive material carrying-in section 40. The film F is immersed in water stored in the water application tank 48, and excess water is then removed by the squeegee rollers 50 before the film F is transported vertically upward.

When a predetermined time duration elapses after the leading end of the film F was detected by the standby sensor 46, i.e., when the leading end of the film F reaches a position located immediately upstream of the inlet side of the pair of laminating rollers 82, in Step 504, the belt 74, the belt 92, and the processing sheet 60 are transported at the same speed as the traveling speed of the film F. As a result, the film F with water applied thereto and the processing sheet 60 are laminated by the pair of laminating rollers 82, and are transported to the heat development section 66. It should be noted that, at this time, the pair of transport rollers 114 and the pair of transport rollers 116 are concurrently rotated at the same speed as the traveling speed of the film F in the heat development section 66.

Subsequently, the film F in the state in which it is laminated on the processing sheet 60 passes over and is heated by the heating plates 68 in the heat development section 66, with the result that images are formed on the film F. Incidentally, since water is attached to the film F, and the belt 92 presses the processing sheet 60 against the film F, the film F and the processing sheet 60 are subjected to heat development uniformly in a state of close contact with each other.

When the laminated assembly of the film F and the processing sheet 60 is transported to the rear end of the heat development section 66, the processing sheet 60 is peeled off the film F by the roller 90C serving as the separating means, and after the processing sheet 60 is dried in the processing-sheet drying section 96, the processing sheet 60 is taken up onto the takeup shaft 64.

Meanwhile, in Step 506, a determination is made as to whether or not the trailing end of the film F, which was separated from the processing sheet 60 by the roller 90C and was dried in the film drying section 104, has been detected by the trailing-end sensor 418. If the trailing end of the film F is detected, YES is given as the answer in the determination, and the operation proceeds to Step 508 to stop the transporting of the processing sheet 60 in the heat development section 66. At this time, since the pair of transport rollers 114 and the pair of transport rollers 116 remain rotating, the film F continues to be transported.

In Step 510, a determination is made as to whether or not the film F has been discharged from the discharge port 16 onto the tray 18 via the transport guide 112 and the pair of transport rollers 114 and the pair of transport rollers 116. Incidentally, the determination as to whether or not the film F has been discharged onto the tray 18 is made on the basis of the transporting time of the film F. Namely, a determination is made that the film F has been discharged onto the tray 18 when a predetermined time duration, which is experimentally obtained in advance, has elapsed upon detection of the trailing end of the film F by the trailingend sensor 418.

If it is determined that the film F has been discharged onto the tray 18, in Step 512, the transporting of the film F by the pairs of transport rollers 114 and 116 is stopped.

When the transporting of the film F is stopped, in Step 514, a signal instructing a rewinding start of the processing sheet 60 is outputted to the rewind instructing section 424 in the rewinding control unit 420.

This completes the description of heat development processing in the control unit 440. Next, referring to FIG. 15, a description will be given of processing for rewinding the processing sheet 60 in the rewinding control unit 420.

In Step 602, a determination is made as to the presence or absence of a signal instructing a rewinding start which is outputted from the control unit 440 to the rewind instructing section 424. When the signal instructing a rewinding start is inputted, YES is given as the answer in the determination. Subsequently, in Step 604, 0 is substituted for a counter value C in the counter section 422. As a result, the counter value C is cleared.

If the counter value C is cleared, in Step 606, the rewinding of the processing sheet 60 by the motor 56 is started. Since the control unit 440 outputs the signal instructing a rewinding start after the discharging of the film F is completed, the rewinding of the processing sheet 60 is started from that point of time. Incidentally, the rewinding of the processing sheet 60 is effected by reversely rotating the motor 56 by means of the rewind instructing section 424.

When the rewinding of the processing sheet 60 is started, in Step 608, a determination is made as to the presence or absence of the rise of the pulse signal outputted from the rotary encoder 357 to the counter section 422. At an input of the rise of the pulse signal, YES is given as the answer in the determination, and in an ensuing Step 612 a determination is made as to whether or not the counter value C is equal to a predetermined value. The above-described operation in Steps 608 and 610 is repeatedly carried out until the counter value C becomes equal to the predetermined value. It should be noted that the predetermined value at this time is the number of pulses of the pulse signal from the rotary encoder 357 when the processing sheet 60 is transported by a length corresponding to the distance from the position of lamination of the film F and an unused portion of the processing sheet 60 to the trailing-end sensor 418, and this value is fixedly given to each apparatus.

Through the above-described processing in Steps 608 to 612, the number of pulses of the pulse signal corresponding to the transported length of the processing sheet 60 and outputted from the rotary encoder 357 is counted as the counter value C, and the reverse rotation of the motor 56 is continued until the counter value C reaches the predetermined value.

When the counter value C becomes equal to the predetermined value, in Step 614, the reverse rotation of the motor 56 is stopped, thereby stopping the rewinding operation of the processing sheet 60.

Through the rewinding operation of the processing sheet 60 making use of the number of revolutions of the nip rollers 402 by means of the rewinding control unit 420, the processing sheet 60 is rewound by the portion of an unused region of the processing sheet 60 which has not been used for heating processing, so that the unused region of the processing sheet 60 can be made usable during ensuing heat development processing.

Figure 16A:
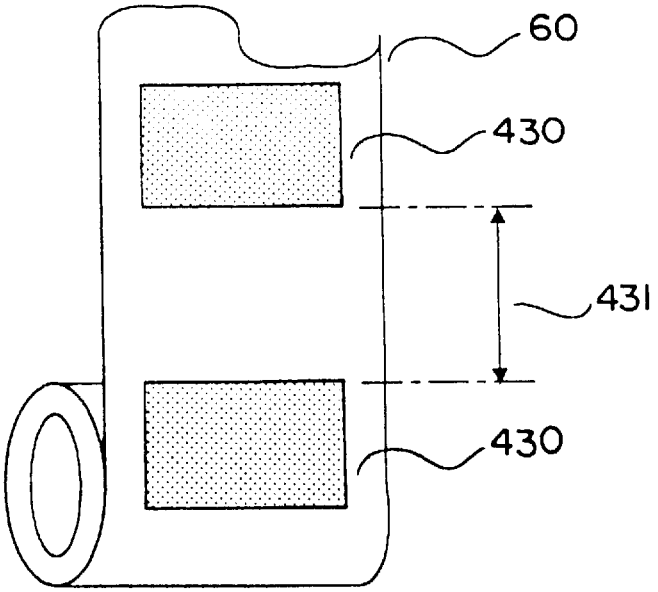
FIG. 16A is a diagram illustrating a used processing sheet in a case where the operation of rewinding the processing sheet is not carried out.
Figure 16B:
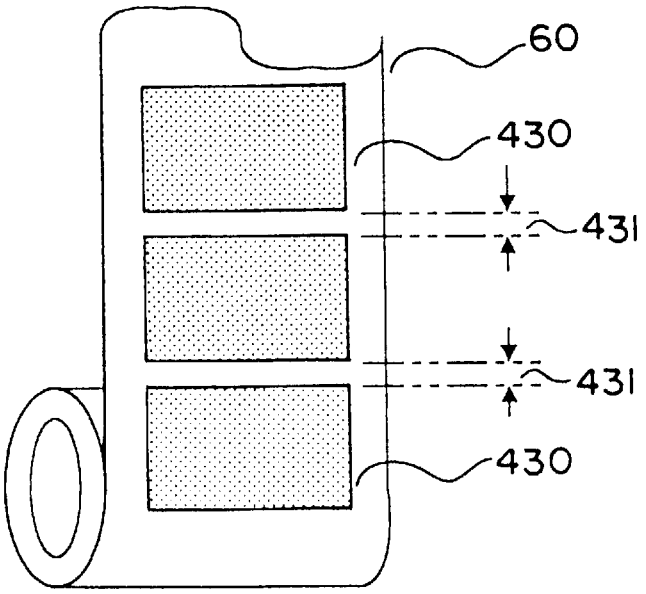
FIG. 16B is a diagram illustrating a used processing sheet in a case where the operation of rewinding the processing sheet is carried out.

FIG. 16A shows the used processing sheet 60 in a case where the rewinding operation of the processing sheet 60 is not carried out. FIG. 16B shows the used processing sheet 60 in a case where the rewinding operation of the processing sheet 60 is carried out.

In the processing sheet 60 shown in FIG. 16A, a substantially long unused region 431, which corresponds to the distance from the position of lamination of the processing sheet 60 and the film F to the trailing-end sensor 418, is present between two used regions 430, whereas, in the processing sheet 60 shown in FIG. 16B, only a very short unused region 431, which corresponds to a transport error in the transport of the film F and the processing sheet 60, is present.

As described above, as the film F on which images (photographed images) have been exposed is laminated on the processing sheet 60 having on its base layers including the complex-formation compound, the physical development nuclei, and the silver halide solvent by using the photosensitive material processing apparatus 310 in accordance with this embodiment, it is possible to easily effect heat development processing and form images without effecting the complicated development and fixation processing in the conventional manner.

In addition, in the photosensitive material processing apparatus 310, since the water serving as the image-forming solvent is applied to the film F prior to the lamination of the film F and the processing sheet 60, the dispersion of the complex-formation compound for metal ions, the silver halide solvent, and the like is facilitated, thereby making it possible to effectively carry out the processing of image formation on the film F.

Furthermore, in the photosensitive material processing apparatus 310, each time the film F is heat-developed and is discharged, the processing sheet 60 is rewound by an amount corresponding to the unused region of the processing sheet 60, and when the processing sheet 60 is used next time, the processing sheet 60 can be used starting from its unused portion which has been rewound. Hence, the processing sheet 60 can be used without waste.

Although, in this embodiment, a description has been given of the photosensitive-material processing apparatus using the heating plates 68, the present invention is not limited to the same. For instance, the photosensitive-material processing apparatus may be a so-called drum-type photosensitive-material processing apparatus which uses a heating drum instead of the heating plates 68.

In addition, although the arrangement provided in this embodiment is such that water serving as the image-forming solvent is applied to the film F, the present invention is not limited to the same. For example, water may be applied to the processing sheet 60, or may be applied to both the film F and the processing sheet 60.

Further, in this embodiment, a description has been given of a case where after one film is subjected to heat development processing, the processing sheet 60 is unfailingly rewound during each heat development processing. However, the present invention is not limited to the same, and when the film F has been discharged continuously from the exposure apparatus 11, heat development processing may be effected continuously, and after all the series of heat development processing has been completed, the processing sheet 60 may be rewound only once. In this case, since the rewinding of the processing sheet 60 is not effected during each period of heat processing when heat development is effected continuously, it is possible to suppress an increase in the processing time spent for rewinding the processing sheet 60.

Fourth Embodiment

In the description of this embodiment, the same parts, members, and arrangements as those of the first embodiment will be denoted by the same reference numerals as those used in the description of the first embodiment, and a detailed description thereof will be omitted.

Figure 17:
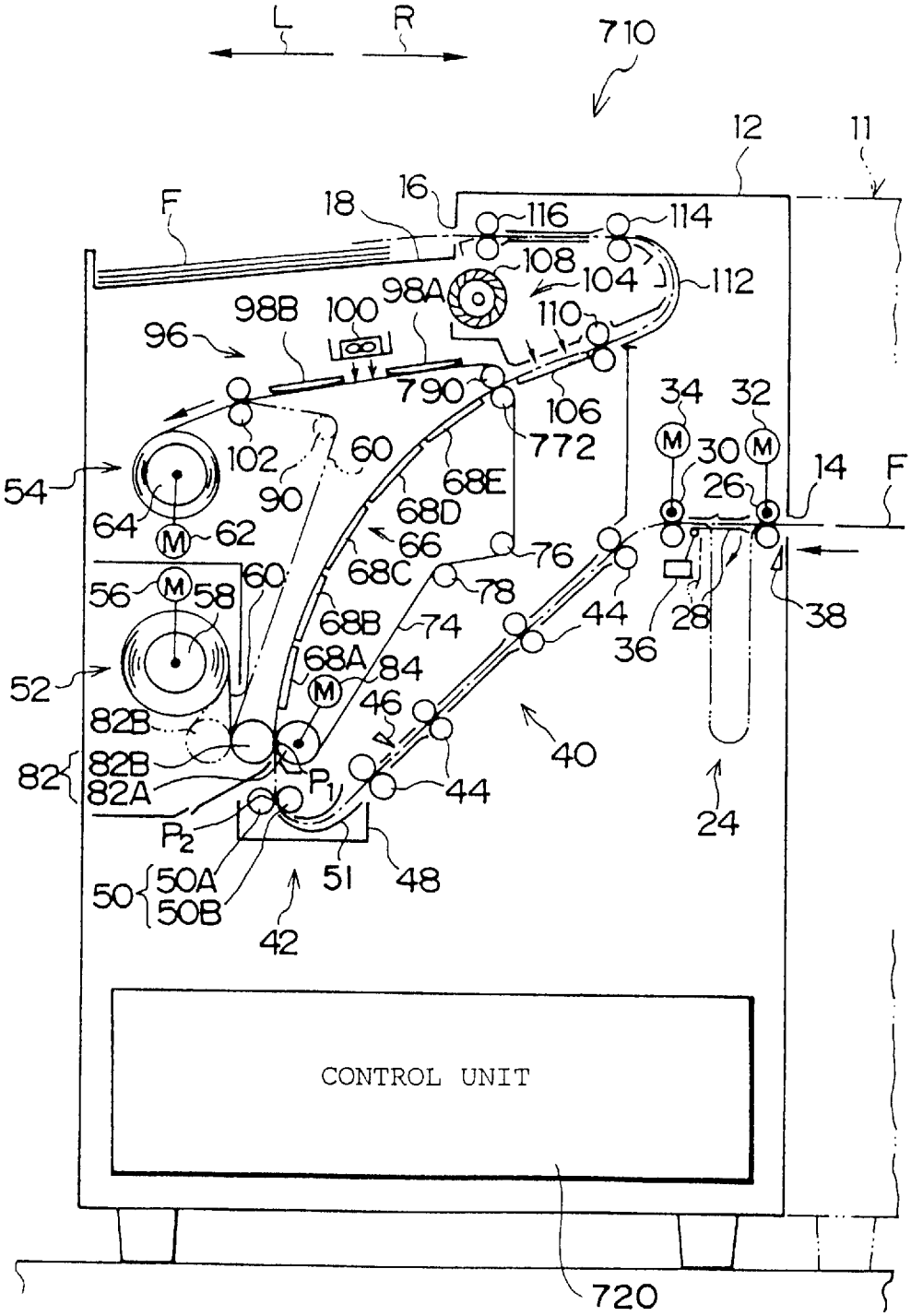
FIG. 17 is a schematic diagram illustrating an internal configuration of the development processing apparatus in accordance with a fourth embodiment.

FIG. 17 shows an internal configuration of a development processing apparatus 710 in accordance with a fourth embodiment of the present invention. As can be appreciated from FIG. 17, this embodiment is very similar to the first embodiment, and the description of this embodiment will be primarily given on those portions which differ from the first embodiment.

In this embodiment, a roller 772 corresponding to the roller 72 in the first embodiment is disposed between the heating plate 68E and the heating plate 106.

The belt 74 which comes into contact with the reverse surface of the film F is wound around the roller 82A of the pair of laminating rollers 82, the heating plates 68A to 68E, and the roller 772, and the belt 74 is further wound around the rollers 76 and 78. The rollers 82A, 772, 76, and 78 are connected to each other by an unillustrated timing belt (or a chain or the like), and are adapted to rotate as the pair of laminating rollers 82 is rotated by the motor 84. Accordingly, the transporting means for transporting the film F and the processing sheet 60 laminated by the pair of laminating rollers 82 is constituted by the rollers 82A, 772, 76, and 78 and the belt 74. The arrangement provided is such that the roller 82A is rotated by the driving force of the motor 84, which in turn causes the belt 74 to concurrently move in a circulating manner and causes the rollers 772, 76, and 78 to rotate, thereby allowing the processing sheet 60 to be transported together with the film F held in contact with the belt 74.

Further, the film F and the processing sheet 60, which were transported along the surfaces of the heating plates 68A to 68E and were subjected to heat development processing, are adapted to be separated by a roller 790 serving as the separating means and provided at a position opposing the roller 772 disposed in the vicinity of the heating plate 68E provided in an uppermost portion of the heat development section. This roller 790 is rotated by an unillustrated motor. In addition, since the processing sheet 60 is transported by the roller 790 while undergoing a shift in direction by 90° or more with a small radius of curvature with respect to the direction in which the processing sheet 60 was transported along the heating plates 68A to 68E, the processing sheet 60 can be separated reliably from the film F.

In addition, the roller 82B of the pair of laminating rollers 82 and the roller 790 serving as the separating means are movable to the position indicated by the phantom line in FIG. 17. As a result, when the development processing apparatus 710 is not being used, i.e., when heat development processing is not being carried out, the processing sheet 60 can be moved away from the heating plates 68A to 68E, so that the deterioration in the quality of the processing sheet 60 can be prevented. As the means for moving the roller 82B and the roller 790, it is possible to apply the means which is used in the above-described second embodiment. Further, a control unit 720 is adapted to control driving units such as motors and detectors such as sensors in the development processing apparatus 710.

Next, a description will be given of the operation in accordance with the fourth embodiment.

In the development processing apparatus 710, when the exposed film F discharged from the exposure device 11 is inserted through the insertion port 14, the film F is detected by the insertion sensor 38, and the transport rollers 26 are rotated at a speed adjusted to the speed at which the film F is inserted, thereby transporting the film F into the interior of the development processing apparatus 710.

Since the processing speed of the film F (at and downstream of the transport rollers 30) in the development processing apparatus 710 is slower than the insertion speed of the film F, when the leading end of the film F is nipped by the transport rollers 30, the branching guide 28 is changed over to the vertical state indicated by the phantom lines. Hence, the trailing end side of the film F is suspended downward, as indicated by the phantom lines in FIG. 17.

The film F transported by the transport rollers 30 is transported to the water applying section 42 by the transport rollers 44 of the photosensitive material carrying-in section 40. The film F is immersed in water stored in the water application tank 48, and excess water is then removed by the squeegee rollers 50 before the film F is transported vertically upward.

Subsequently, when a predetermined time duration elapses after the leading end of the film F was detected by the standby sensor 46, the belt 74 and the processing sheet 60 are transported at the same speed as the traveling speed of the film F, and the film F with water applied thereto and the processing sheet 60 are laminated by the pair of laminating rollers 82, and are transported to the heat development section 66.

In the heat development section 66, the laminated assembly of the film F and the processing sheet 60 is transported while coming into contact with or into close All proximity with the heating surfaces of the heating plates 68A to 68E. As a result, the film F is heated, and its temperature rises and reaches a temperature appropriate for development processing. As the temperature of the film F thus rises, and the complex-formation compound, the physical development nuclei, and the silver halide solvent contained in the processing sheet 60 act on the film F, it is possible to form desired images on the film F.

It should be noted that consideration has been given to ensure that the film F is subjected to heat development uniformly in a state of close contact with the processing sheet 60 since water has been attached to the film F in the water applying section 42. At the same time, since the laminated assembly of the film F and the processing sheet 60 is transported along the surfaces of the heating plates 68A to 68E by the belt 74, and is subjected to heat development processing, even in cases where the processing sheet 60 is a thin material, the film F and the processing sheet 60 are brought into close contact with each other, thereby making it possible to form images stably on the film F.

After the heat development processing is thus effected and the images are formed on the film F, the processing sheet 60 is separated from the film F by the roller 790. At this time, since the processing sheet 60 is transported while undergoing a shift in direction by 90° or more with a small radius of curvature with respect to the direction in which the processing sheet 60 was transported along the heating plates 68A to 68E, the processing sheet 60 can be separated reliably from the film F. The processing sheet 60 which has been separated from the film F is dried while coming into contact with or into close proximity with the heating plates 98A and 98B in the processing-sheet drying section 96, and as warm air is blown onto it. Further, the dried processing sheet 60 is taken up onto the takeup shaft 64.

Meanwhile, the film F which has been separated from the processing sheet 60 is subjected to dry processing in the film drying section 104, and is then discharged onto the tray from the discharge port 16 via the transport guide 112 and the pair of transport rollers 114 and the pair of transport rollers 116.

As described above, in the development processing apparatus 710 in accordance with the fourth embodiment, since the plurality of plate-shaped heating plates 68A to 68E are arranged in the form of a circular arc as the heating means for the heat development processing of the laminated assembly of the film F and the processing sheet 60, the main body of the development processing apparatus 710 can be made compact. In addition, since the laminated assembly of the film F and the processing sheet 60 is subjected to heat development processing while being transported along the surfaces of the heating plates 68A to 68E by means of the belt 72, i.e., the transporting means, heat development processing can be effected stably irrespective of the thickness of the processing sheet 60, and the laminated film F and processing sheet 60 can be easily separated. Furthermore, when heat development processing is not being carried out, the processing sheet 60 is moved away from the surfaces of the heating plates 68A to 68E, so that the deterioration in the quality of the processing sheet 60 can be prevented.

Fifth Embodiment

Figure 18:
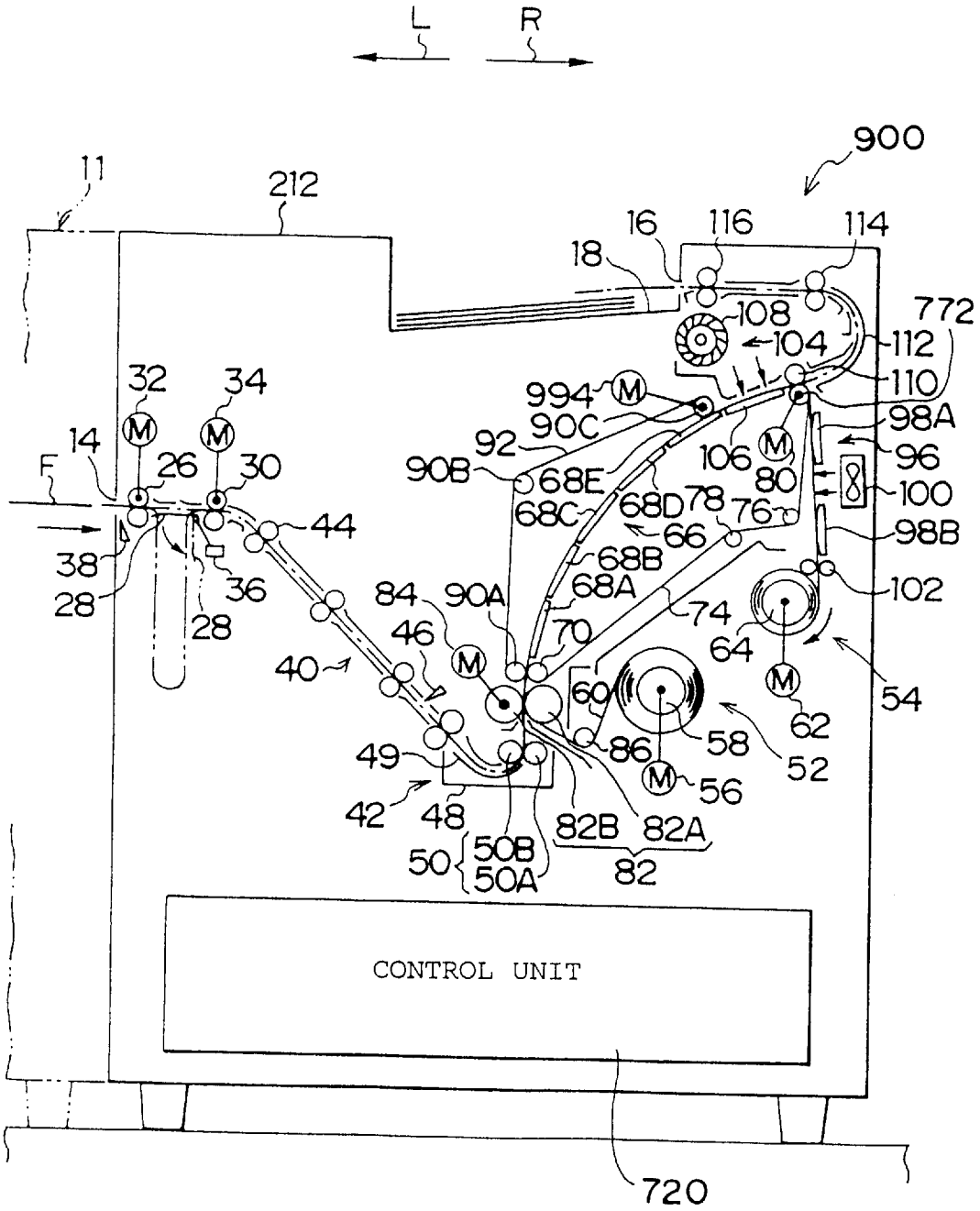
FIG. 18 is a schematic diagram illustrating the internal configuration of the development processing apparatus in accordance with a fifth embodiment.

FIG. 18 shows a development processing apparatus 900 in accordance with a fifth embodiment. Incidentally, the same parts, members, and arrangements as those of the above-described fourth embodiment will be denoted by the same reference numerals, and a detailed description thereof will be omitted.

As shown in FIG. 18, a main body 212 of the development processing apparatus 900 is formed in the shape of a box. The exposure apparatus 11 for imagewise exposing the film F and discharging the same is disposed on the left-hand side of the main body 212 (on the side in the direction of arrow L), and the slit-shaped insertion port 14, through which the undeveloped film F is inserted, is provided on a left-hand surface of the main body 212.

An unillustrated door is provided on a right-hand surface of the main body 212 of the development processing apparatus 900, and the interior of the main body 212 can be exposed by opening the door.

In the heat development section 66, the plurality of heating plates 68A to 68E are arranged in the form of a circular arc in the same way as the development processing apparatus 710 in accordance with the fourth embodiment. On the lower side of the lowermost heating plate 68A provided in this heat development section 66, the roller 70 is disposed on the right-hand side of the traveling path of the film F indicated by the chain line. On the side of the heating plate 68E in the heat development section 66, the heating plate 106 is disposed along the traveling path of the film F. On the right-hand side of the heating plate 106, a roller 772 is disposed on the lower side of the traveling path of the film F. Incidentally, this heating plate 106 is used for heating and drying the film F. while the roller 772 has the function of the separating means for separating the laminated film F and processing sheet 60.

The endless belt 74, which comes into contact with the reverse surface of the processing sheet 60, is wound around the roller 70, the heating plates 68A to 68E, the heating plate 106, and the roller 772, and is further wound around rollers 76 and 78.

Further, provided at positions facing the heating plates 68A to 68E are the rollers 90A, 90B, and 90C, as well as the belt 92 wound around these rollers 90A, 90B, and 90C to urge the processing sheet 60 toward the outer peripheral surfaces of the heating plates 68A to 68E, while transporting the processing sheet 60 along the surfaces of the heating plates 68A to 68E. The rollers 90A, 90B, and 90C are connected to each other by an unillustrated timing belt (or a chain or the like), and are rotated by a motor 794.

Accordingly, the belt 92, which is wound around the rollers 90A, 90B, and 90C provided on the obverse surface side of the heating plates 68A to 68E, comes into contact with the reverse surface of the film F, while the belt 74, which is wound around the rollers 70, 772, 76 and 78 provided on the reverse surface side of the heating plates 68A to 68E, comes into contact with the obverse surface of the processing sheet 60, so as to nip and transport the laminated assembly of the film F and the processing sheet 60 along the surfaces of the heating plates 68A to 68E.

Further, the pair of laminating rollers 82 is disposed below the roller 70 and above the pair of squeegee rollers 50, and the roller 86, around which the processing sheet 60 is wound, is disposed below the feed shaft 58 of the processing-sheet feeding section 52. After the processing sheet 60 fed out from the feed shaft 58 is taken up onto the roller 86, the processing sheet 60 is transported along the heating plates 68A to 68E via the pair of laminating rollers 82.

It should be noted that the processing-sheet feeding section 52 and the processing-sheet takeup section 54 are disposed on the right-hand side of the interior of the main body 212 of the development processing apparatus 900 and on the inner side of the heating plates 68A to 68E arranged in the form of a circular arc. For this reason, in the case of the development processing apparatus 900 in accordance with the fifth embodiment, when heat development processing is not being carried out, the processing sheet 60 cannot be spaced apart from the heating plates 68A to 68E like the development processing apparatus 710 in accordance with the fourth embodiment.

Next, a description will be given of the operation in accordance with the fifth embodiment.

In the development processing apparatus 900, after the film F with water applied thereto is laminated on the processing sheet 60 by the pair of laminating rollers 82, the laminated assembly of the film F and the processing sheet 60 is nipped by the belts 74 and 92, i.e., the transporting means, and is transported along the surfaces of the heating plates 68A to 68E in the heat development section 66. As a result, since the chemicals contained in the processing sheet 60 act on the film F, it is possible to form desired images.

As described above, the development processing apparatus 900 in accordance with the fifth embodiment of the present invention makes it possible to obtain advantages similar to those of the development processing apparatus 710 in accordance with the fourth embodiment. At the same time, since the laminated assembly of the film F and the processing sheet 60 is nipped and transported by the two belts 74 and 92, the heat radiated from the heating plates 68A to 68E is prevented from escaping to the outside, thereby making it possible to enhance the heat isolation effect.

Figure 19:
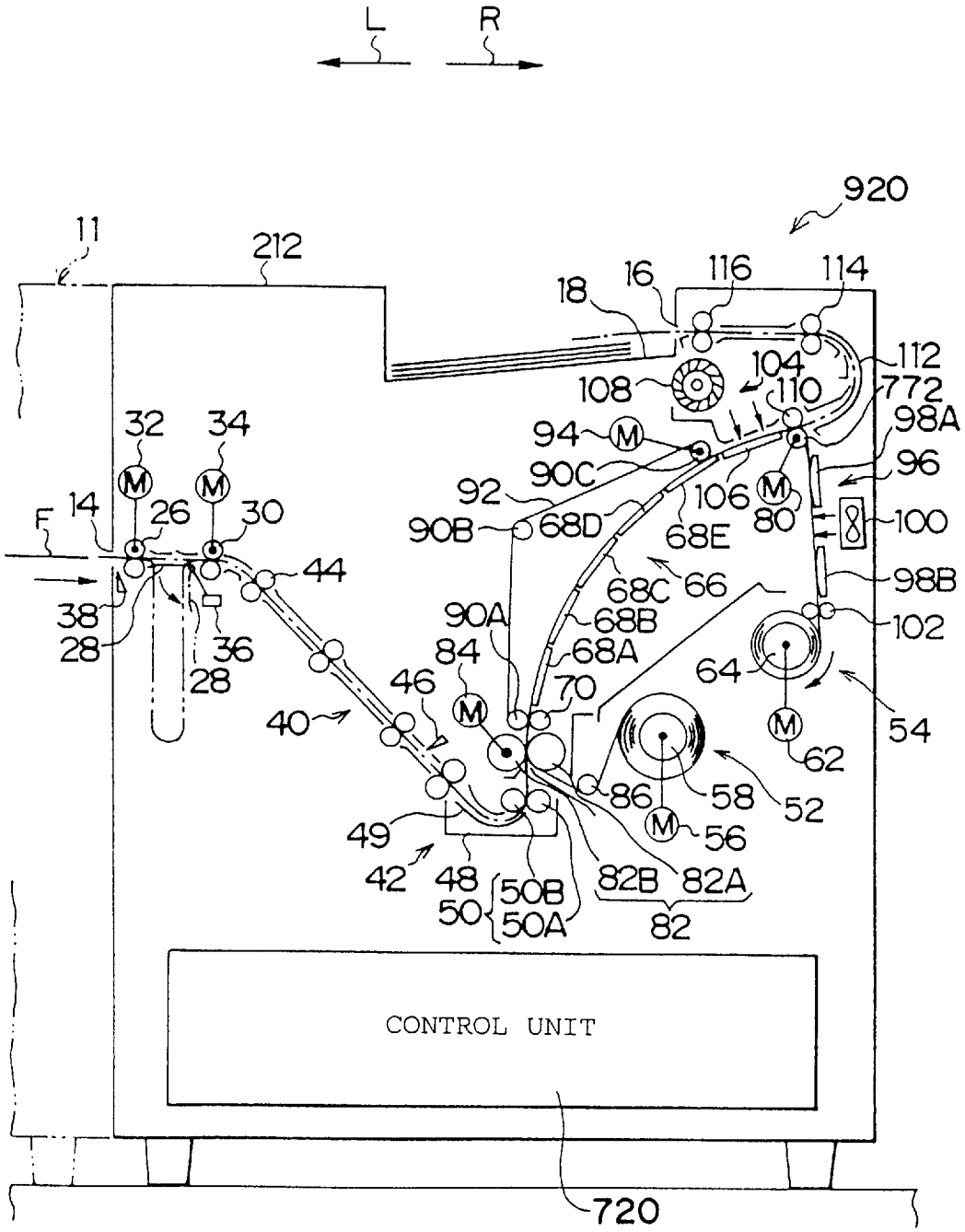
FIG. 19 is a schematic diagram illustrating the internal configuration of the development processing apparatus as a modification of the fifth embodiment.

Incidentally, with respect to the arrangement of the heat development section 66 and its periphery in the development processing apparatus 900 in accordance with the fifth embodiment of the present invention, it is possible to adopt the arrangement of a development processing apparatus 920 shown in FIG. 19 as a modification of the fifth embodiment. As shown in this arrangement, the rollers 76 and 78 and the belt 74 serving as the transporting means on the reverse surface side of the heating plates 68A to 68E provided in the development processing apparatus 900 shown in FIG. 8 may be eliminated from the component parts, and the film F and the processing sheet 60 may be transported by the belt 92 serving as the transporting means provided on the obverse surface side of the heating plates 68A to 68E. At this time, the roller 772 is used as the separating means for separating the laminated film F and processing sheet 60 in the same way as with the development processing apparatus 900.

Thus, since the belt on the heating plates 68A to 68E side is not present, the heat from the heating plates 68A to 68E is transmitted smoothly to the film F; hence, it is possible to reduce the period of time required for heat development processing.

Figure 20:
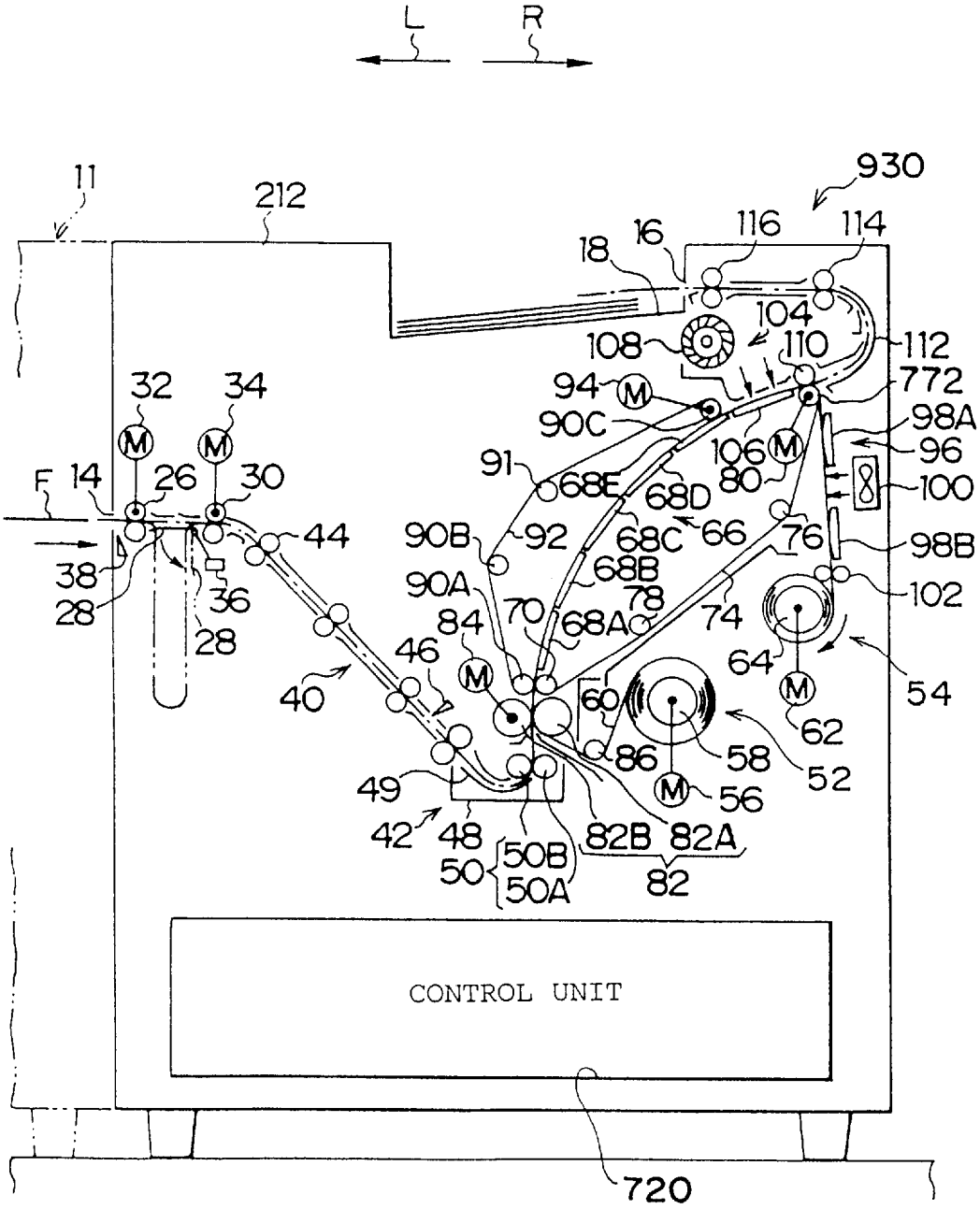
FIG. 20 is a schematic diagram illustrating the internal configuration of the development processing apparatus as another modification of the fifth embodiment.

In addition, as in the case of a development processing apparatus 930 shown in FIG. 20 as another modification of the fifth embodiment, an arrangement may be provided such that the positions and the number of the rollers, around which the belts 74 and 92 provided as the transporting means are wound, are changed. The position of the roller 772, however, should preferably be not altered since the roller 772 is used as the separating means.

Specifically, in the development processing apparatus 930 shown in FIG. 20, of the rollers 70, 772, 76, and 78 around which the belt 74 serving as the transporting means arranged on the reverse surface side of the heating plates 68A to 68E, the positions of the rollers 76 and 78 are changed, and the belt 74 is wound around the roller 78 from the outer side thereof. Further, in the transporting means arranged on the obverse surface side of the heating plates 68A to 68E, a roller 91 is added, and the belt 92 is wound around the four rollers 90A, 90B, 90C, and 91.

Although, in the above-described fourth and fifth embodiments, a description has been given of the arrangement in which the used processing sheet 60 which was separated from the film F is taken up onto the takeup shaft 64 of the processing-sheet takeup section 54, the present invention is not limited to the same. For example, it is possible to adopt an arrangement in which the processing sheet 60 wound around the feed shaft 58 of the processing-sheet feeding section 52 is cut to a length necessary for the development processing of one film F, and the cut one-film portion of the processing sheet 60 may be discarded upon completion of the heat development processing.

In addition, although the arrangement provided in the respective embodiments is such that water serving as the image-forming solvent is applied to the film F, water may be applied to the processing sheet 60, or may be applied to both the film F and the processing sheet 60.

Sixth Embodiment

Figure 21:
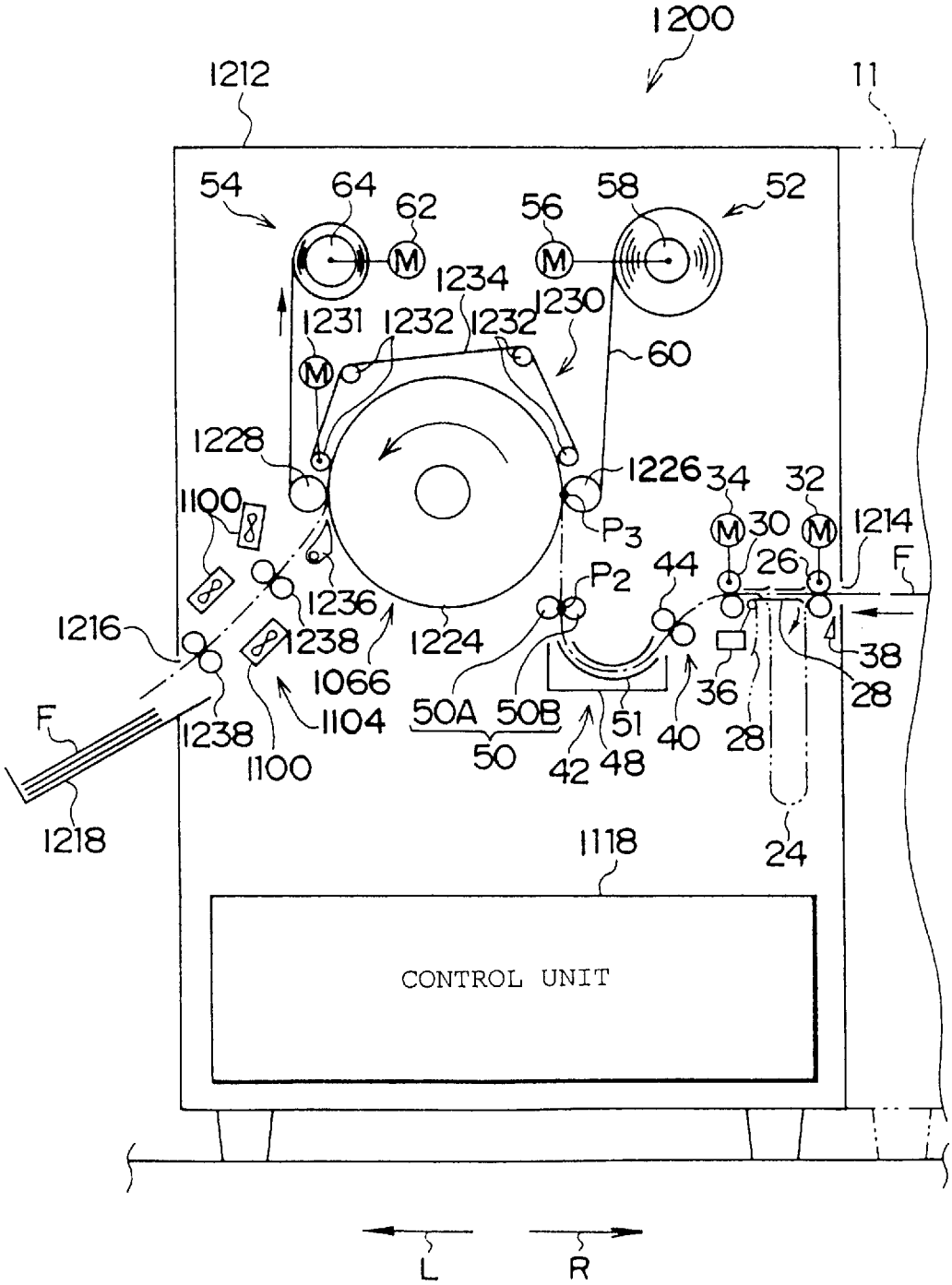
FIG. 21 is an overall diagram of the photosensitivematerial processing apparatus in accordance with a sixth embodiment of the present invention.

Referring now to FIG. 21, a description will be given of a sixth embodiment. In this embodiment, the same parts, members, and arrangements as those of the first embodiment will be denoted by the same reference numerals as those used in the description of the first embodiment, and a detailed description thereof will be omitted.

FIG. 21 shows an internal configuration of a photosensitive-material processing apparatus 1200 in accordance with the sixth embodiment.

As shown in FIG. 21, a main body 1212 of the photosensitive-material processing apparatus 1200 is formed in the shape of a box. An insertion port 1214 is provided in a right-hand surface of the main body 1212, while a discharge port 1216 is provided in a left-hand surface of the main body 1212. Incidentally, a tray 1218 for receiving the film F which has been discharged from the discharge port 1216 is disposed on the let-hand surface of the main body 1212.

An unillustrated door is provided on an upper surface of the main body 1212, and the interior of the main body 1212 can be exposed by opening the door.

Inside the main body 1212, the processing-sheet feeding section 52 is provided in the vicinity of an upper right corner, while the processing-sheet takeup section 54 is provided in the vicinity of an upper left corner. Incidentally, the feed shaft 58 and the takeup shaft 64 can be removed from the main body 1212 by opening the door at the upper surface.

A heating drum 1224 is installed in a heat development section 1066 in accordance with this embodiment. The heating drum 1224 is rotatably supported by the main body 1212, and is rotatively driven by an unillustrated driving system. A heater is accommodated in the heating drum 1224, and is capable of increasing the temperature of the heating drum 1224.

A winding roller 1226 is provided on the right-hand side of the center of rotation of the heating drum 1224, while a winding roller 1228 is provided on the left-hand side of the center of rotation of the heating drum 1224.

The processing sheet 60 is transported from the feed shaft 58 toward the winding roller 1226, and after the processing sheet 60 is wound around the outer peripheral surface of the winding roller 1226, the processing sheet 60 is rewound around the outer peripheral surface (the outer peripheral surface on the upper side) of the heating drum 1224. Further, the processing sheet 60 is wound around the winding roller 1228, and is then taken up onto the takeup shaft 64 in roll form and is accommodated. It should be noted that the winding roller 1228 corresponds to the separating means in accordance with the present invention for separating the processing sheet 60 and the film F. In addition, the heating drum 1224 and the winding roller 1226 correspond to the superposing means (laminating means) in this embodiment.

In addition, the heat development section 1066 is provided with an urging device 1230. The urging device 1230 is provided with a plurality of rollers 1232 which are rotated by a motor 1231, as well as a belt 1234 which are wound around these rollers 1232 to urge the processing sheet 60 against the outer peripheral surface of the heating drum 1224.

The film F which has been transported from the squeegee rollers 50 is inserted into a nip between the heating drum 1224 and the processing sheet 60 wound around the winding roller 1226, and is laminated on the processing sheet 60. Subsequently, the film F is subjected to heat development while it is transported along the outer peripheral surface of the heating drum 1224 in a state in which the film F is nipped by, on the one hand, the outer peripheral surface of the heating drum 1224 and, on the other hand, the processing sheet 60 which is transported in a state of being wound around the outer peripheral surface of the heating drum 1224.

It should be noted that the center of rotation of the heating drum 1224 and the center of rotation of the winding roller 1226 are in the same horizontal plane, while a point of contact $P_3$ between the heating drum 1224 and the winding roller 1226 is located substantially at a position immediately above the point of contact P2 between the roller 50A and the roller 50B of the squeegee rollers 50. As a result, the film F with water applied thereto is transported vertically upward by the squeegee rollers 50.

Since the center of rotation of the heating drum 1224 and the center of rotation of the winding roller 1226 are in the same horizontal plane, when the film F is further transported and even if a trailing end of the film F in its traveling direction leaves the squeegee rollers 50, a rear half portion of the film F in its traveling direction is transported into the nip between the heating drum 1224 and the processing sheet 60 wound around the winding roller 1226 while maintaining its vertical state owing to its own weight. Therefore, the film F with water applied thereto, from its leading end to its trailing end, is laminated on the processing sheet 60 while constantly maintaining a fixed angle with respect to the processing sheet 60.

Meanwhile, a releasing pawl 1236 is disposed below the winding roller 1228 on the left-hand side of the heating drum 1224. The releasing pawl 1236 is capable of releasing from the heating drum 1224 the film F nipped and transported by the heating drum 1224 and the processing sheet 60.

In addition, a film drying section 1104 is provided in the vicinity of the releasing pawl 236. The film drying section 1104 is provided with a plurality of fans 1100 for blowing air onto the film F and pairs of transport rollers 1238 for transporting the film. The arrangement provided is such that the film drying section 1104 is capable of drying the film F released from the heating drum 1224 by the releasing pawl 1236 and of discharging the film F through the discharge port 1216. It should be noted that the transport rollers 1238 correspond to the discharge means in this embodiment.

Further, a control unit 1118 effects control of the motors, the sensors, the heaters, and the like in the same way as in the first embodiment.

Next, a description will be given of the operation in accordance with this embodiment.

With this photosensitive-material processing apparatus 1200, the film F with water applied thereto is introduced into the nip between the heating drum 1224 and the processing sheet 60 wound around the winding roller 1226. The film F is transported around the outer periphery of the heating drum 1224 counterclockwise in FIG. 21 while being nipped by the outer peripheral portion of the heating drum 1224 and the processing sheet 60 wound around the winding roller 1226. Here, as the film F is heated in the state of being superposed on the processing sheet 60, heat development is effected.

When the film F and the processing sheet 60 are transported to a left-end portion of the heating drum 1224, the processing sheet 60 is wound around the winding roller 128 and is thereby separated from the film F and taken up consecutively onto the takeup shaft 64.

Meanwhile, the film F which has reached the winding roller 1228 is peeled off the heating drum 1224 due to the operation of the releasing pawl 1236. The film F released from the heating drum 1224 is dried as drying air is blown onto it by the plurality of fans 1100 in the film drying section 1104, and the film F is discharged from the discharge port 1216 onto the tray 1218 outside the main body 1212.

With the photosensitivie-material processing apparatus 1200 in accordance with this embodiment as well, since the film F and the processing sheet 60 are laminated while constantly maintaining a fixed angle, uneven development does not occur in the film F.

It should be noted that when the film F is released from the processing sheet 60, an unused portion of the processing sheet 60 is entered in the heat development section 1066, so that that unused portion may be rewound after heat development processing, and may be used in the heat development processing of the next film F.

In a case where the unused portion of the processing sheet 60 which has entered the heat development section 1066 is rewound, and the unused portion is used in the heat development processing of the next film F, it is preferable to cause the processing sheet 60 to be spaced apart from the heating drum 1224 so as to avoid the effect of heat in the heat development section 1066. In the case where the processing sheet 60 is spaced apart from the heating drum 1224, it suffices if the overall urging device 1230 is supported by a sliding mechanism, and the urging device 1230 is driven away from the heating drum 1224 by a driving device such as a motor.

In addition, in a case where the continuous processing of the film F is carried out, it is efficient to effect the processing as it is without rewinding the processing sheet 60.

It should be noted that silver halide particles of the photosensitive material which are usable in the present invention are particles of silver halides with a silver chloride content of 70 mol % or more, including silver chloride, silver iodochloride, silver chloroiodobromide, and iodochlorobromide. The silver iodide content is preferably 5 mol % or less, more preferably 1 mol % or less, and still more preferably 0.5 mol % or less.

The silver halide emulsion of the photosensitive material used in the present invention may be a surface latent image type or an internal latent image type. The internal latent image-type emulsion is used as a direct reversal emulsion by combining a nucleating agent and a photocoupler. In addition, particles of the silver halide emulsion may be multi-structured particles having different halogen compositions between the interior of the particle and the surface of the particle. In addition, the silver halide emulsion may be one in which silver halide emulsions having different compositions are joined by epitaxial junction.

It is also possible to use a silver halide emulsion having a structure which has a silver-bromide localized phase in the interior of the silver halide and/or on its surface in a layered or nonlayered form. The halogen composition having the localized layer is preferably one having a silver bromide content of at least 20 mol %, more preferably one in excess of 30 mol %.

In the process of preparing the silver halide emulsion in the present invention, it is preferable to effect a desalting step for removing excess salts. It is possible to effect desalting by using a noodle washing process in which gelatin is gelated, or it is possible to employ a sedimentation process (flocculation) using inorganic salts (e.g., sodium sulfite) constituted by polyhric anions, anionic surface-active agents, anionic polymers (e.g., polystyrene sulfonic acid), or gelatin derivatives (aliphatic acylated gelatin, aromatic acylated gelatin, aromatic carbomoylated gelatin, etc.). Alternatively, it is possible to use ultrafilters disclosed in U.S. Pat. No. 4,758,505, Japanese Patent Application Laid-Open (JP-A) No. 62-113137, Japanese Patent Application Publication (JP-B) No. 59-43727, and U.S. Pat. No. 4,334,012, or it possible to use a natural sedimentation process, or a centrifugal separation process. Ordinarily, the sedimentation process is preferably used.

Combinations of a basic metal compound, which is difficultly soluble in the water used as a base precursor in the above-described photosensitive material, and a compound (referred to as a complex-forming compound or a complexing agent) capable of undergoing a complex-forming reaction with metal ions forming the difficultly soluble metal compound, are disclosed in Japanese Patent Application Laid-Open (JPA) No. 62-129848, European Patent Laid-Open No. 210,660A2, U.S. Pat. No. 4,740,445, and the like.

Preferable difficultly soluble basic metal compounds include oxides of zinc or aluminum, hydroxides, and basic carbonates, and particularly preferable are zinc oxides, zinc hydroxides, and basic zinc carbonates.

The metal compound which is difficultly soluble in water is used by being dispersed in the form of fine particles in a hydrophilic binder, as disclosed in Japanese Patent Application Laid-Open (JP-A) No. 59-174830. The average particle size of the fine particle is 0.001–5 $\mu$m, preferable in the range of 0.01–2 $\mu$m. The content in the photosensitive material is 0.01 g/m$^2$–5 g/m$^2$, preferably 0.05 g/m$^2$–2 g/m$^2$.

The complex-forming compound used in the processing sheet 60 which contains the complex-forming compound for metal ions of the basic metal compound which is difficultly soluble in water is well-known as a chelating agent in analytical chemistry and as a water softener in photographic chemistry.

In the present invention, physical development nuclei are contained in the processing sheet 60, and the physical development nuclei are formed such that soluble silver salts which diffused from a photosensitive material are reduced and transformed into physical development silver, which is then fixed on the processing sheet 60. As the physical development nuclei, all the well-known physical development nuclei can be used, including heavy metals such as zinc, mercury, lead, cadmium, iron, chromium, nickel, tin, cobalt, lead, and ruthenium, rare metals such as palladium, platinum, silver, and gold, and colloidal particles of their chalcogen compounds of sulfur, selenium, tellurium, and the like. These physical development nucleus substances are obtained by forming metal colloidal dispersions by reducing corresponding metal ions with reducing agents such as ascorbic acid, sodium borohydride, hydroquinone, and dextran, or by preparing colloidal dispersions of water-insoluble metal sulfides, metal selenides, or metal tellurides by mixing soluble sulfide, selenide, or telluride solutions. These dispersions are preferably formed in the presence of a hydrophilic binder such as gelatin. The method of preparing colloidal silver particles is disclosed in U.S. Pat. No. 2,688,601. A desalting process for removing excess salts, which is known in the process of preparation of silver halide emulsions, may be effected, as required.

As the sizes of these physical development nuclei, those with a particle size of 2–200 nm are preferably used.

These physical development nuclei are normally contained in the processing sheet 60 in an amount of $10^{-3}$–100 mg/m$^2$, preferably $10^{-2}$–10 mg/M$^2$.

The physical development nuclei may be prepared separately and added to an applying solution, but may be 1prepared in an applying solution containing a hydrophilic binder by reacting, for instance, a silver nitrate and a sodium sulfide, or a gold chloride and a reducing agent, and the like.

As the physical development nuclei, silver, silver sulfides, palladium sulfides, and the like are preferably used. In a case where physical development silver transferred to the processing sheet 60 is used as an image, palladium sulfides, silver sulfides, and the like are preferably used because $D_{min}$ is too low and $D_{max}$ is high.

As the silver halide solvents used in the present invention, well-known ones can be used. For example, it is possible to use thiosulfates such as sodium thiosulfates and ammonium thiosulfates; sulfites such as sodium sulfites and sodium hydrogensulfites; thiocyanates such as potassium thiocyanates and ammonium thiocyanates; thioether compounds such as 1,8-di-3,6-diaoctane, 2,2'-thiodiethanol, 6,9-dioxa3, 12-dithiatetradecane-1, and 14-diol, as disclosed in Japanese Patent Application Publication (JP-B) No. 47-11386; thiourea compounds, as disclosed in Japanese Patent Application Laid-Open (JP-A) Nos. 53-82408, 55-77737, and 55-2982; compounds having five- or six-member imide rings such as uracil and hydantoin, as disclosed in Japanese Patent Application No. 6-325350; imidazols disclosed in Japanese Patent Application Laid-Open (JP-A) No.54-100717; and compounds of the following general formula, as disclosed in Japanese Patent Application Laid-Open (JP-A) No. 53-144319:

N(R1)(R2)–C(=S)–X–R3 where X represents a sulfur atom or an oxygen atom; R1 and R2 may be the same or different, and respectively represent an aliphatic group, an aryl group, a heterocyclic residue, or an amino group. R3 represents a aliphatic or aryl group.

R1 and R2, or R2 and R3 may be coupled with each other to form five- or six-membered heterocyclic rings. Trimethyl triazolium thiolate and meso-ion thiolate compounds described in *Analytical Chemica Acta*, Vol. 248, pp. 604–614 (1991) are also preferable to use. Compounds which can be stabilized by fixing silver halides disclosed in Japanese Patent Application No. 6-206331 can also be used as silver halide solvents. Combinations of the above-described silver halide solvents may be used in admixture of two or more.

Seventh Embodiment

Figure 22:
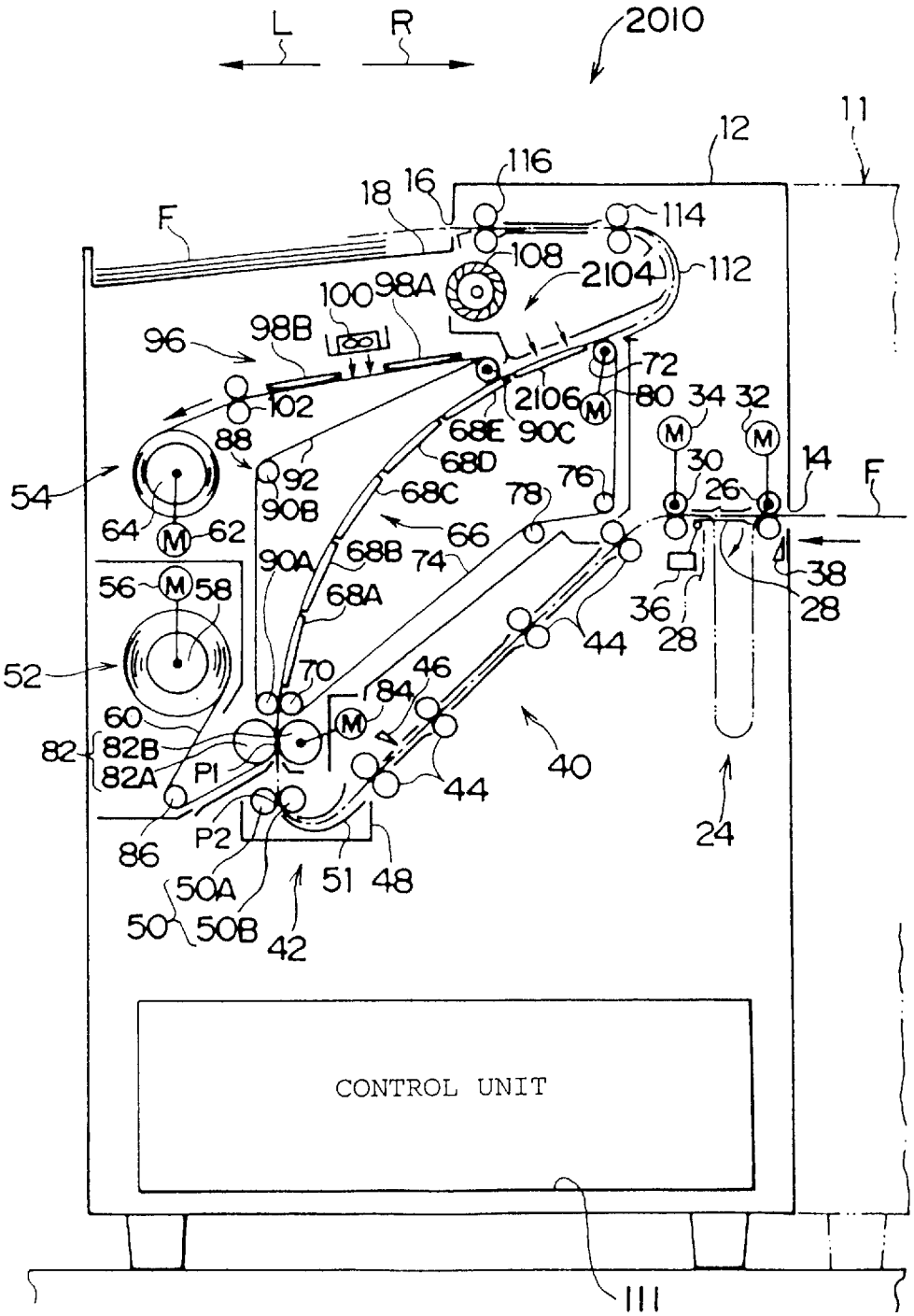
FIG. 22 is a overall diagram of the development processing apparatus in accordance with a seventh embodiment.

Referring to FIG. 22, a description will be given of a seventh embodiment. In this embodiment, the same parts, members, and arrangements as those of the first embodiment will be denoted by the same reference numerals as those used in the description of the first embodiment, and a detailed description thereof will be omitted. In this embodiment, the arrangement of the film drying section differs from that of the first embodiment, so that a description will be primarily given of this aspect.

In a development processing apparatus 2010 in accordance with this embodiment, a film drying section 2104 is provided on the downstream side, as viewed in the traveling direction of the film F, of the heat development section 66. A heating plate 2106 for drying is provided in the film drying section 2104 along the traveling path of the film F, and the fan 108 which has an unillustrated heater incorporated therein for blowing warm air onto the film F is provided with the traveling path of the film F interposed between the fan 108 and the heating plate 2106 for drying.

The heating surface (the upper surface in FIG. 22) of the heating plate 2106 for drying is formed flat, and is arranged in the same plane as that of the heating surface of the heating plate 68E. Thus, the film drying section 2104 is arranged such that the film F is transported rectilinearly along the flat heating surface of the heating plate 2106 for drying. Namely, in the film drying section 2104, consideration has been given so that a force such as a pressing force or a bending force will not be applied to the film F being transported. Further, the temperature of the heating surface of the heating plate 2106 for drying is set to about 80° C. which is higher than the glass transition temperature Tg (about 70° C.) of PET which is the base constituting the film F. Although the temperature of the heating surface of the heating plate 2106 for drying is thus set to be higher than the glass transition temperature Tg of PET, since no external force such as a pressing force or a bending force is applied to the film F being transported, no deformation occurs in the film F.

Next, a description will be given of the operation in accordance with the seventh embodiment.

In the film drying section 2104, the film F which has been released from the processing sheet 60 is transported rectilinearly along the surface of the heating plate 2106 for drying whose temperature is set to about 80° C. This heating temperature is higher than the glass transition temperature Tg of PET which is the base constituting the film F, i.e., the heating temperature is set to be substantially higher than the conventional heating temperature for drying, so that drying is speeded up. In this seventh embodiment in which the heating temperature is set to about 80° C., as compared with a conventional case in which the heating temperature is set to about 80° C., it is possible to obtain the effect of increasing the speed by about 10 times.

In addition, warm air from the fan 108 is blown onto the upward-facing surface (the surface opposite to the surface which comes into contact with the heating plate 2106 for drying) of the film F which is transported along the surface of the heating plate 2106 for drying. Since both surfaces of the film F are thus heated and dried, the film F can be dried very efficiently.

On the other hand, when the film F is transported along the surface of the heating plate 2106 for drying, since the film F is transported rectilinearly, no force which would otherwise deform the film F acts on the film F. As a result, despite the fact that the temperature of the film F becomes substantially higher than the glass transition temperature Tg of PET which is the base, no residual deformation occurs in the film F.

Accordingly, in accordance with the seventh embodiment, it is possible to increase the speed in the dry processing of the film F while ensuring that no deformation remains in the film F.

The film F subjected to high-speed dry processing in the above-described manner is discharged from the discharge port 16 onto the tray 18 via the transport guide 112, the pair of transport rollers 114, and the pair of transport rollers 116.

Eighth Embodiment

Figure 23:
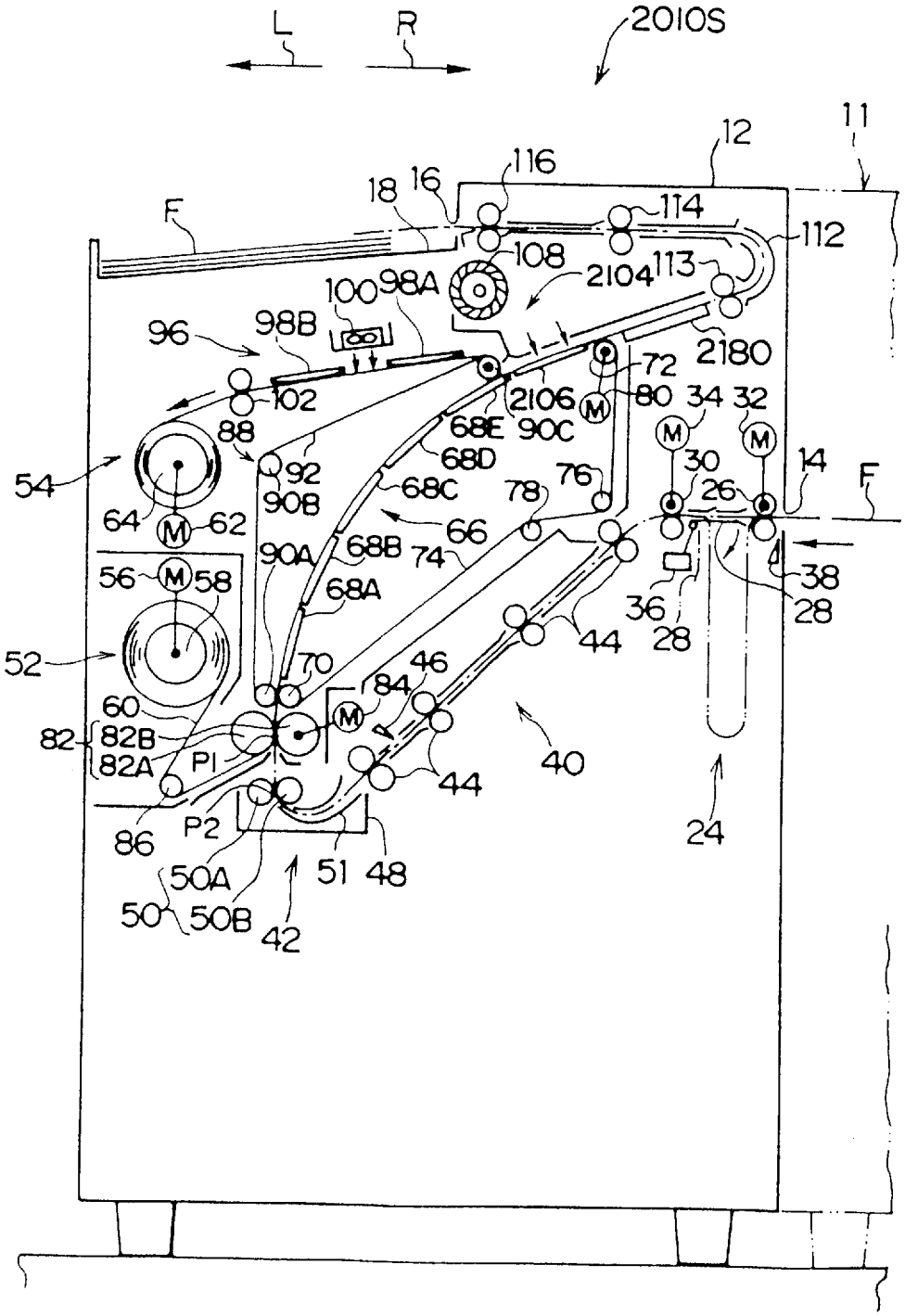
FIG. 23 is a overall diagram of the development processing apparatus in accordance with an eighth embodiment.

Referring to FIG. 23, a description will be given of an eighth embodiment. This eighth embodiment shows an example in which, in the development processing apparatus 2010 in the above-described seventh embodiment shown in FIG. 22, a cooling section 2180 for preventing a sudden change in the temperature of the film F after drying is provided on the downstream side of the heating plate 2106 for drying.

Figure 24:
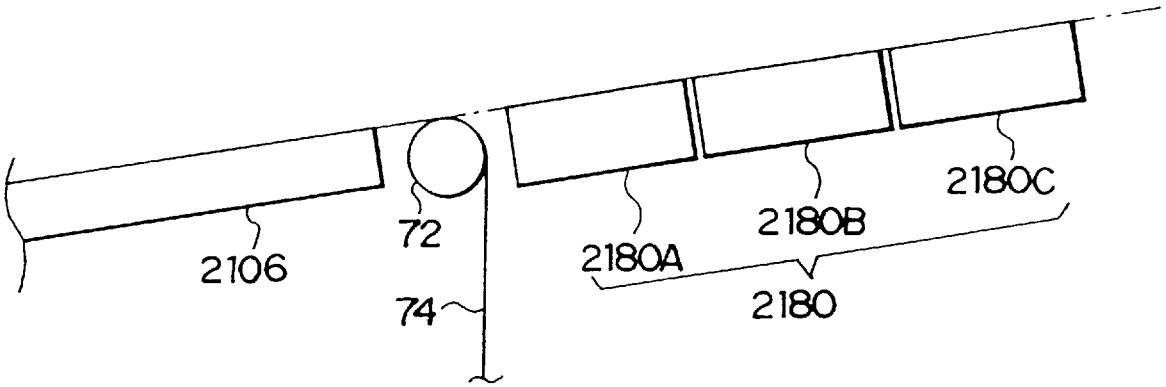
FIG. 24 is a overall diagram of the development processing apparatus in accordance with a ninth embodiment.

First, a description will be given of the arrangement of a development processing apparatus 2010S in accordance with the eighth embodiment with reference to FIGS. 23 and 24. As shown in FIG. 23, in the development processing apparatus 2010S in accordance with the eighth embodiment, the aforementioned cooling section 2180 is disposed on the downstream side, as viewed in the traveling direction of the film F, of the heating plate 2106 for drying, i.e., on the downstream side adjacent to the roller 72. As shown in FIG. 24, this cooling section 2180 is comprised of a total of three heating plates, including a heating plate 2180A for cooling whose temperature at the heating surface (the upper surface in FIG. 24) is set to 70° C., a heating plate 2180B for cooling whose temperature at the heating surface is set to 60° C., and a heating plate 2180C for cooling whose temperature at the heating surface is set to 40° C. The heating plates 2180A, 2180B, and 2180C for cooling are arranged in that order along the traveling direction of the film F.

The heating surfaces of these heating plates 2180A, 2180B, and 2180C for cooling are located in the same plane as that of the heating surface of the heating plate 2106 for drying. Consequently, consideration has been given so that no external force such as a pressing force or a bending force is applied to the film F being transported.

Further, as shown in FIG. 23, a pair of transport rollers 113 for transporting the film F toward the discharge port 16 via the substantially U-shaped transport guide 112 is disposed on the downstream side of the cooling section 2180.

Next, a description will be given of the operation of the eighth embodiment. Since development processing and dry processing after development are similar to those in the seventh embodiment, a description thereof will be omitted, and a description will be given of only cooling processing after drying.

In the film drying section 2104, the film F is dried while it is transported rectilinearly along the surface of the heating plate 2106 for drying, and as warm air from the fan 108 is blown onto its upper surface in FIG. 23. The film F, which has been dried and set in a high-temperature state of about 80° C., is further transported to the cooling section 2180. Then, in the cooling 2180, the film F is transported rectilinearly while consecutively coming into contact with the surfaces of the heating plate 2180A for cooling at about 70° C., the heating plate 2180B for cooling at about 60° C., and the heating plate 2180C for cooling at about 40° C. Consequently, the temperature of the film F which has been set in the high-temperature state of about 80° C. in the film drying section 2104 gradually declines in the cooling section 2180.

Thus, as the film F, whose temperature is higher than the glass transition temperature Tg (about 70° C.) of PET which is the base, is gradually cooled down to a temperature level lower than glass transition temperature Tg (about 70° C.) in the cooling section 2180, it is possible to obviate a situation in which the film F, which has been set in the high-temperature state of about 80° C. in the film drying section 2104, is air-cooled, and its temperature drops suddenly. Namely, it is possible to prevent the occurrence of a sudden temperature change in the film F, and prevent the occurrence of deformation in the film F.

It should be noted that, during the cooling of the film F in the cooling section 2180 (during the transport of the film F along the heating surfaces of the heating plates 2180A, 2180B, and 2180C for cooling), the film F in the high-temperature state is transported rectilinearly, and no external force is applied thereto. Hence, it goes without saying that such a deformation that would remain in the film F does not occur.

The film F, which has been gradually cooled in the cooling section 2180 in the above-described manner, is transported to the U-shaped transport guide 112 along the pair of transport rollers 113, and is subsequently transported toward the discharge port 16 by means of the pairs of transport rollers 114 and 116. When the film F has reached the transport guide 112, since the film F has already been cooled to a temperature level lower than the glass transition temperature Tg (about 70° C.) of PET, even if the film F is deformed in the substantially U-shape during its travel along the transport guide 112, its deformation does not remain.

In accordance with the above-described eighth embodiment, as the film F, whose temperature is higher than the glass transition temperature Tg (about 70° C.) of PET, is gradually cooled down to a temperature level lower than glass transition temperature Tg (about 70° C.) in the cooling section 2180, it is possible to obviate a situation in which the film F, which has been set in the high-temperature state of about 80° C. in the film drying section 2104, is air-cooled, and its temperature drops suddenly. Namely, it is possible to prevent the occurrence of a sudden temperature change in the film F, and prevent the occurrence of deformation in the film F.

It should be noted that, in the development processing apparatuses in accordance with the seventh and eighth embodiments, a description has been given of an example in which the film F whose base is constituted by PET as the silver halide photosensitive material in accordance with the present invention, and heating and drying are effected at a temperature higher than the glass transition temperature Tg (about 70° C.) of PET. However, the base of the silver halide photosensitive material is not limited to PET, and it is possible to use various materials such as those shown in Table 1 below, and heating and drying may be effected at temperatures higher than their corresponding glass transition temperatures Tg.

TABLE 1

| Material Constituting the Base | Glass Transition Temperature Tg |
|---|---|
| Polyurethane (PU) | −58 to 109 |
| Polyacryl (PMMA) | 105 |
| Polycarbonate (PC) | 141 to 150 |
| Polyethylene napthalate (PEN) | 113 |
| Polyether ether ketone (PEEK) | 143 |

Ninth Embodiment

Figure 25B:
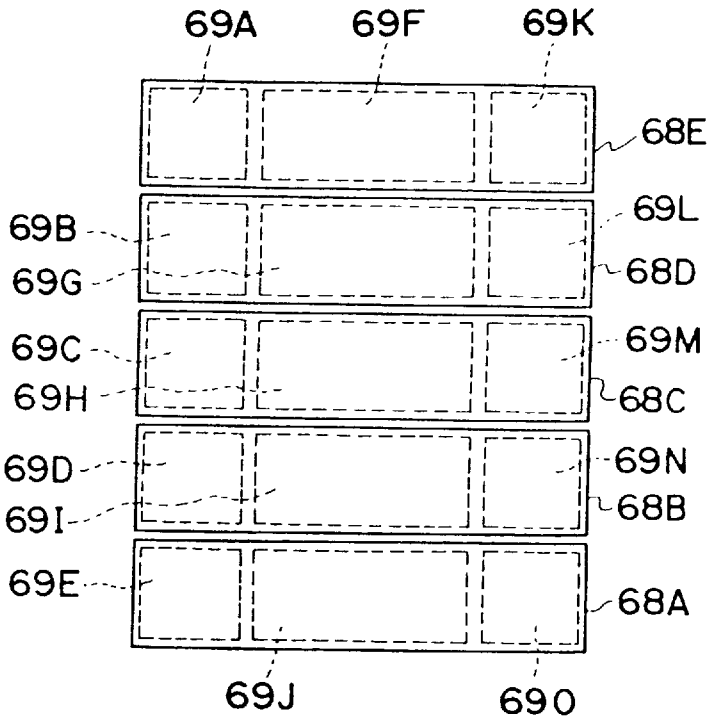
FIG. 25B is a front elevational view illustrating a state in which the plurality of heating plates provided in the heat development section in accordance with the ninth embodiment are developed in view.
Figure 25A:
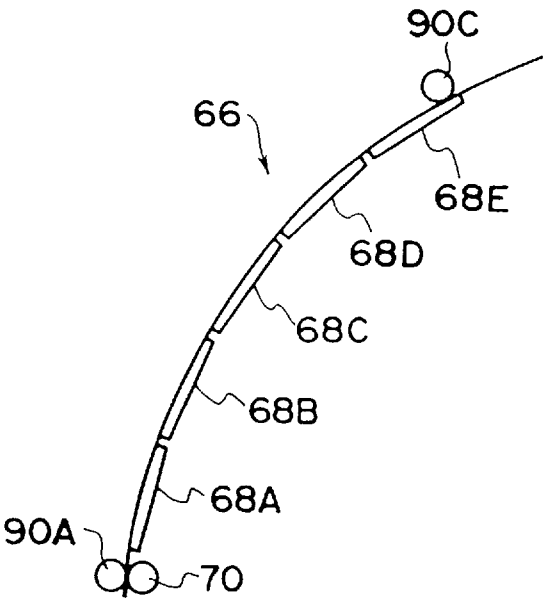
FIG. 25A is a schematic side elevational view schematically illustrating a heat development section of the development processing apparatus applied to the ninth embodiment.

A description will now be given of a ninth embodiment with reference to FIGS. 25A and 25B, and referring to FIG. 1 as necessary. This embodiment shows a preferred example of the heating means of the first embodiment, and a description will be given centering on this aspect. In this embodiment, the same parts, members, and arrangements as those of the first embodiment will be denoted by the same reference numerals as those used in the description of the first embodiment, and a detailed description thereof will be omitted.

The heat development section 66 serving as the heating means is provided in a substantially central portion of the main body 12 of the development processing apparatus 10. In the heat development section 66, the plurality of heating plates 68A to 68E are arranged in the form of a circular arc, as shown in FIGS. 1 and 25A. In this embodiment, the five heating plates 68A to 68E are provided. The above arrangement is similar to that of the first embodiment. The shapes of the heating plates 68A to 68E are substantially rectangular, as shown in FIG. 25B, and planar heaters 69A to 69O and unillustrated temperature sensors are incorporated therein. As for the heaters 69A to 69O, three heaters are incorporated in each of the heating plates 68A to 68E. The heaters 69F to 69J which are provided at the central portions of the heating plates 68A to 68E are twice as long as the heaters 69A to 69E and 69K to 69O provided at opposite end portions of the heating plates 68A to 68E.

It should be noted that since the temperatures of the plurality of heaters 69A to 69O incorporated in the heating plates 68A to 68E can be respectively set to different temperature levels by the control unit 111, temperature differences can be produced between the regions of the heating plates 68A to 68E.

In this embodiment, the temperature of the heaters 69F to 69J provided at the central portions of the heating plates 68A to 68E is set to 80° C. This is a temperature which is suitable for the heat development processing of the laminated assembly of the film F and the processing sheet 60. In contrast, the temperature of the heaters 69A to 69E and 69K to 69O provided at the opposite end portions of the heating plates 68A to 68E is set to 90° C. which is higher by predetermined degrees than the temperature of the heaters LAF 69F to 69J provided at the central portions of the heating plates 68A to 68E, i.e., the temperature which is suitable for heat development processing. Thus, the temperature setting of the heaters 69A to 69O is provided such that a temperature difference of 10° C. or thereabouts will be produced between the central portions and the opposite end portions of the heating plates 68A to 68E.

In this heat development section 66, the film F is heated by the heating plates 68A to 68E, and its temperature rises and reaches a temperature level suitable for development processing and, at the same time, the complex-formation compound, the physical development nuclei, and the silver halide solvent contained in the processing sheet 60 act on the film F, thereby forming images on the film F.

As described above, the heating plates 68A to 68E are heated by the heaters 69A to 69O such that the temperature of their central portions is set to the temperature level suitable for heat development processing and the temperature of their opposite end portions becomes higher by predetermined degrees than the temperature of the central portions. Hence, when the laminated assembly of the film F and the processing sheet 60 is transported along the surfaces of the heating plates 68A to 68E, the elongation of the opposite end portions of the processing sheet 60 becomes greater than that of the central portion thereof. Accordingly, the slack in the vicinity of the central portion of the processing sheet 60 can be alleviated, making it possible to prevent the occurrence of creases.

As a result, since the film F and the processing sheet 60 are transported along the surfaces of the heating plates 68A to 68E in a state in which the film F and the processing sheet 60 are reliably held in close contact with each other, it is possible to form desired images on the film F.

Next, a description will be given of the operation in accordance with this embodiment.

In the heat development section 66, the film F and the processing sheet-60 which were laminated by the pair of laminating rollers 82 are transported while being urged toward the heating plates 68A to 68E side by the urging device 88, and coming into contact with or in close proximity to the heating surfaces of the heating plates 68A to 68E. At this time, the heating plates 68A to 68E are heated by the heaters 69A to 69O provided thereon in a state in which a temperature difference is produced between the regions of the heating plates 68A to 68E.

In this embodiment, the temperature of the central portions of the heating plates 68A to 68E is set to a temperature level (80° C.) suitable for heat development processing by the heaters 69F to 69J provided at the central portions of the heating plates 68A to 68E, while the temperature of the opposite portions of the heating plates 68A to 68E is heated at a temperature (90° C.) which is higher by predetermined degrees.

Consequently, the elongation of the opposite end portions of the processing sheet 60, which is transported along the surfaces of the heating plates 68A to 68E, becomes greater than that of the central portion thereof. Therefore, the slack which is likely to occur in the vicinity of the central portion of the processing sheet 60 during the transport can be alleviated, making it possible to prevent the occurrence of creases. Thus, since the film F and the processing sheet 60 are transported along the surfaces of the heating plates 68A to 68E in a state in which the film F and the processing sheet 60 are reliably held in close contact with each other, and heat development processing is effected, it is possible to form desired images on the film F.

Although, in this embodiment, a description has been given of the arrangement in which five heating plates 68A to 68E are provided in the heat development section 66, and three of the heaters 69A to 69O are provided for each of the heating plates 68A to 68E, the present invention is not limited to the same.

Figure 26:
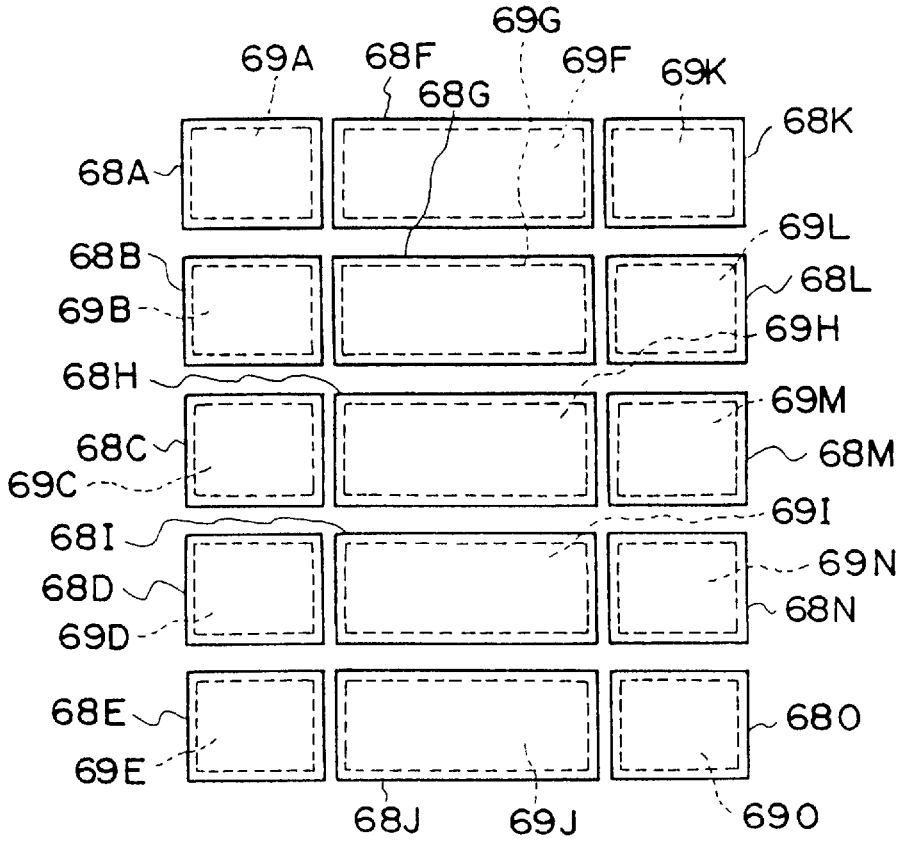
FIG. 26 is a schematic front elevational view illustrating the heating plates of the heat development section as a modification of the ninth embodiment.

For example, an arrangement may be provided such that, as shown in FIG. 26, each of the heating plates is divided into regions, and each of the heating plates 68A to 68O is provided with one heater. In this case as well, an arrangement may be provided such that the temperature of the heaters 69F to 69J provided on the heating plates 68F to 68J corresponding to the central portions is set to a temperature level suitable for heat development processing, whereas the temperature of the heaters 69A to 69E and 69K to 690 provided on the heating plates 68A to 68E and 68K to 68O corresponding to the opposite end portions is set to a temperature level which is higher by predetermined degrees than the temperature of the heaters 69F to 69J provided on the central portions. Thus, the film F and the processing sheet 60 may be heated in the state in which a predetermined temperature difference is produced between the central portions and the opposite end portions of the heating plates 68A to 68E.

Figure 27A:
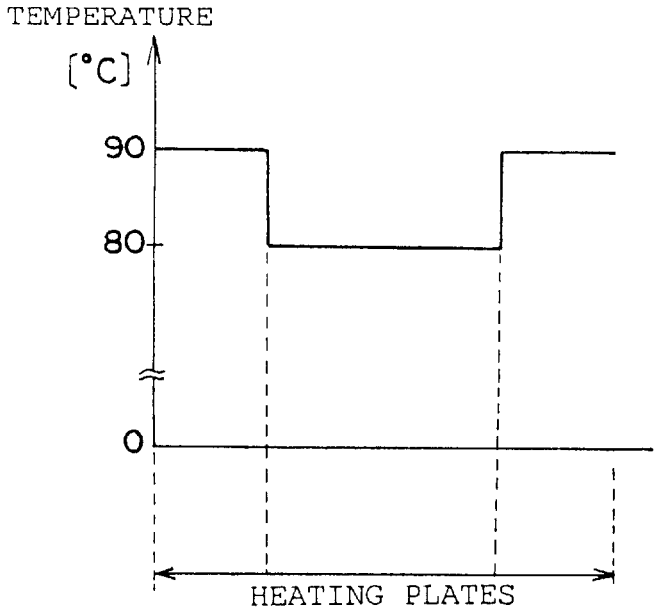
FIG. 27A is a graph illustrating a temperature distribution of the heating plates of the heat development section which can be used in the ninth embodiment and its modification, and illustrates a case in which the temperature setting has been provided such that a temperature difference occurs in steps between the central portions and the opposite end portions of the heating plates.

In addition, although in this embodiment the temperature setting (temperature distribution) of the heaters 69A to 69O provided on the heating plates 68A to 68E of the heat development section 66 is provided such that, as shown in FIG. 27A, the temperature of the heaters 69F to 69J provided at the central portions of the heating plates 68A or,Z to 68E is set to 80° C., and the temperature of the heaters 69A to 69E and 69K to 69O provided at the opposite end portions of the heating plates 68A to 68E is set to 90° C., so as to produce a step-like temperature difference between the central portions and the opposite end portions, the present invention is not limited to such a setting method.

Figure 27B:
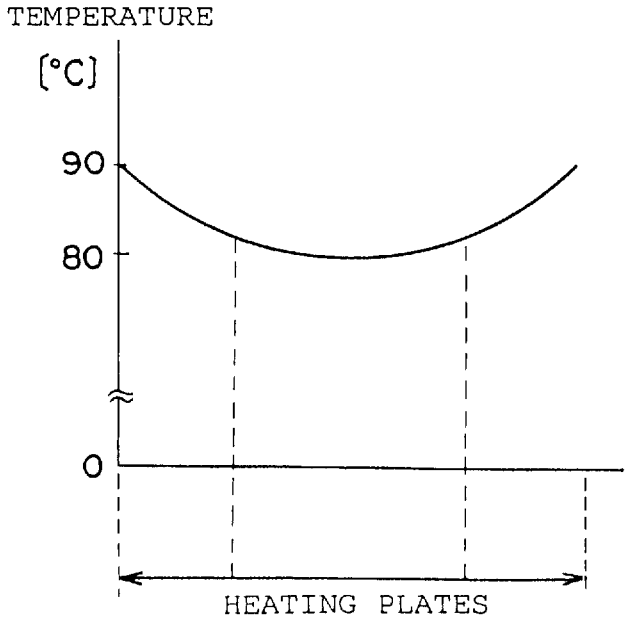
FIG. 27B is a graph illustrating a temperature distribution of the heating plates of the heat development section which can be used in the ninth embodiment and its modification, and illustrates a case in which the temperature setting has been provided such that a temperature difference occurs continuously between the central portions and the opposite end portions of the heating plates.

For example, the temperature setting may be provided such that, as shown in FIG. 27B, a continuous temperature difference is produced from the opposite end portions to the central end portions of the heating plates 68A to 68E. However, in this case as well, the temperature at the central portions of the heating plates 68A to 68E should preferably be set to a temperature suitable for heat development processing.

Further, although the arrangement provided in this embodiment is such that a predetermined temperature difference is produced between the central portions and the opposite end portions of the heating plates 68A to 68E, the central portions and the opposite end portions of the heating plates 68A to 68E may be made to correspond to the image-forming region and the non-image-forming region of the film F. Namely, regions where images are to be formed are determined in advance in the film F, and if the processing sheet 60 is set in a state in which the processing sheet 60 is reliably kept in close contact with the image-forming region, a desired image can be formed on the film F. Accordingly, by effecting heating such that the central portions of the heating plates 68A to 68E correspond to the image-forming regions of the film F, and the opposite end portions of the heating plates 68A to 68E correspond to the non-image-forming regions of the film F, the processing sheet 60 is set in a state of close contact with the image-forming regions of the film F, thereby making it possible to form desired images.

10th Embodiment

A 10th embodiment shows a preferred example the transport belt 74 which constitutes the transporting means of the heat development section 66 in accordance with the first embodiment. Accordingly, a description will be given of this transport belt 74 in accordance with the 10th embodiment with reference to FIGS. 28A, 28B, and 28C.

Figure 28A:
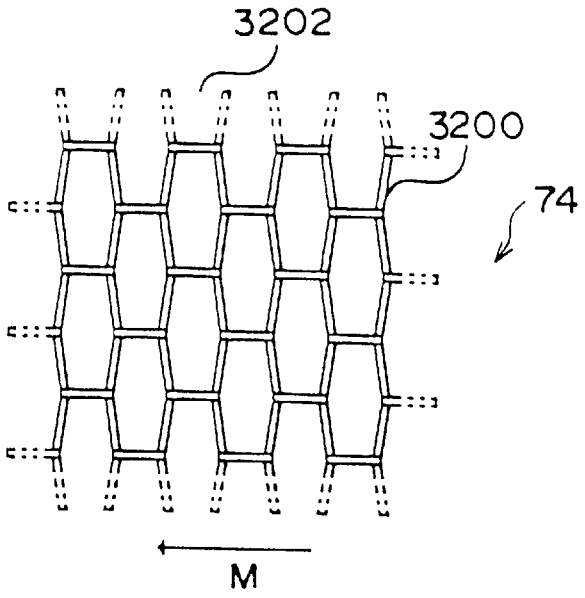
FIG. 28A is a diagram for explaining a transport belt in accordance with a 10th embodiment, and illustrates a woven state of a web.
Figure 28B:
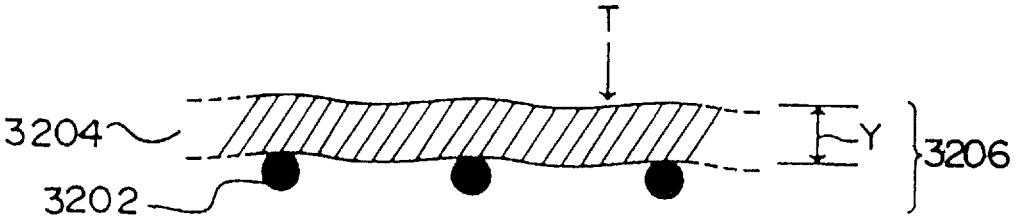
FIG. 28B is a diagram for explaining the transport belt in accordance with the 10th embodiment, and illustrates a cross-sectional view of a coarse belt.
Figure 28C:
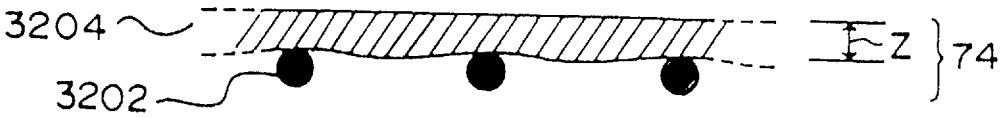
FIG. 28C is a diagram for explaining the transport belt in accordance with the 10th embodiment, and illustrates a cross-sectional view of the transport belt.

The transport belt 74, which is used for heat development in the heat development section 66, is formed by a web, which is formed by mesh-like heat-resistant silicone core members, and electrically conductive silicone rubber which is applied to the web and whose film F side has been smoothed. Referring next to FIGS. 28A to 28C, a description will be given of the process of fabrication of the transport belt 74. Incidentally, FIG. 28A is a diagram illustrating a woven state of the web in the transport belt 74. FIG. 28B is a cross-sectional view of a coarse belt 3206 which is the transport belt 74 prior to grinding and polishing and will be described later. FIG. 28C is a cross-sectional view of the transport belt 74 after grinding and polishing.

First, as shown in FIG. 28A, heat-resistant silicone core members 3200 (e.g., tradename: Nomex, manufactured by du Pont) are woven into a mesh form to fabricate a web 3202. Since the web 3202 is fabricated into the mesh form by using the heat-resistant silicone core members 3200, the web 3202 extremely excels in elasticity. Incidentally, the direction of arrow M shows the direction in which the film F is transported by the photosensitive material belt 74 using the web 3202.

In this embodiment, Nomex with a diameter of 0.35 mm was used as the heat-resistant silicone core member 3200, and the thickness of the web 3202 was set to 0.35 mm or thereabouts.

Next, as shown in FIG. 28B, electrically conductive silicone rubber 3204 was applied to one surface of the web 3202 to fabricate the coarse belt 3206. In the web 3202, since the heat-resistant silicone core members 3200 are woven into the mesh form as shown in FIG. 28A, open spaces are present between the strands of the heat-resistant silicone core members 3200. Due to the effect of the open spaces, the upper surface T of the electrically conductive silicone rubber 3204 of the coarse belt 3206 is irregular.

Incidentally, the thickness Y of the coat of the electrically conductive silicone rubber 3204 at this time is preferably 0.4 to 0.5 mm or thereabouts in this embodiment.

Finally, as shown in FIG. 28C, the upper surface T of the electrically conductive silicone rubber 3204 coated on the surface of the coarse belt 3206 is ground and polished, thereby fabricating the transport belt 74. Thanks to this grinding and polishing process, the irregularities on the surface of the electrically conductive silicone rubber 3204 are removed to obtain a smooth surface.

The grinding and polishing in this embodiment is carried out so that the thickness Z of the electrically conductive silicone rubber 3204 of the transport belt 74 which is obtained after grinding and polishing becomes 0.3 mm or thereabouts. Accordingly, the thickness of the transport belt 74 becomes 0.65 mm or thereabouts. In addition, as for the finished state of the surface obtained by grinding and polishing in this embodiment, the grinding and polishing is effected until the a center line average height Ra becomes 1.6a or thereabouts.

The transport belt 74 fabricated in the above-described process is used by being wound around the respective rollers in the heat development section 66, such that the ground and polished surface becomes the surface which comes into contact with the film F when the film F is transported.

Although, in this embodiment, a description has been given of the case where the photosensitive-material transport belt 74 is fabricated by using the heat-resistant silicone core members 3200 and the electrically conductive silicone rubber 3204, the present invention is not limited to the same, and it suffices to use any material insofar as it exhibits elasticity, heat resistance, and durability.

Further, although, in this embodiment, a description has been given of the case where the smoothing of the transport belt is effected only for the photosensitive-material transport belt 74, the present invention is not limited to the same. For example, the smoothing may be effected only for the belt 92, or may be effected for both the photosensitive-material transport belt 74 and the belt 92. In the case where both the photosensitive-material transport belt 74 and the belt 92 are smoothed, it becomes possible to suppress the unevenness in density and the transfer of mesh marks as compared with the case where only either one of the belts is smoothed.

What is claimed is:

1. A development processing apparatus comprising:

laminating means for laminating a silver halide photosensitive material on which an image has been exposed and a processing sheet containing chemicals for forming an image on the silver halide photosensitive material;

heating means having a curved heating surface for subjecting the silver halide photosensitive material to development processing by heating the silver halide photosensitive material and the processing sheet laminated by said laminating means;

first transporting means for transporting the silver halide photosensitive material and the processing sheet laminated by said laminating means along the heating surface of said heating means to allow said heating means to effect the development processing; and separating means for separating the silver halide photosensitive material and the processing sheet after completion of the development processing by said heating means.

2. A development processing apparatus according to claim 1, wherein said separating means is arranged such that the processing sheet is separated by undergoing a change in direction with a small radius of curvature and at 90° or more with respect to a direction in which the silver halide photosensitive material and the processing sheet are transported.

3. A development processing apparatus according to claim 2, further comprising:

spacing-apart means for spacing apart the processing sheet from the heating surface of said heating means when the development processing is not being effected.

4. A development processing apparatus according to claim 1, further comprising:

spacing-apart means for spacing apart the processing sheet from the heating surface of said heating means when the development processing is not being effected.

5. A development processing apparatus according to claim 1, wherein said heating means is formed by arranging a plurality of plate-shaped members with a predetermined curvature along a direction in which the silver halide photosensitive material and the processing sheet are transported by said first transporting means.

6. A development processing apparatus according to claim 1, further comprising:

temperature-range maintaining means for maintaining a difference between a temperature of the silver halide photosensitive material during lamination by said laminating means and a temperature of the silver halide photosensitive material heated by said heating means during transport by said first transporting means such that the temperature difference falls within a predetermined range.

7. A development processing apparatus according to claim 1, further comprising:

preheating means for preheating at least one of said laminating means and the processing sheet prior to its lamination by said laminating means.

8. A development processing apparatus according to claim 1, wherein said heating means is a heating plate, and said development processing apparatus further comprises pressing means for pressing a laminated assembly of the silver halide photosensitive material and the processing sheet toward said heating plate with a weak force equal to or less than a predetermined value at an early period of time when transport of the laminated assembly of the silver halide photosensitive material and the processing sheet is started along a heating surface of said heating plate by said first transporting means.

9. A development processing apparatus according to claim 1, wherein said heating means is a heating plate, and said development processing apparatus further comprises nonpressing means for maintaining a laminated assembly of the silver halide photosensitive material and the processing sheet in a nonpressed state with respect to a direction toward said heating plate at an early period of time when transport of the laminated assembly of the silver halide photosensitive material and the processing sheet is started along a heating surface of said heating plate.

10. A development processing apparatus according to claim 1, wherein said heating means is a heating plate, and said laminating means is constituted by a pair of laminating rollers for nipping and laminating the silver halide photosensitive material and the processing sheet, a portion of a heating surface of said heating plate which is in close proximity to said pair of laminating rollers being located on a tangential line which passes a point of contact between said pair of laminating rollers.

11. A development processing apparatus according to claim 1, wherein said first transporting means is constituted by a transport belt whose surface facing a laminated assembly of the silver halide photosensitive material and the processing sheet has been smoothed.

12. A development processing apparatus according to claim 11, wherein said transport belt is formed by a web formed by weaving heat-resistant fibers into mesh form and a heat-resistant elastic material layer applied to the web to a predetermined depth, and the smoothing of said transport belt is effected by grinding and polishing the heat-resistant elastic material layer.

13. A development processing apparatus according to claim 12, wherein the heat-resistant fibers are heat-resistant silicone core members, and the heat-resistant elastic material is an electrically conductive silicone rubber.

14. A development processing apparatus according to claim 1, wherein said heating means is a heating plate, and said development processing apparatus further comprises a pressing roller disposed in a vicinity of a rear end of a transporting path of said first transporting means and adapted to press the silver halide photosensitive material and the processing sheet toward a heating surface of said heating plate with a predetermined pressure immediately before the silver halide photosensitive material and the pressing sheet are separated by said separating means.

15. A development processing apparatus according to claim 1, wherein said separating means is constituted by a separating roller around which, of the laminated silver halide photosensitive material and processing sheet, the processing sheet is wound, said separating roller being urged in a direction in which said separating roller presses the processing sheet with a force which is uniform in a direction substantially perpendicular to the direction in which the processing sheet is transported by said first transporting means.

16. A development processing apparatus according to claim 1, wherein said heating means is a heating plate, and said development processing apparatus further comprises spacing-apart means for spacing apart the processing sheet from the heating surface of said heating means when the development processing of the silver halide photosensitive material is not being effected.

17. A development processing apparatus according to claim 1, wherein said laminating means is constituted by a pair of laminating rollers for nipping and laminating the silver halide photosensitive material and the processing sheet, an angle at which the processing sheet is fed into a nip between said pair of laminating rollers being arranged to be smaller than a predetermined angle with respect to a tangential line which passes the nip.

18. A development processing apparatus according to claim 1, wherein the processing sheet has been wound in roll form, and said development processing apparatus further comprises:

feeding and rewinding means capable of feeding the processing sheet to supply the processing sheet to said laminating means and capable of rewinding the processing sheet which has been fed;

applying means for applying an image-forming solvent to at least one of the processing sheet and the silver halide photosensitive material before the silver halide photosensitive material and the processing sheet fed by said feeding and rewinding means are laminated by said laminating means; and rewinding control unit for controlling said feeding and rewinding means to allow the processing sheet to be rewound by said feeding and rewinding means in a case where a region which was not used in the development processing is present in the processing sheet after the processing sheet was fed by said feeding and rewinding means and was used in the development processing, such that the region which was not used in the development processing can be laminated on the silver halide photosensitive material subject to next development processing.

19. A development processing apparatus according to claim 18, wherein said rewinding control means controls said feeding and rewinding means such that said feeding and rewinding means rewinds the processing sheet after each completion of the development processing in the control for rewinding the processing sheet.

20. A development processing apparatus according to claim 18, wherein said rewinding control means controls said feeding and rewinding means such that said feeding and rewinding means rewinds the processing sheet after completion of a series of continuous development processing.

21. A development processing apparatus according to claim 1, further comprising:

applying means for applying an image-forming solvent to at least one of the processing sheet and the silver halide photosensitive material before the silver halide photosensitive material and the processing sheet are laminated by said laminating means, wherein said heating means heats the silver halide photosensitive material and the processing sheet in the presence of the image-forming solvent.

22. A development processing apparatus according to claim 21, further comprising:

an accommodating section for accommodating the processing sheet and feeding the processing sheet for the development processing;

a collecting section for collecting the processing sheet separated from the silver halide photosensitive material by said separating means; and discharging means provided in said apparatus and adapted to discharge the silver halide photosensitive material, separated from the processing sheet by said separating means, outside said apparatus.

23. A development processing apparatus according to claim 1, further comprising:

applying means for applying an image-forming solvent to at least one of the processing sheet and the silver halide photosensitive material before the silver halide photosensitive material and the processing sheet are laminated by said laminating means;

second transporting means for transporting the silver halide photosensitive material in a substantially vertical direction toward said laminating means; and third transporting means for transporting the processing sheet toward said laminating means, wherein said laminating means is arranged to hold the silver halide photosensitive material in a substantially vertical state in a state in which the silver halide photosensitive material is spaced apart from said second transporting means, and to laminate the silver halide photosensitive material and the processing sheet transported by said third transporting means, and said heating means is arranged to heat the processing sheet and the silver halide photosensitive material in the presence of the image-forming solvent.

24. A development processing apparatus according to claim 23, wherein said second transporting means is arranged to transport the silver halide photosensitive material upward, and said laminating means is disposed above said second transporting means and is arranged to receive the silver halide photosensitive material.

25. A development processing apparatus according to claim 1, further comprising:

applying means for applying an image-forming solvent to the silver halide photosensitive material before the silver halide photosensitive material and the processing sheet are laminated by said laminating means;

a heating plate which is disposed adjacent to said heating means and whose temperature is set to be higher than a glass transition temperature of a base member of the silver halide photosensitive material and substantially equivalent to a temperature of said heating means, so as to subject the silver halide photosensitive material separated by said separating means to dry processing; and fourth transporting means for rectilinearly transporting the silver halide photosensitive material separated by said separating means, along a surface of said heating plate for drying.

26. A development processing apparatus according to claim 25, further comprising:

a fan disposed in such a manner as to oppose said heating plate for drying and adapted to blow warm air onto the silver halide photosensitive material separated by said separating means.

27. A development processing apparatus according to claim 25, further comprising:

a heating plate for cooling which is disposed adjacent to said heating plate for drying and whose temperature is set to be lower than the glass transition temperature of the base member of the silver halide photosensitive material, wherein said fourth transporting means is arranged to transport the silver halide photosensitive material subjected to the dry processing rectilinearly along a surface of said heating plate for cooling.

28. A development processing apparatus according to claim 26, further comprising:

a heating plate for cooling which is disposed adjacent to said heating plate for drying and whose temperature is set to be lower than the glass transition temperature of the base member of the silver halide photosensitive material, wherein said fourth transporting means is arranged to transport the silver halide photosensitive material subjected to the dry processing rectilinearly along a surface of said heating plate for cooling.

29. A development processing apparatus according to claim 1, wherein said heating means is constituted by a plurality of heating plates each having the heating surface, said plurality of heating plates being arranged in a curved form, and said development processing apparatus further comprises:

controlling means for controlling said plurality of heating plates such that a temperature of a central portion, as viewed in a direction substantially perpendicular to a direction of transport by said first transporting means, of the heating surface of each of said plurality of heating plates becomes suitable for the development processing, and such that a temperature of each opposite end portion, as viewed in the direction substantially perpendicular to the direction of transport by said first transporting means, of the heating surface of each of said plurality of heating plates becomes higher by predetermined degrees than the temperature suitable for the development processing;

drying means for respectively subjecting to dry processing the silver halide photosensitive material and the processing sheet which have been separated by said separating means; and discharging means for discharging the silver halide photosensitive material subjected to the dry processing outside said development processing apparatus.

30. A development processing apparatus according to claim 29, wherein said controlling means controls said heating means such that the temperature of the central portions of the heating surfaces becomes suitable for the development processing, the central portions corresponding to an image-forming region of the silver halide photosensitive material, and such that the temperature of the opposite end portions of the heating surfaces becomes higher by the predetermined degrees than the temperature suitable for the development processing, the opposite end portions corresponding to a non-image-forming region of the silver halide photosensitive material.

31. A development processing apparatus according to claim 1, further comprising:

second transporting means for transporting the silver halide photosensitive material in a substantially vertical direction toward said laminating means.

32. A development processing apparatus according to claim 31, wherein said laminating means is constituted by a pair of laminating rollers for nipping and laminating the silver halide photosensitive material and the processing sheet, said development processing apparatus further comprising:

a means for feeding the processing sheet, to the nip between said pair of laminating rollers, at an angle with respect to a line which passes through the nip and is tangent to both laminating rollers.

33. A development processing method comprising the steps of:

laminating a silver halide photosensitive material on which an image has been exposed and to which an imageforming solvent has been applied and a processing sheet containing chemicals for forming an image on the silver halide photosensitive material;

effecting development processing of the silver halide photosensitive material by heating the silver halide photosensitive material and the processing sheet, laminated by said laminating means, to a temperature suitable for the development processing by means of predetermined heating means;

separating the processing sheet and the silver halide photosensitive material after completion of the development processing; and drying the silver halide photosensitive material by transporting the separated silver halide photosensitive material rectilinearly along a surface of a heating plate for drying whose temperature has been set to be higher than a glass transition temperature of a base member of the silver halide photosensitive material and substantially equivalent to a temperature of said heating means.

* * * * *